US007823421B2

(12) United States Patent
Hashimoto

(10) Patent No.: US 7,823,421 B2
(45) Date of Patent: Nov. 2, 2010

(54) WASHING APPARATUS

(75) Inventor: Hideo Hashimoto, Uji (JP)

(73) Assignee: Happy Co., Ltd., Uji, Kyoto (JP)

( * ) Notice: Subject to any disclaimer, the term of this patent is extended or adjusted under 35 U.S.C. 154(b) by 449 days.

(21) Appl. No.: 11/658,873

(22) PCT Filed: Aug. 30, 2006

(86) PCT No.: PCT/JP2006/017142

§ 371 (c)(1),
(2), (4) Date: Jan. 30, 2007

(87) PCT Pub. No.: WO2007/102234

PCT Pub. Date: Sep. 13, 2007

(65) Prior Publication Data

US 2009/0199600 A1 Aug. 13, 2009

(30) Foreign Application Priority Data

Mar. 7, 2006 (JP) ..... 2006-061937
Jun. 5, 2006 (JP) ..... 2006-156314
Aug. 28, 2006 (JP) ..... 2006-231413

(51) Int. Cl.
*D06F 21/04* (2006.01)
*D06F 33/02* (2006.01)
*D06F 37/06* (2006.01)

(52) U.S. Cl. ..... 68/12.05; 68/12.21; 68/24; 68/142

(58) Field of Classification Search ..... 68/24, 68/142, 12.01, 12.05, 12.19, 12.21
See application file for complete search history.

(56) References Cited

U.S. PATENT DOCUMENTS 1,641,780 A * 9/1927 Parker ..... 210/122

(Continued)

FOREIGN PATENT DOCUMENTS

DE 29 15 092 10/1979

(Continued)

OTHER PUBLICATIONS

European Search Report dated Apr. 4, 2009 issued in corresponding Application No. 06797114.3-2314/2014815.

*Primary Examiner*—Joseph L Perrin
(74) *Attorney, Agent, or Firm*—Global IP Counselors, LLP

(57) ABSTRACT

The washing apparatus has a frame body 18 to be filled with a cleaning liquid. The frame body 18 is rotated within a casing by a drive motor 23. The frame body 18 has an inner periphery having a wavy patterned surface. An inner diameter D of the frame body 18 is set to more than or equal to 600 mm and less than or equal to 850 mm. The frame body 18 is rotated so that a peripheral speed of the inner periphery 39 is more than or equal to 28 m/min and less than or equal to 57 m/min. A height h of the wave form is set to more than or equal to 2.0% and less than or equal to 9.0% of the inner diameter D, and a pitch p of the wave form is set to more than or equal to 2.0% and less than or equal to 9.0% of a peripheral length L of an imaginary circle having a diameter of the inner diameter D.

12 Claims, 7 Drawing Sheets

U.S. PATENT DOCUMENTS

| | | | | |
|---|---|---|---|---|
| 1,850,951 | A * | 3/1932 | Allbright | 452/123 |
| 1,943,709 | A | 1/1934 | Wilkins | |
| 2,591,143 | A * | 4/1952 | Eilersgaard | 68/140 |
| 5,029,458 | A * | 7/1991 | Obata et al. | 68/19.2 |
| 5,207,764 | A * | 5/1993 | Akabane et al. | 68/20 |
| 6,502,433 | B1 * | 1/2003 | Uhlin | 68/24 |
| 6,843,079 | B2 * | 1/2005 | Hird | 68/13 R |
| 2001/0027580 | A1 * | 10/2001 | Back et al. | 8/158 |
| 2005/0132755 | A1 * | 6/2005 | Sundell et al. | 68/3 R |
| 2005/0257576 | A1 * | 11/2005 | Omura et al. | 68/12.05 |

FOREIGN PATENT DOCUMENTS

| | | | |
|---|---|---|---|
| DE | 88 00 891.6 | | 4/1988 |
| DE | 93 10 938.5 | | 10/1993 |
| EP | 0 288 722 | | 11/1988 |
| EP | 0 533 004 | | 3/1993 |
| GB | 2 268 939 | | 1/1994 |
| JP | 35-31858 | U | 11/1959 |
| JP | 60-246790 | A | 12/1985 |
| JP | 4-61893 | A | 2/1992 |
| JP | 4-164494 | A | 6/1992 |
| JP | 6-238086 | A | 8/1994 |
| JP | 9-248395 | A | 9/1997 |
| JP | 9-276582 | A | 10/1997 |
| JP | 11-169579 | A | 6/1999 |
| JP | 11-267391 | A | 10/1999 |
| JP | 2001-269495 | A | 10/2001 |
| JP | 2002-58892 | A | 2/2002 |
| JP | 2003-260290 | A | 9/2003 |
| JP | 2004-057657 | | 2/2004 |

* cited by examiner

WASHING APPARATUS

TECHNICAL FIELD

This invention relates to an apparatus for washing clothes and the like.

BACKGROUND ART

As a method of washing clothes made from wool for example, a washing method called dry cleaning has widely been known. The dry cleaning is a method of cleaning clothes using a petroleum solvent or an organic solvent as a cleaning liquid. The dry cleaning is the washing method capable of preventing loss of shapes shrinkage, swelling, and the like of the clothes while washing clothes conveniently. This is one of reasons of the widespread of the dry cleaning.

More specifically, contaminations adhering to clothes are usually of water-soluble contaminations such as sweat, foods, and mud. In order to perfectly clean such water-soluble contaminations, it is necessary to wash the clothes with water. However, when clothes made from wool are washed with water, scales formed on a surface of fibers (wool) are damaged to change a fabric to a felt-like one. When the fabric becomes feltish, the clothes are hardened to loose the original texture and to be difficult to wear. However, when a petroleum solvent or the like is used as the cleaning liquid, the above-described fabric change does not occur. Therefore, the dry cleaning has widely been employed as a clothes-washing method.

However, in a case where the petroleum solvent is used as the cleaning liquid, the water-soluble contaminations adhering to the clothes are not cleaned perfectly, and yellowing and the like of the clothes can occur later on. That is, the dry cleaning is employed for the purpose of avoiding the risk of damage on clothes even when it is necessary to wash the clothes with water in order to perfectly clean the contaminations of the clothes.

Washing methods employed for conventional washing apparatuses can be divided into two types. One of them is a washing method utilizing a rotating current of a washing liquid (see, for example, Patent Publication 1), and the other is a washing method utilizing a mechanical force (see, for example, Patent Publications 2 and 3).

With the washing method utilizing the rotating current of the cleaning liquid, a washing tub is rotated about a rotation shaft disposed in a substantially vertical direction. In such a washing tub, the cleaning liquid is rotated in a substantially horizontal direction. Clothes are cleaned by means of the rotating current of the cleaning liquid. On the other hand, with the washing method utilizing the mechanical force, a washing tub is rotated about a rotation shaft disposed in a substantially horizontal direction. In such a washing tub, clothes placed therein are moved upward along an inner wall surface of the washing tub and then fall down. The clothes are cleaned by means of impact caused when the clothes fall on the inner wall surface of the washing tub. That is, with the washing method utilizing the rotating current of the cleaning liquid, the contaminations are separated when the clothes are twisted round by means of the rotating cleaning liquid. On the other hand, with the washing method utilizing the mechanical force, the contaminations are separated by means of the impact applied on the clothes. In both washing methods, burden on the fabrics is large, and, though a certain cleaning effect is achieved by the washing methods, the fabrics are steadily damaged.

Conventional washing apparatuses and washing methods are disclosed in Patent Publications 1 to 12 listed below. Particularly, Patent Publication 4 (JP-A-4-61893) discloses a washing method for flipping a laundry article by means of a jet current and a washing machine for performing the washing method. As disclosed in Patent Publication 4, the washing machine is provided with an outer barrel (1) and an inner barrel (4). The laundry article is placed in the inner barrel (4), and the outer barrel (1) is filled with a washing liquid. A propelling wing (18) is disposed in a space communicated with an interior of the outer barrel (1). When the propelling wing (18) is rotated, a strong swirling current of the washing liquid is generated in the outer barrel (1). The laundry article is twisted round by the swirl of the washing liquid, so that the contaminations are cleaned.

Patent Publication 1: JP-A-2002-58892
Patent Publication 2: JP-A-2003-260290
Patent Publication 3: JP-A-2001-269495
Patent Publication 4: JP-A-4-61893
Patent Publication 5: JP-A-4-164494
Patent Publication 6: JP-A-9-248395
Patent Publication 7: JP-A-9-276582
Patent Publication 8: JP-A-6-238086
Patent Publication 9: JP-A-11-169579
Patent Publication 10: JP-A-60-246790
Patent Publication 11: JP-UM-B-35-31858
Patent Publication 12: JP-A-11-267391

DISCLOSURE OF THE INVENTION

Problems to be Solved by the Invention

As explained above, with a conventional washing machine disclosed in Patent Publication 4, the laundry article is thrown in the washing liquid filled in the washing tub and then contaminations adhering to the laundry article is cleaned by the strong current of the washing liquid. Patent Publication 4 shows that the washing machine does not cause damage on the laundry article and exhibits a strong detergency (see page 4, fourth line of upper right column to lower left column). However, since the conventional washing machine disclosed in Patent Publication 4 utilizes the strong swirl of the washing liquid generated by the propelling wing (18) as explained in the foregoing, the washing method is far from being harmless for the laundry article. More specifically, with the conventional washing machine disclosed in Patent Publication 4, a swirling jet current turning around repeatedly in the vertical direction of the inner barrel is generated and the swirling jet current strongly moves the laundry article vertically. That is, the laundry article is cleaned in such a manner that the laundry article is pressed against an inner upper surface and an inner lower surface of the inner barrel to be rubbed and, at the same time, twisted round and then untwisted. Therefore, with such a washing method, the damage on the laundry article is not small at all, and it is apparent that the laundry article is strongly twisted so that the fibers constituting the laundry article are damaged. Moreover, when water is used as a cleaning liquid, it is very much predictable that the fabrics will be greatly damaged.

Meanwhile, a washing process is then followed by finishing work to fix the shape of the laundry article. In commercial laundry, this finishing work (press finishing) is extremely important. As described in the foregoing, however, the fibers constituting the laundry article, when damaged through such washing, will cause loss of shape and original texture of the laundry article. Such loss of shape and the like are not easy to correct through the finishing work. Moreover, even with very careful finishing work, it is extremely difficult to fix the damage of the fibers completely to restore the original texture.

Some clothing items such as a lounge suit comprise a plurality of types of fabrics. And each type of such fabrics has a different shrinkage factor in washing. Therefore, in general, the more types of fabrics a clothing item comprises, the more loss of shape it suffers. Thus, it is extremely difficult to correct, through finishing work, the loss of shape of a clothing item comprising a plurality of fabrics having different shrinkage factors.

Therefore, an object of this invention is to provide a washing apparatus for softly washing clothes with water without damaging fabrics thereof even when the fabrics are delicate ones such as wool.

Means for Solving the Problems (1) In order to attain the object, a washing machine according to a first aspect of the present invention comprises: an outer casing filled with a cleaning liquid containing a surfactant and tightly sealed; a cylindrical basket-like washing tub being disposed in the outer casing, an inner periphery of the cylindrical basket-like washing tub having a shape of a wavy patterned surface in a form of a sine curve with protrusions protruding in radial directions of the cylindrical basket-like washing tub; and a rotating mechanism for rotating the cylindrical basket-like washing tub about a central shaft in the outer casing while supporting the cylindrical basket-like washing tub in such a manner that the central shaft thereof is held horizontally. An inner diameter D of the cylindrical basket-like washing tub is set to more than or equal to 300 mm and less than or equal to 500 mm. The rotating mechanism rotates the cylindrical basket-like washing tub so that a peripheral speed of the inner periphery thereof is more than or equal to 28 m/min and less than equal to 57 m/min. A height h of a shape of a wavy patterned surface formed by the inner periphery of the cylindrical basket-like washing tub is set to more than or equal to 2.0% and less than or equal to 9.0% of the inner diameter D of the cylindrical basket-like washing tub. A pitch p of the wave form is set to more than or equal to 2.0% and less than or equal to 9.0% of a peripheral length L of an imaginary circle having a diameter of the inner diameter D.

The outer casing is filled with a cleaning liquid containing a surfactant and tightly sealed. Disposed in the outer casing, the cylindrical basket-like washing tub is submerged in and filled with the cleaning liquid. A laundry article is placed in the cylindrical basket-like washing tub filled with the cleaning liquid. Then, the laundry article is in a near-zero gravity state inside the cylindrical basket-like washing tub. The "near-zero gravity state" herein does not mean a zero-gravity state but means a state in which the laundry article floats in the cleaning liquid. More specifically, certain gravity is exerted on the laundry article disposed in the cylindrical basket-like washing tub. At the same time, since the cylindrical basket-like washing tub is filled with the cleaning liquid, buoyancy corresponding to a volume of the laundry article and to a density of the cleaning liquid is exerted on the laundry article. Under influence of the buoyancy and the gravity at the same time, the laundry article floats inside the cylindrical basket-like washing tub.

Generally, when a cylindrical basket-like washing tub has a very small inner diameter, the washing apparatus can wash only very small laundry articles. Therefore, such a washing apparatus cannot be used in commercial laundry. On the other hand, when a cylindrical basket-like washing tub has a very large inner diameter, the washing apparatus can wash larger laundry articles but needs a much increased amount of cleaning liquid, thus causing energy conservation problems such as washing efficiency and other environmental problems. Unless such problems are solved, such a washing apparatus cannot be used in the commercial laundry. Since the inner diameter D of the cylindrical basket-like washing tub is set to more than or equal to 300 mm and less than or equal to 500 mm, the present invention needs only a small quantity of the cleaning liquid to be used and enables sufficient cleaning of smaller-sized laundry articles such as ties and gloves and medium-sized laundry articles.

Moreover, since the cylindrical basket-like washing tub is rotated at the above-mentioned speed by the rotating mechanism and the height h and the pitch p of the wave form formed by the inner periphery of the cylindrical basket-like washing tub are set to the above mentioned values, the laundry article can be maintained in a near-zero gravity state in the cylindrical basket-like washing tub when the cylindrical basket-like washing tub is in rotation. The present inventor considers the reasons for it as follows.

Firstly, since the inner periphery of the cylindrical basket-like washing tub has a shape of a wavy patterned surface in a form of a sine curve with protrusions protruding in radial directions of the cylindrical basket-like washing tub, when the cylindrical basket-like washing tub rotates, the cleaning liquid moves toward the periphery of the cylindrical basket-like washing tub as if it were dragged by the inner periphery thereof. And at the same time, mild currents in the form of swirls are generated in the vicinity of an inner periphery of the cylindrical basket-like washing tub. The mild currents in the form of swirls expand three-dimensionally in radial and circumferential directions in the vicinity of the inner periphery of the cylindrical basket-like washing tub. Meanwhile, the cleaning liquid in the cylindrical basket-like washing tub is given centrifugal force by rotation of the cylindrical basket-like washing tub and moves outwardly in the radial directions. And the outward current in radial directions generated by the centrifugal force collides with the mild currents in the form of swirls coming in opposing directions, to form a "wall of currents". This "wall of currents" is formed in a circular shape extending along a circumferential direction of the cylindrical basket-like washing tub.

Due to formation of the "wall of currents", a moving speed of the cleaning liquid toward the periphery of the cylindrical basket-like washing tub ununiformly varies in radial directions. That is, the moving speed of the cleaning liquid toward the periphery does not vary in proportion to a distance from the center of the cylindrical basket-like washing tub. More specifically, in an outside area of the "wall of currents" (outward in radial directions), the cleaning liquid moves along the inner periphery of the cylindrical basket-like washing tub, whereas in an inside area of the "wall of currents" (in the central portion of the cylindrical basket-like washing tub), the cleaning liquid very mildly moves in a rotating direction of the cylindrical basket-like washing tub. In the vicinity of a front end and a rear end of the cylindrical basket-like washing tub, however, neither the currents in the form of swirls nor the currents along the circumferential direction are generated. Therefore, a pressure fluctuation is generated in the cleaning liquid in the cylindrical basket-like washing tub, and then the cleaning liquid mildly moves in an axial direction thereof, causing convection.

When the "wall of currents" is well formed, a laundry article is maintained in a near-zero gravity state in an inside area of the "wall of currents". It is because even when a laundry article floating in a near-zero gravity state in the cylindrical basket-like washing tub moves in an outward direction from an inner area toward an outer area within the cylindrical basket-like washing tub, the laundry article will bounce back at the well-formed "wall of currents" to the inside area of the cylindrical basket-like washing tub. On the other hand, when the laundry article move, due to some factors, from the inside area of, through, and to the outside area of the "wall of currents" in the cylindrical basket-like washing tub, the laundry article will be dragged by the cleaning liquid moving in the circumferential direction in the outside area of the "wall of currents", and then will circulate along the inner periphery of the cylindrical basket-like washing tub. Thus, the no near-zero gravity state will not be maintained.

Centrifugal force acting on a cleaning liquid and the mild currents in the form of swirls have a great influence on formation of the "wall of currents". In other words, a rotation speed of the cylindrical basket-like washing tub and a height h and a pitch p of the wavy patterned surface have a great influence on formation of the "wall of currents". Generally, a higher rotation speed of a cylindrical basket-like washing tub would cause too great centrifugal force, and a slower rotation speed of a cylindrical basket-like-washing tub would probably fail to generate opposing currents of the cleaning liquid strong enough to form the "wall of currents". That is, in order to form the "wall of currents", it is important to have a balanced formation of the current moving outward in radial directions generated by the centrifugal force and the mild currents in the form of swirls. Therefore, a condition necessary for a good formation of the "wall of currents" and for maintaining a laundry article in a near-zero gravity state in the cylindrical basket-like washing tub is as follows: an inner diameter D of the cylindrical basket-like washing tub is set to more than or equal to 300 mm and less than or equal to 500 mm; a height h of a wavy patterned surface of the inner periphery is set to more than or equal to 2.0% and less than or equal to 9.0% of the inner diameter D; a pitch p of the wavy patterned surface form is set to more than or equal to 2.0% and less than or equal to 9.0% of a peripheral length L of an imaginary circle having a diameter of the inner diameter D; and the cylindrical basket-like washing tub is rotated so that a peripheral speed of the inner periphery thereof is more than or equal to 28 m/min and less than or equal to 57 m/min.

When a laundry article is maintained in a near-zero gravity state in a cylindrical basket-like washing tub, the laundry article is prevented from contacting the inner periphery of the cylindrical basket-like washing tub, and damages on the laundry article are reliably prevented. Further, the cleaning liquid moving outward in radial directions from the center of the cylindrical basket-like washing tub and the cleaning liquid moving in axial directions spread out the laundry article in the cylindrical basket-like washing tub (unfold). Thus, the contact area of the laundry article with the cleaning liquid is increased, thereby enabling the surfactant contained in the cleaning liquid to permeate deep into fibers of the fabrics forming the laundry article. Since the surfactant permeates deep into the fibers of the fabrics constituting the laundry article, the contaminations adhering to fibers are easily removed without application of physical external forces to the laundry article, that is, without application of mechanical external force to the laundry article or pounding or twisting of the laundry article by water-current jet.

(2) In order to attain the object, a washing machine according to a second aspect of the present invention comprises: an outer casing filled with a cleaning liquid containing a surfactant and tightly sealed; a cylindrical basket-like washing tub being disposed in the outer casing, an inner periphery of the cylindrical basket-like washing tub having a shape of a wavy patterned surface in a form of a sine curve with protrusions protruding in radial directions of the cylindrical basket-like washing tub; and a rotating mechanism for rotating the cylindrical basket-like washing tub about a central shaft in the outer casing while supporting the cylindrical basket-like washing tub in such a manner that the central shaft thereof is held horizontally. Specifically, an inner diameter D of the cylindrical basket-like washing tub is set to more than or equal to 600 mm and less than or equal to 850 mm. The rotating mechanism rotates the cylindrical basket-like washing tub so that a peripheral speed of the inner periphery thereof is more than or equal to 27 m/min and less than or equal to 57 m/min. A height h of a wave form formed by the inner periphery of the cylindrical basket-like washing tub is set to more than or equal to 2.0% and less than or equal to 9.0% of the inner diameter D of the cylindrical basket-like washing tub. A pitch p of the wave form is set to more than or equal to 2.0% and less than or equal to 9.0% of a peripheral length L of an imaginary circle having a diameter of the inner diameter D.

In this invention, too, the outer casing is filled with a cleaning liquid containing a surfactant and tightly sealed. Disposed in the outer casing, the cylindrical basket-like washing tub is submerged in and filled with the cleaning liquid. A laundry article is placed in the cylindrical basket-like washing tub filled with the cleaning liquid. Thus, the laundry article is in a near-zero gravity state inside the cylindrical basket-like washing tub. The "near-zero gravity state" herein does not mean a zero-gravity state but means a state in which the laundry article floats in the cleaning liquid. More specifically, certain gravity is exerted on the laundry article disposed in the cylindrical basket-like washing tub. At the same time, since the cylindrical basket-like washing tub is filled with the cleaning liquid, buoyancy corresponding to a volume of the laundry article and to a density of the cleaning liquid is exerted on the laundry article. Under influence of the buoyancy and the gravity at the same time, the laundry article floats inside the cylindrical basket-like washing tub.

Generally, when a cylindrical basket-like washing tub has a very small inner diameter, the washing apparatus can wash only very small laundry articles. Therefore, such a washing apparatus cannot be used in commercial laundry. On the other hand, when a cylindrical basket-like washing tub has a very large inner diameter, the washing apparatus can wash larger laundry articles but needs a much increased amount of cleaning liquid, thus causing energy conservation problems such as washing efficiency and other environmental problems. Unless such problems are solved, such a washing apparatus cannot be used in commercial laundry. Since an inner diameter D of the cylindrical basket-like washing tub is set to more than or equal to 600 mm and less than or equal to 850 mm, this invention enables cleaning of larger-sized laundry articles such as lounge suits, overcoats, and kimonos, while keeping the amount of the cleaning liquid to use to a relatively low level. Therefore, the washing apparatus according to this invention is especially suitable for an efficient commercial laundry.

Moreover, the cylindrical basket-like washing tub is rotated so that the peripheral speed of the inner periphery thereof is more than or equal to 27 m/min and less than or equal to 57 m/min, the height h of the wave form formed by the inner periphery of the cylindrical basket-like washing tub is set to more than or equal to 2.0% and less than or equal to 9.0% of the inner diameter D of the cylindrical basket-like washing tub, and the pitch p of the wave form is set to more than or equal to 2.0% and less than or equal to 9.0% of the peripheral length L of the imaginary circle having a diameter of the inner diameter D. Therefore, the laundry article can be maintained in a near-zero gravity state in the cylindrical basket-like washing tub when the cylindrical basket-like washing tub is in rotation. Reasons thereof are considered as follows.

Firstly, since the inner periphery of the cylindrical basket-like washing tub has a shape of a wavy patterned surface in a form of a sine curve with protrusions protruding in radial directions of the cylindrical basket-like washing tub, when the cylindrical basket-like washing tub rotates, the cleaning liquid moves toward the periphery of the cylindrical basket-like washing tub as if it were dragged by the inner periphery thereof. And at the same time, mild currents in the form of swirls are generated in the vicinity of the inner periphery of the cylindrical basket-like washing tub. The mild currents in the form of swirls expand three-dimensionally in radial and circumferential directions in the vicinity of the inner periphery of the cylindrical basket-like washing tub. Meanwhile, the cleaning liquid in the cylindrical basket-like washing tub is given centrifugal force by the rotation of the cylindrical basket-like washing tub and moves outwardly in the radial directions. And the outward current in radial directions generated by the centrifugal force collides with the mild currents in the form of swirls coming in opposing directions, to form a "wall of currents". This "wall of currents" is formed in a circular shape extending along a circumferential direction of the cylindrical basket-like washing tub.

Due to formation of the "wall of currents", a moving speed of the cleaning liquid toward the periphery of the cylindrical basket-like washing tub ununiformly varies in radial directions. That is, the moving speed of the cleaning liquid toward the periphery does not vary in proportion to a distance from the center of the cylindrical basket-like washing tub. More specifically, in an outside area of the "wall of currents" (outward in radial directions), the cleaning liquid moves along the inner periphery of the cylindrical basket-like washing tub, whereas in an inside area of the "wall of currents" (in the central portion of the cylindrical basket-like washing tub), the cleaning liquid very mildly moves in a rotating direction of the cylindrical basket-like washing tub. In the vicinity of a front end and a rear end of the cylindrical basket-like washing tub, however, neither the currents in the form of swirls nor the currents along the circumferential direction are generated. Therefore, a pressure fluctuation is generated in the cleaning liquid in the cylindrical basket-like washing tub, and then the cleaning liquid mildly moves in an axial direction thereof, causing convection.

When the "wall of currents" is well formed, a laundry article is maintained in a near-zero gravity state in an inside area of the "wall of currents". It is because even when a laundry article floating in a near-zero gravity state in the cylindrical basket-like washing tub moves in an outward direction from an inner area toward an outer area within the cylindrical basket-like washing tub, the laundry article will bounce back at the well-formed "wall of currents" to the inside area of the cylindrical basket-like washing tub. On the other hand, when the laundry article move, due to some factors, from the inside area of, through, and to the outside area of the "wall of currents" in the cylindrical basket-like washing tub, the laundry article will be dragged by the cleaning liquid moving in the circumferential direction in the outside area of the "wall of currents" and then will circulate along the inner periphery of the cylindrical basket-like washing tub. Thus, the no near-zero gravity state will not be maintained.

Centrifugal force acting on a cleaning liquid and the mild currents in the form of swirls have a great influence on formation of the "wall of currents". In other words, a rotation speed of the cylindrical basket-like washing tub and a height h and a pitch p of the wavy patterned surface have a great influence on formation of the "wall of currents". Generally, a higher rotation speed of a cylindrical basket-like washing tub would cause too great centrifugal force, and a slower rotation speed of a cylindrical basket-like washing tub would probably fail to generate opposing currents of the cleaning liquid strong enough to form the "wall of currents". That is, in order to form the "wall of currents", it is important to have a balanced formation of the current moving outward in radial directions generated by the centrifugal force and the mild currents in the form of swirls. Therefore, a condition necessary for a good formation of the "wall of currents" and for maintaining a laundry article in a near-zero gravity state in the cylindrical basket-like washing tub is as follows: an inner diameter D of the cylindrical basket-like washing tub is set to more than or equal to 600 mm and less than or equal to 850 mm; a height h of a wave form of a wavy patterned surface of the inner periphery is set to more than or equal to 2.0% and less than or equal to 9.0% of the inner diameter D; and a pitch p of the wave form is set to more than or equal to 2.0% and less than or equal to 9.0% of a peripheral length L of an imaginary circle having a diameter of the diameter D, and the cylindrical basket-like washing tub is rotated so that a peripheral speed of the inner periphery thereof is more than or equal to 27 m/min and less than or equal to 57 m/min.

When a laundry article is maintained in a near-zero gravity state in a cylindrical basket-like washing tub, the laundry article is prevented from contacting the inner periphery of the cylindrical basket-like washing tub, and damages on the laundry article are reliably prevented. Further, the cleaning liquid moving outward in radial directions from the center of the cylindrical basket-like washing tub and the cleaning liquid moving in axial directions spread out the laundry article in the cylindrical basket-like washing tub (unfold). Thus, the contact area of the laundry article with the cleaning liquid is increased, thereby enabling the surfactant contained in the cleaning liquid to permeate deep into fibers of the fabrics forming the laundry article. Since the surfactant permeates deep into the fibers of the fabrics constituting the laundry article, the contaminations adhering to fibers are easily removed without application of physical external forces to the laundry article, that is, without application of mechanical external force to the laundry article or pounding or twisting of the laundry article by water-current jet.

(3) In order to attain the object, a washing machine according to a third aspect of the present invention comprises: an outer casing filled with a cleaning liquid containing a surfactant and tightly sealed; a cylindrical basket-like washing tub being disposed in the outer casing, an inner periphery of the cylindrical basket-like washing tub having a shape of a wavy patterned surface in a form of a sine curve with protrusions protruding in radial directions of the cylindrical basket-like washing tub; and a rotating mechanism for rotating the cylindrical basket-like washing tub about a central shaft in the outer casing while supporting the cylindrical basket-like washing tub in such a manner that the central shaft thereof is held horizontally. Specifically, an inner diameter D of the cylindrical basket-like washing tub is set to more than or equal to 300 mm and less than or equal to 850 mm. The rotating mechanism rotates the cylindrical basket-like washing tub so that a peripheral speed of the inner periphery thereof is more than or equal to 27 m/min and less than or equal to 57 m/min. A height h of a wave form formed by the inner periphery of the cylindrical basket-like washing tub is set to more than or equal to 2.0% and less than or equal to 9.0% of the inner diameter D of the cylindrical basket-like washing tub. A pitch p of the wave form is set to more than or equal to 2.0% and less than or equal to 9.0% of a peripheral length L of an imaginary circle having a diameter of the inner diameter D.

In this invention, too, the outer casing is filled with the cleaning liquid containing a surfactant and tightly sealed. Disposed in the outer casing, the cylindrical basket-like washing tub is submerged in and filled with the cleaning liquid. A laundry article is placed in the cylindrical basket-like washing tub filled with the cleaning liquid. Thus, the laundry article is in a near-zero gravity state inside the cylindrical basket-like washing tub. The "near-zero gravity state" herein does not mean a zero-gravity state but means a state in which the laundry article floats in the cleaning liquid. More specifically, certain gravity is exerted on the laundry article disposed in the cylindrical basket-like washing tub. At the same time, since the cylindrical basket-like washing tub is filled with the cleaning liquid, buoyancy corresponding to a volume of the laundry article and to a density of the cleaning liquid is exerted on the laundry article. Under influence of the buoyancy and the gravity at the same time, the laundry article floats inside the cylindrical basket-like washing tub.

Generally, when a cylindrical basket-like washing tub has a very small inner diameter, the washing apparatus can wash only very small laundry articles. Therefore, such a washing apparatus cannot be used in commercial laundry. On the other hand, when a cylindrical basket-like washing tub has a very large inner diameter, the washing apparatus can wash larger laundry articles but needs a much increased amount of the cleaning liquid, thus causing energy conservation problems such as washing efficiency and other environmental problems. Unless such problems are solved, such a washing apparatus cannot be used in the commercial laundry. In the present invention, since the inner diameter D of the cylindrical basket-like washing tub is set to more than or equal to 300 mm and less than or equal to 850 mm, the amount of the cleaning liquid to use is kept to a relatively low level. Moreover, the washing apparatus can wash larger-sized laundry articles such as lounge suits, overcoats, and kimonos, as well as small-sized laundry articles such as ties and gloves and medium-sized laundry articles. Therefore, the washing apparatus according to this invention is especially suitable for commercial laundry.

Moreover, the cylindrical basket-like washing tub is rotated so that a peripheral speed of the inner periphery thereof is more than or equal to 27 m/min and less than or equal to 57 m/min, the height h of a wave form formed by the inner periphery of the cylindrical basket-like washing tub is set to more than or equal to 2.0% and less than or equal to 9.0% of the inner diameter D of the cylindrical basket-like washing tub, and the pitch p of the wave form is set to more than or equal to 2.0% and less than or equal to 9.0% of a peripheral length L of an imaginary circle having a diameter of the inner diameter D. Therefore, the laundry article can be maintained in a near-zero gravity state in the cylindrical basket-like washing tub when the cylindrical basket-like washing tub is in rotation. Reasons thereof are considered as follows.

Firstly, since the inner periphery of the cylindrical basket-like washing tub has a shape of wavy patterned surface in a form of a sine curve with protrusions protruding in radial directions of the cylindrical basket-like washing tub, when the cylindrical basket-like washing tub rotates, the cleaning liquid moves toward the periphery of the cylindrical basket-like washing tub as if it were dragged by the inner periphery thereof. And at the same time, mild currents in the form of swirls are generated in the vicinity of an inner periphery of the cylindrical basket-like washing tub. The mild currents in the form of swirls expand three-dimensionally in radial and circumferential directions in the vicinity of the inner periphery of the cylindrical basket-like washing tub. Meanwhile, the cleaning liquid in the cylindrical basket-like washing tub is given centrifugal force by the rotation of the cylindrical basket-like washing tub and moves outwardly in the radial directions. And the outward current in radial directions generated by the centrifugal force collides with the mild currents in the form of swirls coming in opposing directions, to form a "wall of currents". This "wall of currents" is formed in a circular shape extending along a circumferential direction of the cylindrical basket-like washing tub.

Due to formation of the "wall of currents", a moving speed of the cleaning liquid toward the periphery of the cylindrical basket-like washing tub ununiformly varies in radial directions. That is, the moving speed of the cleaning liquid toward the periphery does not vary in proportion to a distance from the center of the cylindrical basket-like washing tub. More specifically, in an outside area of the "wall of currents" (outward in radial directions), the cleaning liquid moves along the inner periphery of the cylindrical basket-like washing tub, whereas in an inside area of the "wall of currents" (in the central portion of the cylindrical basket-like washing tub), the cleaning liquid very mildly moves in a rotating direction of the cylindrical basket-like washing tub. In the vicinity of a front end and a rear end of the cylindrical basket-like washing tub, however, neither the currents in the form of swirls nor the currents along the circumferential direction are generated. Therefore, a pressure fluctuation is generated in the cleaning liquid in the cylindrical basket-like washing tub, and then the cleaning liquid mildly moves in an axial direction thereof, causing convection.

When the "wall of currents" is well formed, a laundry article is maintained in a near-zero gravity state in an inside area of the "wall of currents". It is because even when a laundry article floating in a near-zero gravity state in the cylindrical basket-like washing tub moves in an outward direction from an inner area toward an outer area within the cylindrical basket-like washing tub, the laundry article will bounce back at the well-formed "wall of currents" to the inside area of the cylindrical basket-like washing tub. On the other hand, when the laundry article move, due to some factors, from the inside area of, through, and to the outside area of the "wall of currents" in the cylindrical basket-like washing tub, the laundry article will be dragged by the cleaning liquid moving in the circumferential direction in the outside area of the "wall of currents" and then will circulate along the inner periphery of the cylindrical basket-like washing tub. Thus, the no near-zero gravity state will not be maintained.

Centrifugal force acting on a cleaning liquid and the mild currents in the form of swirls have a great influence on formation of the "wall of currents". In other words, a rotation speed of the cylindrical basket-like washing tub and a height h and a pitch p of the wavy patterned surface have a great influence on formation of the "wall of currents". Generally, a higher rotation speed of a cylindrical basket-like washing tub would cause too great centrifugal force, and a slower rotation speed of a cylindrical basket-like washing tub would probably fail to generate opposing currents of the cleaning liquid strong enough to form the "wall of currents". That is, in order to form the "wall of currents", it is important to have a balanced formation of the current moving outward in radial directions generated by the centrifugal force and the mild currents in the form of swirls. Therefore, a condition necessary for a good formation of the "wall of currents" and for maintaining a laundry article in a near-zero gravity state in the cylindrical basket-like washing tub is as follows: an inner diameter D of the cylindrical basket-like washing tub is set to more than or equal to 300 mm and less than or equal to 850 mm; a height h of a wave form of a wavy patterned surface of the inner periphery is set to more than or equal to 2.0% and less than or equal to 9.0% of the inner diameter D; a pitch p of the wave form is set to more than or equal to 2.0% and less than or equal to 9.0% of a peripheral length L of an imaginary circle having a diameter of the diameter D; and the cylindrical basket-like washing tub is rotated so that a peripheral speed of the inner periphery thereof is more than or equal to 27 m/min and less than or equal to 57 m/min.

When a laundry article is maintained in a near-zero gravity state in a cylindrical basket-like washing tub, the laundry article is prevented from contacting the inner periphery of the cylindrical basket-like washing tub, and damages on the laundry article are reliably prevented. Further, the cleaning liquid moving outward in radial directions from the center of the cylindrical basket-like washing tub and the cleaning liquid moving in axial directions spread out the laundry article in the cylindrical basket-like washing tub (unfold). Thus, the contact area of the laundry article with the cleaning liquid is increased, thereby enabling the surfactant contained in the cleaning liquid to permeate deep into fibers of the fabrics forming the laundry article. Since the surfactant permeates deep into the fibers of the fabrics constituting the laundry article, the contaminations adhering to fibers are easily removed without application of physical external forces to the laundry article, that is, without application of mechanical external force to the laundry article or pounding or twisting of the laundry article by water-current jet.

(4) Preferably, the above-described height his set to more than or equal to 3.0% and less than or equal to 6.0% of the inner diameter D of the cylindrical basket-like washing tub and the above-mentioned pitch p is set to more than or equal to 3.0% and less than or equal to 6.0% of a peripheral length L of an imaginary circle having a diameter of the inner diameter D.

In such a case, an excellent "wall of currents" is formed. Thus, a near-zero gravity state of the laundry article is reliably maintained in the cylindrical basket-like washing tub.

(5) The above-described rotating mechanism may rotate the cylindrical basket-like washing tub intermittently.

With the intermittent rotation of the cylindrical basket-like washing tub, the cleaning liquid current becomes irregular. Therefore, though the cleaning liquid current is mild, the cleaning liquid flows between fibers of the laundry article without fail. Accordingly, the surfactant acts more effectively to reliably separate the contaminations adhering to the laundry article from the laundry article.

(6) The rotating mechanism may rotate the cylindrical basket-like washing tub normally and reversely.

The normal and reverse rotations of the cylindrical basket-like washing tub prevent the cleaning liquid from constantly flowing in a predetermined direction. Thus, a near-zero gravity state of the laundry article is more reliably maintained in the cylindrical basket-like washing tub. By appropriately setting a cycle of the normal and reverse rotations, the cylindrical basket-like washing tub rotates in a swinging manner like a cradle. Such a rotation manner has the advantage that the laundry article is cleaned still more softly.

(7) The cleaning liquid in the cylindrical basket-like washing tub may preferably be pressurized or depressurized by a pressure change device.

By the change in pressure of the cleaning liquid, the cleaning liquid permeates deep into the fibers constituting the laundry article. Also, since the air contained in the fibers of the laundry article is removed by the change in pressure of the cleaning liquid, the cleaning liquid reliably permeates deep into the fibers. Further, since the cylindrical basket-like washing tub is filled with the cleaning liquid, a strong swirl or the like does not occur by the change in pressure of the cleaning liquid. Therefore, the laundry article is not damaged by the pressure change of the cleaning liquid. That is, contaminations adhering to surfaces of the fibers as well as contaminations that have permeated deep into the fibers (deposited contaminations) are removed without fail without damaging the laundry article. Particularly, though the contaminations permeated deep into the fibers become the cause of yellowing of the fabric when they are oxidized, the yellowing of fabrics is prevented without fail since such contaminations are removed without fail.

EFFECT OF THE INVENTION

According to this invention, since the surfactant permeates deep into fibers of a fabric constituting a laundry article, contaminations adhering to the laundry article is easily removed without applying physical external force to the laundry article. Therefore, water-soluble contaminations adhering to the fabric, such as sweat and mud, are reliably removed without loosing original texture of the fabric even when the laundry article is made from wool, for example, which is easily damaged.

As a result, the following effects are achieved. (1) It is possible to use water in stead of an organic solvent and a petroleum solvent as a cleaning liquid. The use of the organic solvent is of course possible in this invention; however, it is possible to realize a remarkably environment-friendly commercial laundry by refraining from using the organic and petroleum solvents. (2) Since shrinkage and original texture loss of fabric are prevented, even in a case of washing a clothing item constituted of a plurality of types of fabrics (typically a lounge suit formed of an outer material made of wool and a lining cloth made from rayon), creases due to differences in shrinkage factor of the fabrics do not occur in the clothing item. Therefore, it is possible to realize an easier press finishing in commercial laundry, leading to reduction of costs of cleaning service.

BEST MODE FOR CARRYING OUT THE INVENTION

Hereinafter, this invention will be described in detail with reference to the drawings and based on preferred embodiments.

FIG. 1 is a schematic diagram showing a washing apparatus according to one embodiment of this invention.

A washing apparatus 10 is provided with a washing tub unit 11, a support device 12 for supporting the washing tub unit 11, a rotation drive device 13 (rotating mechanism) for rotating the washing tub unit 11 in a manner described later in this specification, a cleaning liquid supply device 14 for supplying a cleaning liquid to the washing tub unit 11 and forcibly generating mild currents of the cleaning liquid in the washing tub unit 11, and a pressure change device 16 for varying an inside pressure of the washing tub unit 11. Though not shown in FIG. 1, the washing apparatus 10 is provided with a control device 50 (see FIG. 5). This control device 50 controls operations of the rotation drive device 13, the cleaning liquid supply device 14, and the pressure change device 16. Constitution of the control device 50 will be described later in this specification.

The washing tub unit 11 is provided with a casing (outer casing) 17 and a frame body 18 (cylindrical basket-like washing tub). The frame body 18 is disposed inside the casing 17 and enclosed by the casing 17. The casing 17 may be made from a metal such as a stainless steel and an aluminum alloy. The casing 17 is provided with a door 20 disposed at its front face as shown in FIG. 1. A right end portion of this door 20 is attached to the casing 17 via a hinge 45. Accordingly, the door 20 opens/closes the casing 17 by swinging horizontally about the hinge 45. The door 20 is also provided with a handle 15. A user of the washing apparatus 10 operates the handle 15 to open/close the door 20. The front face of the casing 17 is opened/closed in a liquid tight fashion by the door 20. After the door 20 is closed, a cleaning liquid is supplied to the casing 17 as described later in this specification. Thus, the casing 17 is filled with the cleaning liquid and tightly sealed.

The casing 17 has a shape of a cylindrical container as shown in FIG. 1. Of course, the casing 17 may have a different shape. In short, it is sufficient that the casing 17 has a shape capable of being filled with the cleaning liquid, tightly closed, and housing the frame body 18. The door 20 of the casing 17 may be provided with a window for watching the inside of the casing 17. A transparent acryl plate or the like may preferably be fitted to the window. The provision of such a window makes it possible to watch a washing state from the outside.

The support device 12 is attached to the casing 17. The support device 12 stably supports the casing 17. The support device 12 is made from a metal such as a stainless steel and aluminum, too. The support device 12 is a supporting frame having a rigid frame structure with a plurality of pillars and beams combined therein. The support device 12, however, may be provided with a coil spring and a damper in addition to the supporting frame. In such a case, the casing 17 is supported by the supporting frame via the coil spring and the damper, thereby enabling a stable support of the casing 17 even when periodic external force is applied to the casing 17. Moreover, the casing 17 is supported by the support device 12 in such a manner that a central axis N thereof is horizontal. The central axis N of the casing 17 coincides with a central axis of the washing tub unit 11 and a central shaft 19 (see FIG. 2) of the frame body 18.

FIG. 2 is a perspective view showing the frame body 18. FIG. 3 is a sectional view showing the frame body 18. FIG. 4 is an enlarged view showing a major part of FIG. 3.

The frame body 18 has a cylindrical shape. The frame body 18 is disposed inside the casing 17 (see FIG. 1). That is, the frame body 18 is fitted into the casing 17 in a nested fashion. An interior part of the frame body 18 is used as a laundry article housing chamber for housing laundry articles. The frame body 18 has a basketlike shape. More specifically, a plurality of slits 37 (37*a* to 37*f*) are provided on a periphery 36 of the frame body 18. Each of the slits 37 penetrates through the periphery 36 of the frame body 18 in radial directions. Therefore, the cleaning liquid supplied to the casing 17 is allowed to freely move through the slits 37 into and out of the frame body 18. The slits 37 extend in axial directions of the frame body 18 as shown in FIG. 2. The number of the slits 37, a width, and a length of the slits 37 are set appropriately.

Multiple punching holes may be provided on the frame body 18 in place of the slits 37. The frame body 18 may have a skeleton structure. In short, it is sufficient that the frame body 18 has a basket-like shape which allows the cleaning liquid to freely move into and out of the frame body 18.

The frame body 18 is provided with a central shaft 19. The central shaft 19 is projected from a rear end face 38 (see FIG. 2) of the frame body 18. As described in the foregoing, the center of the central shaft 19 coincides with the central axis N (see FIG. 1). That is, the frame body 18 is disposed in the casing 17 coaxially with the casing 17. As shown in FIG. 1, the central shaft 19 of the frame body 18 is supported by a bearing (not shown). Thus, the frame body 18 freely rotates about the central axis N inside the casing 17. The central shaft 19 is connected to a drive motor 23 described later in this specification. In this embodiment, the central shaft 19 is so supported by the bearing as to support the frame body 18 in a cantilever fashion. Note that the central shaft 19 may be provided on a door 15 of the casing 17 so that the frame body 18 is supported at opposite ends thereof.

As shown in FIGS. 2 to 4, an inner periphery 39 (wavy patterned surface) of the frame body 18 has a shape of a wavy patterned surface. The wavy shape is formed by forming a plurality of protruding parts 40 on the inner periphery 39 of the frame body 18. The protruding parts 40 extend along axial directions of the frame body 18. In this embodiment, the multiple protruding parts 40 are provided on the inner periphery 39, along a circumferential direction of the inner periphery 39 and at a constant interval. The protruding parts 40 may be formed integrally with the inner periphery of the frame body 18. However, the protruding parts 40 may be prepared as other members than the frame body 18 and then attached to the frame body 18. For example, a curved thin plate having a sine curve shape may be fixed to the inner periphery 39 of the frame body 18 so as to form the protruding parts 40. Using such a thin plate will lead to reduction of production costs of the frame body 18.

In this embodiment, thin plates 55 to 60, each having a sine curve shape, are attached to the inner periphery 39 of the frame body 18. Each of the thin plates 55 to 60 is made of resins or metals. Each of the thin plates 55 to 60 is rectangular in outline. Each of the thin plates 55 to 60 is flexible. Therefore, each of the thin plates 55 to 60 can easily be deformed to be fitted to the inner periphery 39 of the frame body 18.

Positions of the slits 37*a* to 37*f* provided in the frame body 18 and the shape of the inner periphery 39 of the frame body 18 are as shown in FIG. 3. More specifically, in this embodiment, frame body 18 is provided with six slits, 37*a* to 37*f*, and a width (a length in a circumferential direction of the frame body 18) of each of the slits 37*a* to 37*f* is decided by an angle $\alpha$ from the center of the frame body 18. In this embodiment, the angle $\alpha$ is set to 8.80 degrees. A distance (a length in a circumferential direction of the frame body 18) between adjacent slits 37 is decided by angles $\beta$ and $\gamma$ from the center of the frame body 18.

In this embodiment, a distance between the slit 37*a* and the slit 37*b*, a distance between the slit 37*b* and the slit 37*c*, a distance between the slit 37*c* and the slit 37*d*, a distance between the slit 37*e* and the slit 37*f*, and a distance between the slit 37*f* and the slit 37*a*, are decided by the angle $\beta$, and the angle $\beta$ is set to 55.16 degrees. A distance between the slit 37*d* and the slit 37*e* is decided by the angle $\gamma$, and the angle $\gamma$ is set to 31.29 degrees.

The thin plate 55 is disposed in such a manner as to cover an area between the slit 37*a* and the slit 37*b* of the inner periphery 39 of the frame body 18. The thin plate 56 is disposed in such a manner as to cover an area between the slit 37*b* and the slit 37*c* of the inner periphery 39 of the frame body 18. The thin plate 57 is disposed in such a manner as to cover an area between the slit 37*c* and the slit 37*d* of the inner periphery 39 of the frame body 18. The thin plate 58 is disposed in such a manner as to cover an area between the slit 37*d* and the slit 37*e* of the inner periphery 39 of the frame body 18. The thin plate 59 is disposed in such a manner as to cover an area between the slit 37*e* and the slit 37*f* of the inner periphery 39 of the frame body 18. The thin plate 60 is disposed in such a manner as to cover an area between the slit 37*f* and the slit 37*a* of the inner periphery 39 of the frame body 18.

The number of the slits 37 (37*a* to 37*f*) and values of the angles α, β, and γ may be modified. For example, the slits 37 may be disposed on the inner periphery 39 of the frame body 18 at a constant interval along the circumferential direction. The number of the slits 37 is not particularly limited but may be set to approximately four to ten. In such a case, the angles α, β, and γ are decided in accordance with the number of the slits 37. When the slits 37 are disposed at a constant interval, the angle β and the angle γ are set to satisfy β=γ.

As described in the foregoing, instead of the slits 37, a plurality of punching holes may be provided on a side of the frame body 18. In such a case, a single thin plate may be disposed on the inner periphery 39 of the frame body 18. The thin plate is also made of resins or metals, and is attached in such a manner as to cover the inner periphery 39 of the frame body 18. The punching holes are provided in such a manner as to penetrate both the thin plate and the frame body 18. Of course, the inner periphery 39 of the frame body 18 itself may be in a form of the wavy patterned surface, without the thin plate provided.

The shape of the inner periphery 39 of the frame body 18, that is, the wavy shape formed by surfaces of the protruding parts 40, forms a sine curve as shown in FIG. 4. However, the wavy shape of the inner periphery 39 may not necessarily form an exact sine curve. For example, successive half-round surfaces may be disposed in a circumferential direction to form a smooth wavy shape of the inner periphery 39 having a form of a sine curve. In this embodiment, an inner diameter D of the frame body 18 is set to 650 mm. Preferably, the inner diameter D may be set to more than or equal to 250 mm and less than or equal to 1000 mm. More preferably, the inner diameter D may be set to more than or equal to 300 mm and less than or equal to 850 mm. Still more preferably, the inner diameter D may be set to more than or equal to 600 mm and less than or equal to 850 mm and/or more than or equal to 300 mm and less than or equal to 500 mm. Operation and effect of setting the inner diameter D of the frame body 18 to the above-mentioned range will be described later in this specification.

A height h and a pitch p of a wave form formed by the inner periphery 39 is set to have a predetermined proportion with respect to an inner diameter D of the frame body 18. More specifically, the height h is set to 19.5 mm and the pitch p is set to 62.4 mm. That is, the height h is set to 3% of the inner diameter D, and the pitch p is set to 3% of a peripheral length L (πD) of an imaginary circle having a diameter of the inner diameter D. Of course, the height h and the pitch p are not limited to the above-mentioned values. The height h is set to more than or equal to 2.0% and less than or equal to 9.0% of the inner diameter D. The pitch p is set to more than or equal to 2.0% and less than or equal to 9.0% of the peripheral length L (πD). More preferably, the height h is set to more than or equal to 3.0% and less than or equal to 6.0% of the inner diameter D. More preferably, the pitch p is set to more than or equal to 3.0% and less than or equal to 6.0% of a peripheral length L (πD) of an imaginary circle having a diameter of the inner diameter D.

As shown in FIGS. 1 and 2, the rotation drive device 13 has the drive motor 23. The drive motor 23 is mounted on an end face 21 of the casing 17. A driving shaft 24 of the drive motor 23 is coupled to the central shaft 19 of the frame body 18. Therefore, the frame body 18 is rotated about the central axis N in the casing 17 when the drive motor 23 is activated. The frame body 18 rotates normally (in one direction) inside the casing 17 when the drive motor 23 rotates normally, and the frame body 18 rotates reversely (in the other direction) inside the casing 17 when the drive motor 23 rotates reversely.

In this embodiment, the frame body 18 is rotated approximately 15 rotations per minute. However, the rotation speed of the frame body 18 may be set to approximately from 5 to 45 rotations per minute. Specifically, the rotation speed of the frame body 18 may preferably be set to approximately from 13 to 30 rotations per minute. In other words, the frame body 18 is preferably rotated so that a peripheral speed of the inner periphery 39 is more than or equal to 10 m/min and less than or equal to 90 m/min, and more preferably, more than or equal to 28 m/min and less than or equal to 57 m/min.

Operation and effect of setting the rotation speed of the frame body 18 and the height h and the pitch p to the above-mentioned values will be described later in this specification.

As shown in FIG. 1, the cleaning liquid supply device 14 is provided with a tank 25 for storing a cleaning liquid, an induction pipe 26 connected to the tank 25, a pump 27 to which the induction pipe 26 is connected, a supply pipe 28 connected to the pump 27, a drain pipe 29 connected to the casing 17, and a bypass pipe 30 providing connection between the drain pipe 29 and the induction pipe 26. A pipe made of stainless steels that is generally used is used as each of the pipes 26, 28, 29, and 30. The induction pipe 26, the drain pipe 29, and the bypass pipe 30 are provided with valves 31 to 33 for opening/closing the pipes, respectively. The pump 27 pumps the cleaning liquid in the tank 25 to supply the cleaning liquid to the casing 17 and circulates the cleaning liquid as described later in this specification. As the cleaning liquid, water may typically be used. The cleaning liquid may generally contain a surfactant. In addition, a petroleum solvent and an organic solvent may be used.

The cleaning liquid is temporarily withdrawn from the casing 17 when the cleaning liquid supply device 14 circulates the cleaning liquid in the casing 17 as described later in this specification. The withdrawn cleaning liquid is directly returned to the casing 17. At this time, the cleaning liquid is returned to the casing 17 with a predetermined pressure. Therefore, a current of the cleaning liquid is generated in the casing 17. In a case where the current is strong, a strong swirl of the cleaning liquid in the casing 17 can be generated and may affect the fabrics of the clothes. However, the current of the cleaning liquid in this embodiment is so mild as to prevent the fabrics of clothes from being damaged. Further, as described later in this specification, the current of the cleaning liquid may forcibly position the laundry articles at a central part of the casing 17. The cleaning liquid, in addition to the circulation in the casing 17 as described above, may be discharged from the casing 17 during its supply to the casing 17.

The pressure change device 16 is a cylinder piston device in this embodiment. The cylinder piston device is connected to the casing 17. Therefore, the inside pressure of the washing tub unit 11, i.e. the inside pressure of the casing 17, is changed when the piston is activated. The pressure change device 16 is not limited to the cylinder piston device, and any device may be used insofar as the device can vary the pressure inside the casing 17 (pressure of the cleaning liquid).

FIG. 5 is a schematic diagram showing a constitution of the control device 50.

The control device 50 comprehensively controls operations and the like of the drive motor 23 of the rotation drive device 13, the pump 27 and the valves 31 to 33 of the cleaning liquid supply device 14, and the pressure change device 16. Therefore, a liquid level sensor 75 is provided in the casing 17, and a rotary encoder 76, a rotation speed sensor 77, and the like are provided in the frame body 18. The liquid level sensor 75 detects an amount of the cleaning liquid in the casing 17. The rotary encoder 76 detects a rotation angle of the frame body 18, and the rotation speed sensor 77 detects a rotation speed of the frame body 18.

The control device 50 is a microcomputer constituted mainly of a CPU (Central Processing Unit) 51, a ROM (ReaD Only Memory) 52, a RAM (RanDom Access Memory) 53, and an EEPROM (Electrically Erasable anD Programmable ROM) 54. The control device 50 is connected to an ASIC (Application Specific Integrated Circuit) 70 via a bus 69.

The ROM 52 stores a computer program and the like for controlling various operations of the washing apparatus 10. The RAM 53 is used as a storage region or a work region for temporarily storing various data to be used for execution of the program by the CPU 51. The EEPROM 54 stores settings and flags to be retained after the power is turned off.

The ASIC 70 generates signals and the like to be communicated to the drive motor 23 in accordance with instructions from the CPU 51. The signals are sent to a drive circuit 78 of the drive motor 23, and drive signals are communicated to the drive motor 23 via the drive circuit 78. Rotation of the drive motor 23 is controlled as described above, and, as a result, the rotation of the frame body 18 is controlled. The drive circuit 78 is used for driving the drive motor 23 and generates electric signals for rotating the drive motor 23 upon reception of output signals from the ASIC 70. The drive motor 23 rotates upon reception of the electric signals.

The ASIC 70 generates signals and the like to be communicated to the pump 27 in accordance with instructions from the CPU 51. The signals are applied to a drive circuit 79 of the pump 27, and drive signals are communicated to the pump 27 via the drive circuit 79. Rotation of the pump 27 is controlled as described above, and, as a result, supply of the cleaning liquid to the casing 17 is controlled. The drive circuit 79 is used for driving the pump 27 and generates electric signals for rotating the pump 27 upon reception of output signals from the ASIC 70. The pump 27 rotates upon reception of the electric signals.

The ASIC 70 generates signals and the like for driving the pressure change device 16 in accordance with instructions from the CPU 51. The signals are sent to a drive circuit 80 of the pressure change device 16, and drive signals are sent to the pressure change device 16 via the drive circuit 80. The pressure change device 16 is controlled as described above, and, as a result, the pressure of the cleaning liquid in the casing 17 is controlled. The drive circuit 80 is used for driving the pressure change device 16 and generates electric signals for activating pressure change device 16 upon reception of output signals from the ASIC 70. The pressure change device 16 is activated upon reception of the electric signals.

The ASIC 70 generates signals and the like to be communicated to the valves 31 to 33 in accordance with instructions from the CPU 51. The signals are applied to drive circuits 81 to 83 of the valves 31 to 33, respectively, and drive signals are communicated to the valves 31 to 33 via the drive circuits 81 to 83, respectively. Opening/closure of the valves 31 to 33 are controlled as described above, and, as a result, supply/discharge of the cleaning liquid to/from the casing 17 are controlled. The drive circuits 81 to 83 are used for driving the valves 31 to 33, respectively, and generate electric signals for opening/closing the valves 31 to 33 upon reception of output signals from the ASIC 70, respectively. The valves 31 to 33 open/close upon reception of the electric signals, respectively.

FIG. 6 is a diagram schematically showing a procedure of washing by the washing apparatus 10. The washing apparatus 10 performs washing of clothes in the following procedure.

As shown in FIG. 6(*a*), clothes 35 (laundry articles) are placed in the washing tub unit 11. More specifically, the door 2*o* (see FIG. 1) provided on the casing 17 is opened so that the clothes 35 are thrown into the inside of the frame body 18. The work of placing the clothes 35 in the washing tub unit 11 may be performed automatically by a laundry article conveying device (not shown) or the like. In such a case, the control device 50 controls operation of the laundry article conveying device. The valves 31 to 33 are all closed when the clothes 35 are placed in the washing tub unit 11. A preparation of a cleaning liquid may be performed in the tank 25 simultaneously with the work of placing the clothes 35. As described in the foregoing, water is used as the cleaning liquid and water and a detergent (surfactant) are mixed together in this embodiment. Of course, water may be used as the cleaning liquid as it is.

As shown in FIG. 6(*b*), the washing tub unit 11 is filled with the cleaning liquid. The cleaning liquid supply device 14 is activated to supply the cleaning liquid to the washing tub unit 11. More specifically, the valve 31 is opened simultaneously with closure of the valves 32 and 33, and then the pump 27 is activated. With such operations, the cleaning liquid is pumped up from the tank 25 to be supplied to the casing 17 via the induction pipe 26 and the supply pipe 28. The pump 27 supplies the cleaning liquid until the casing 17 is filled with the cleaning liquid. That is, the cleaning liquid is supplied until the casing 17 is filled with the cleaning liquid. In this embodiment, the casing 17 is provided with a liquid level sensor 75 (not shown) (see FIG. 5). The liquid level sensor 75 is used for sensing a level of the cleaning liquid supplied to the casing 17. Examples of the liquid level sensor 75 include a sensor that directly detects the level of the cleaning liquid and a pressure sensor that detects a pressure of the cleaning liquid. Since the cleaning liquid is supplied until the casing 17 is filled with the cleaning liquid, it is preferable to use the pressure sensor as the liquid level sensor 75.

The cleaning liquid filled in the casing 17 is tightly sealed. The clothes 35 are disposed in the cleaning liquid tightly sealed in the casing 17. Therefore, the clothes 35 are in a state of near-zero gravity inside the frame body 18. More specifically, though certain gravity is exerted on the clothes 35 in the frame body 18, buoyancy corresponding to a volume of the clothes 35 and a density of the cleaning liquid are exerted on the clothes 35. Moreover, since the casing 17 is filled with the cleaning liquid, the cleaning liquid fills up the frame body 18. Accordingly, the clothes 35 float inside the frame body 18. That is, the above-described "near-zero gravity state" does not mean a zero-gravity state but means a state in which the clothes 35 float in the cleaning liquid. Thus, the clothes 35 are cleaned softly in the near-zero gravity state.

Then, as shown in FIG. 6(*c*), the valves 31 to 33 are closed, followed by start of rotation of the washing tub unit 11. The rotation drive device 13 (see FIG. 1) is activated to rotate the washing tub unit 11 about the central axis N. More specifically, the drive motor 23 of the rotation drive device 13 is activated so that the frame body 18 rotates about the central axis N inside the casing 17. When the frame body 18 is rotated, the cleaning liquid is rotated inside the frame body 18 in a direction of the rotation of the frame body.

Since the central shaft 19 of the frame body 18 is disposed in the horizontal direction as described in the foregoing, the frame body 18 functions as a so-called front-loading design tub. As shown in FIGS. 2 to 4, since the inner periphery 39 of the frame body 18 has the wavy patterned surface and the inner diameter D of the frame body 18, the height h and the pitch p of a wave form formed by the inner periphery 39 of the frame body 18, and the rotation speed of the frame body 18 are set to the above-mentioned values, the following operation and effects are achieved.

When the frame body 18 has a very small inner diameter D, the washing apparatus 10 can only wash small-sized clothes 35. Accordingly, if the inner diameter D is less than 250 mm, for example, practical use of this washing apparatus 10 will be difficult. If the inner diameter D exceeds 1000 mm, the washing apparatus 10 can wash larger-sized clothes 35, but needs an extremely increased amount of cleaning liquid. In commercial laundry, it is necessary to solve energy conservation problems such as washing efficiency and other environmental problems. Therefore, if the inner diameter D exceeds 1000 mm, solution of such energy conservation problems and the like will be difficult, and use of such a washing apparatus in commercial laundry will also be difficult.

A washing apparatus 10 according to this embodiment, having an inner diameter D of a frame body 18 set to more than or equal to 250 mm and less than or equal to 1000 mm, can clean from smaller-sized laundry articles, such as ties and gloves, to larger-sized laundry articles, such as lounge suits, overcoats, and kimonos, while limiting the amount of leaning liquid to be used to a certain level or less. However, when the inner diameter D of the frame body 18 is set to more than or equal to 300 mm and less than or equal to 850 mm, the washing apparatus 10 is especially suitable for commercial laundry. It is because the amount of the cleaning liquid to be used is kept to a relatively low level, and it is possible to clean larger-sized laundry articles, such as lounge suits, overcoats, and kimonos as well as smaller-sized laundry articles such as ties and gloves and medium-sized laundry articles. When the inner diameter D of the frame body 18 is set to approximately from 250 mm to 500 mm, and especially set to more than or equal to 300 mm and less than or equal to 500 mm, the amount of cleaning liquid to be used is kept to a low level, and smaller-sized laundry articles, such as ties and gloves, and medium-sized laundry articles are sufficiently cleaned.

Moreover, when the inner diameter D of the frame body 18 is set to more than or equal to 500 mm and less than or equal to 1000 mm, larger-sized laundry articles, such as lounge suits, overcoats, and kimonos, are sufficiently cleaned. Specifically in this embodiment, the inner diameter D of the frame body 18 is set to 650 mm. More preferably, the inner diameter D may be set to more than or equal to 600 mm and less than or equal to 850 mm. When the inner diameter D of the frame body 18 is set to such values, larger-sized articles, such as lounge suits, overcoats, and kimonos, are sufficiently cleaned, with the amount of cleaning liquid kept to a relatively low level. Therefore, the washing apparatus 10 is especially suitable for an efficient commercial laundry.

In this embodiment, the frame body 18 is rotated 15 rotations per minute. Accordingly, a peripheral speed of the inner periphery 39 of the frame body 18 is 30.6 m/min. Moreover, a height h of a wave form formed by the inner periphery 39 of the frame body 18 is set to 3% of the inner diameter D of the frame body 18, and a pitch p of the wave form is set to 3.0% of a peripheral length L ($\pi D$) of an imaginary circle having a diameter of the inner diameter D. When the values D, h, and pare set to the above-mentioned values, respectively, a phenomenon happens that clothes 35 are maintained in a near-zero gravity state within the frame body 18 as the frame body 18 rotates. Probable reasons thereof are considered as follows.

FIG. 7 is a diagram showing currents of a cleaning liquid in a rotating frame body 18.

Since the inner periphery 39 of the frame body 18 has a shape of a wavy patterned surface in a form of a sine curve with protrusions protruding in radial directions, when the frame body 18 rotates in a direction of arrows, the cleaning liquid 48 moves toward the periphery of the frame body 18 as if it were dragged by the inner periphery 39. Moreover, when the frame body 18 rotates, due to a smooth curved surface of the inner periphery 39, mild currents in the form of swirls are generated in the vicinity of the inner periphery 39. The mild currents 46 in the form of swirls expand three-dimensionally in radial and circumferential directions in the vicinity of the inner periphery 39 of the frame body 18. Being a diagram, the FIG. 7 shows only four of the mild currents 46; however, the mild currents are generated actually in all parts of the inner periphery 39 of the frame body 18.

Meanwhile, when the frame body 18 rotates, the cleaning liquid 47 inside the frame body 18 moves outward in radial directions to the periphery under influence of centrifugal force. And the outward current in radial directions generated by the centrifugal force collides with the mild currents 46 in the form of swirls coming in opposing directions, to form a "wall of currents". Thus, the collision of the currents coming in opposite radial directions forms what is called a "wall of currents". This "wall of currents" 49 is formed in a circular shape extending along a circumferential direction of the frame body 18.

Due to the formation of the "wall of currents", a moving speed of the cleaning liquid toward the periphery of the frame body 18 ununiformly varies in radial directions. That is, the moving speed of the cleaning liquid toward the periphery does not vary in proportion to a distance from the center of the frame body 18. More specifically, the cleaning liquid 48 in an outside area of the "wall of currents" rapidly moves along the inner periphery 39 of the frame body 18, whereas the cleaning liquid 47 in an inside area of the "wall of currents" very mildly moves in a rotating direction of the frame body 18. In the vicinity of a front end and a rear end of the frame body 18 (see FIG. 2), however, neither the currents 46 in the form of swirls nor the currents along the circumferential direction are generated. Therefore, a pressure fluctuation is generated in the cleaning liquid in the frame body 18, and then the cleaning liquid mildly moves in an axial direction of the frame body 18, causing convection.

When the "wall of currents" 49 is well formed, the clothes 35 are maintained in a near-zero gravity state in an inside area of the "wall of currents" 49. It is because even when the clothes 35 floating in a near-zero gravity state in the frame body 18 moves in an outward direction from an inner area toward an outer area within the frame body 18, the clothes 35 will bounce back at the well-formed "wall of currents" 49 to the inside area of the frame body 18. However, when the clothes 35 move, due to some factors, from the inside area of, through, and to the outside area of the "wall of currents" 49 in the frame body 18, the clothes 35 will be strongly dragged in the circumferential direction by the cleaning liquid 48 in the outside area of the "wall of currents" 49. As a result, the clothes 35 will circulate along the inner periphery of the frame body 18, and the no near-zero gravity state will not be maintained.

Centrifugal force acting on a cleaning liquid and the mild currents 46 in the form of swirls have a great influence on formation of the "wall of currents" 49. In other words, a rotation speed of the frame body 18 (that is, a peripheral speed of the inner periphery 39 of the frame body 18) and the height h and the pitch p have a great influence on formation of the "wall of currents" 49. Generally, a higher rotation speed of a frame body 18 causes a greater centrifugal force, and a slower rotation speed of a frame body 18 would probably fail to generate opposing currents of the cleaning liquid strong enough to form the "wall of currents" 49. That is, it is considered that in order to form the "wall of current" 49, it is important to have a balanced formation of the outward current in radial directions generated by the centrifugal force and the mild currents 46 in the form of swirls. In this embodiment, the inner diameter D of the frame body 18 is set to 650 mm, the frame body 18 is rotated 15 rotations per minute, the height h is set to 3.0% of the inner diameter D, and the pitch p is set to 3.0% of a peripheral length L of an imaginary circle having a diameter of the inner diameter D. This satisfies conditions for formation of a good "wall of currents" 49.

In this embodiment, when the peripheral speed of the inner periphery 39 of the frame body 18 is set to 30.6 m/min (15 rotations per minute), the height h is set to 3.0% of the inner diameter D, and the pitch p is set to 3.0% of the peripheral length L, a good "wall of currents" 49 is formed. However, even when the frame body 18 is rotated so that the peripheral speed of the inner periphery 39 is more than or equal to 10 m/min and less than or equal to 90 m/min, the height h is set to more than or equal to 2.0% and less than or equal to 9.0% of the inner diameter D, and the pitch p is set to more than or equal to 2.0% and less than or equal to 9.0% of the peripheral length L, the good "wall of currents" 49 may be formed. Specifically, as described later in embodiments, when the peripheral speed of the inner periphery 39 of the frame body 18 is set to more than or equal to 28 m/min and less than or equal to 57 m/min, the height h is set to more than or equal to 3.0% and less than or equal to 6.0% of the inner diameter D, and the pitch p is set to more than or equal to 3.0% and less than or equal to 6.0% of the peripheral length L, a good "wall of currents" 49 is formed. The height h and the pitch p may be varied within the range mentioned above. When a proportion of the height h to the pitch p is relatively high, protrusions are formed in higher density on the inner periphery 39; and when a proportion of the height h to the pitch p is relatively low, protrusions are formed in lower density on the inner periphery 39.

In a case of the peripheral speed of the inner periphery 39 of the frame body 18 at 10 m/min, a frame body 18 having an inner diameter of 300 mm is rotated 10.6 rotations per minute, a frame body 18 having an inner diameter of 650 mm is rotated 4.9 rotations per minute, and a frame body 18 having an inner diameter of 850 mm is rotated 3.7 rotations per minute. Moreover, in a case of the peripheral speed of the inner periphery 39 of the frame body 18 at 28 m/min, a frame body 18 having an inner diameter of 300 mm is rotated 29.7 rotations per minute, a frame body 18 having an inner diameter of 650 mm is rotated 13.7 rotations per minute, and a frame body 18 having an inner diameter of 850 mm is rotated 10.5 rotations per minute. Moreover, in a case of the peripheral speed of the inner periphery 39 of the frame body 18 at 57 m/min, a frame body 18 having an inner diameter of 300 mm is rotated 60.5 rotations per minute, a frame body 18 having an inner diameter of 650 mm is rotated 27.9 rotations per minute, and a frame body 18 having an inner diameter of 850 mm is rotated 21.4 rotations per minute. In addition, in a case of the peripheral speed of the inner periphery 39 of the frame body 18 at 90 m/min, a frame body 18 having an inner diameter of 300 mm is rotated 95.5 rotations per minute, a frame body 18 having an inner diameter of 650 mm is rotated 44.1 rotations per minute, and a frame body 18 having an inner diameter of 850 mm is rotated 33.7 rotations per minute.

When clothes 35 are maintained in a near-zero gravity state in the frame body 18, the clothes 35 are prevented from contacting the inner periphery 39 of the frame body 18, and damages on the clothes 35 are reliably prevented. Further, the cleaning liquid moving outward in radial directions from the center of the frame body 18 and the cleaning liquid moving in the axial direction spread out the clothes 35 widely in the frame body 18. Thus, the contact area of the clothes 35 with the cleaning liquid is increased, thereby enabling the surfactant contained in the cleaning liquid to permeate deep into fibers of the fabrics forming the clothes 35. Since the surfactant permeates deep into the fibers of the fabrics constituting the clothes 35, the contaminations adhering to fibers are easily removed without application of physical external forces to the clothes 35, that is, without application of mechanical external force to the clothes 35 or pounding or twisting of the clothes 35 by water-current jet.

When the cleaning of the clothes 35 is finished, the valve 32 is opened at the same time with closure of the valves 31 and 33 as shown in FIG. 6(*d*), and the cleaning liquid is discharged.

Since the washing apparatus 10 according to this embodiment removes contaminations adhering to the clothes 35 without application of mechanical external force to the clothes 35, even in a case where the clothes are made from delicate fabrics such as wool, the fabrics are not damaged. That is, the contaminations adhering to the fabrics are removed without deteriorating the shapes and the original textures of the clothes 35. Accordingly, this invention enables water washing of the clothes 35 made from delicate fabrics such as wool and reliable removal of water-soluble contaminations such as sweat and mud adhering to the clothes 35. In addition, this invention has advantages that a finishing work becomes easier and creases hardly occur since the clothes 35 are free from the deterioration in shape.

Particularly, in this embodiment, the frame body 18 rotates about the central shaft 19 disposed horizontally. That is, inside the frame body 18, the cleaning liquid rotates about the central axis N. Such constitution has an advantage that the cleaning liquid smoothly passes through the clothes 35. The reason for the advantage is still unclear, but it has been confirmed that more excellent washing is realized by the above-described constitution as compared with a constitution wherein the axial center of the frame body 18 is extended in the vertical direction.

The frame body 18 may be rotated intermittently. In order to rotate the frame body 18 intermittently, the rotation of the drive motor 23 is controlled. The rotation control of the drive motor 23 is easily performed by the control device 50. By rotating the frame body 18 intermittently, the current of cleaning liquid in the frame body 18 becomes irregular. Accordingly, the cleaning liquid flows between fibers of the clothes 35 without fail though the cleaning liquid current flows mildly.

For instance, a cycle consisting of a rotation of the frame body 18 for 1 to 240 seconds, a halt for 1 to 60 seconds, and a rotation of the frame body 18 for 1 to 240 seconds is repeated. The initial rotation period of the frame body 18 may preferably be from 5 to 200 seconds, more preferably from 10 to 120 seconds, yet more preferably from 20 to 80 seconds. The halt period of the frame body 18 may be set to less than or equal to a second, for example. The rotation period after the halt of the frame body 18 may preferably be from 5 to 200 seconds, more preferably from 10 to 120 seconds, yet more preferably from 20 to 80 seconds. With such a rotation cycle, the cleaning liquid more reliably flows between fibers of the clothes 35. Therefore, it is possible to more reliably separate the contaminations adhering to the clothes 35 from the clothes 35 without damaging the clothes 35 by the cleaning. Of course, the initial rotation period of the frame body 18 and the rotation period after the halt of the frame body 18 may be different from each other.

Also, the frame body 18 may be rotated normally and reversely with regularity. More specifically, the drive motor 23 is rotated normally and reversely with regularity. Such rotation control of the drive motor 23 is easily performed by the control device 50. With such rotation control, the cleansing liquid flows more reliably between fibers of the clothes 35.

For instance, the frame body 18 may be rotated clockwise (in one direction) for 1 to 540 seconds, followed by a halt for 1 to 60 seconds, and then rotated anticlockwise (in the other direction) for 1 to 540 seconds. The clockwise rotation period of the frame body 18 may preferably be from 5 to 440 seconds, more preferably from 10 to 280 seconds, yet more preferably from 20 to 180 seconds. The halt period of the frame body 18 after the clockwise rotation may be set to less than or equal to a second, for example. The anticlockwise rotation period of the frame body 18 after the halt may preferably be from 5 to 440 seconds, more preferably from 10 to 280 seconds, yet more preferably from 20 to 180 seconds. The normal rotation and the reverse rotation are set as one cycle, and this rotation cycle is repeated. Since the frame body 18 is rotated normally and reversely, the cleaning liquid more reliably flows between fibers of the clothes 35. Therefore, it is possible to more reliably separate the contaminations adhering to the clothes 35 from the clothes 35 without damaging the clothes 35 by the cleaning.

Though the normal rotation is set to the clockwise rotation and the reverse rotation is set to the anticlockwise rotation in the above description, the clockwise and anticlockwise rotations may of course be replaced with each other. Also, the normal rotation period and the reverse rotation period may of course be different from each other.

In this embodiment, the cleaning liquid in the casing 17, i.e. the cleaning liquid in the frame body 18, is pressurized or depressurized by the pressure change device 16. By the change in pressure of the cleaning liquid, the cleaning liquid permeates deep into the fibers constituting the clothes 35. Also, since the air contained in the fibers is removed by the change in pressure of the cleaning liquid, the cleaning liquid reliably permeates deep into the fibers. Also, since the cleaning liquid is tightly sealed in the frame body 18, a change in pressure of the cleaning liquid does not cause a strong swirl or the like in the frame body 18. Therefore, the clothes 35 are not damaged by the pressure change of the cleaning liquid.

Due to the increase in pressure of the cleaning liquid, contaminations adhering to surfaces of the fibers as well as contaminations that have permeated deep into the fibers (deposited contaminations) are removed without fail without damaging the clothes 35. Particularly, the contaminations that have permeated deep into the fibers can be the cause of yellowing of the fabrics when they are oxidized. However, since such contaminations are reliably removed, this invention has an advantage of reliable prevention of the yellowing of fabrics.

Further, a mild jet current of the cleaning liquid may be formed in the frame body 18 during the cleaning of the clothes 35.

More specifically, the cleaning liquid supply device 14 is activated during the cleaning of the clothes 35. As shown in FIG. 6(*c*), when the valves 31 and 32 are closed at the same time with opening of the valve 33, the pump 27 is activated. Thus, the cleaning liquid is withdrawn from the washing tub unit 11 to be returned to the washing tub unit 11 after passing through the bypass pipe 30 and the supply pipe 28. In this case, a mild current of the cleaning liquid is formed in the washing tub unit 11. Note that it is necessary that the current is considerably weak and does not cause strong twisting of the clothes 35. Such a mild current is readily formed by the control of the operation of the pump 27 by the control device 50. The cleaning liquid more smoothly flows between fibers of the clothes 35 due to the cleaning liquid current and the cleaning liquid circulation. As a result, a superior detergency is expected.

The above-described mild current may be formed in the reverse direction. That is, when the valves 31 and 32 are closed at the same time with opening of the valve 33, the pump 27 is activated in the reverse direction. Thus, the cleaning liquid is withdrawn from an upper part of the washing tub unit 11 to be returned to the washing tub unit 11 after passing through the supply pipe 28 and the bypass pipe 30. In this case, a cleaning liquid current oriented upward from the bottom is formed in the washing tub unit 11. Due to such a cleaning liquid current, the clothes 35 are forcibly positioned at the central part of the washing tub unit 11.

More specifically, the clothes 35 disposed in the washing tub unit 11 are in the above-described near-zero gravity state. This state is caused by the buoyancy exerted on the clothes 35. Since certain gravity is always exerted on the clothes 35, the clothes 35 tend to sink to the bottom (in a vertically downward direction) of the washing tub unit 11. Due to the cleaning liquid current oriented upward from the bottom in the washing tub unit 11, the clothes 35 are always pushed upward to be positioned at the central part of the washing tub unit 11. Thus, the clothes 35 are reliably prevented from contacting the inner wall surface of the washing tub unit 11, so that the clothes 35 are reliably prevented from being damaged.

In a case where the clothes 35 are moved to the upper part of the washing tub unit 11 due to the cleaning liquid current, the above-described cleaning liquid current oriented downward from the upper part of the washing tub unit 11 is formed to position the clothes 35 at the central part of the washing tub unit 11 again.

The washing apparatus 10 according to this embodiment may be provided with a temperature adjustment device for adjusting the temperature of cleaning liquid. The temperature adjustment device may be a heater or the like disposed inside the washing tub unit 11. Outputs from the heater may be controlled by the control device 50. The temperature of the cleaning liquid may be set to an optimum value for removing contaminations depending on the type and degree of contaminations adhering to the clothes 35. By adjusting the temperature of the cleaning liquid, the contaminations adhering to the clothes 35 are removed rapidly and reliably.

EXAMPLES

Effects of this invention will hereinafter be clarified in conjunction with examples; however, this invention should not be interpreted in a limited way based on descriptions of the examples.

In each Example and Comparative Example, a washing tub unit was filled with a cleaning liquid, and a plurality of small balls were housed in a frame body. The cleaning liquid was water (specific gravity 1.0). Each small ball was colored red, white, or brown, and five balls of each color were housed in the frame body, respectively. A red small ball had a specific gravity of 0.95, a white small ball had a specific gravity of 1.0, and a brown small ball had a specific gravity of 1.2. Therefore, red small balls move upwards within a stationary frame body, white small balls float within a stationary frame body, and brown small balls sink within a stationary frame body. Protruding parts were provided on an inner periphery of the frame body to form a wavy patterned surface of the inner periphery. In each Example and Comparative Example, behaviors of each small ball were observed when the frame body was rotated. Tables 1 to 50 show the results.

In each Example and Comparative Example (Tables 1 to 50), the proportion of the height of a protruding part to the inner diameter of the frame body (see FIG. 4) is given as "Height" (%) along with an actual size (mm) thereof. In each Example and Comparative Example (Tables 1 to 50), the proportion of the pitch between protruding parts to the peripheral length of an imaginary circle having a diameter of the inner diameter of the frame body (see FIG. 4) is given as "pitch" (%) along with an actual value (mm). Moreover, in each Example and Comparative Example (Tables 1 to 50), the rotation speed of the frame body was set as follows. The inner diameter of the frame body was set to 300 mm, and the rotation speed of the frame body was decided according to the number of rotations per minute.

Behaviors of the small balls of each color during the rotation of the frame body were described in corresponding columns of the Tables 1 to 50. The present inventor considered that, as described in the foregoing, when the frame body having an inner periphery with a wavy patterned surface rotated, the "wall of currents" 49 (see FIG. 7) was formed in the cleaning liquid in the frame body with an increase in the rotation speed. When the frame body rotates at a low speed, the red small balls (specific gravity 0.95) should move upwards in the cleaning liquid and then roll along the inner wall surface of the frame body. Then, if the "wall of currents" 49 is formed with an increase in the rotation speed of the frame body, the red small balls (specific gravity 0.95) should repeat moving up and down in the cleaning liquid. When the frame body rotates at a high speed, the "wall of currents" should approach the center of the frame body, thus causing the red small balls (specific gravity 0.95) to leave the inner wall surface and gather in the center of the frame body. When the frame body rotates at a low speed, the brown small balls (specific gravity 1.2) should sink in the cleaning liquid and roll along the inner wall surface of the frame body. And if the "wall of currents" 49 is formed with an increase in the rotation speed of the frame body, the brown small balls (specific gravity 1.2) should repeat moving away from and toward the inner wall surface of the frame body. When the frame body rotates at a high speed, the brown small balls (specific gravity 1.2) should pass through the "wall of currents" and stay on the inner wall surface of the frame body. Moreover, when the frame body rotates at a low speed, the white small balls (specific gravity 1.0) should float irregularly in the cleaning liquid. And when the "wall of currents" 49 is formed with an increase in the rotation speed of the frame body, the white small balls (specific gravity 1.0) should move in a circular motion along the vicinity of the inner wall surface of the frame body, that is, along the inner periphery of the "wall of currents". Moreover, when the frame body rotates at a high speed, the white small balls (specific gravity 1.0) should gather in the center of the frame body.

Comparative Example 1

The proportion of the height h of the protruding parts to the inner diameter D of the frame body is represented as a height ratio (hereinafter referred to as a height). In this comparative example a height was 2% (6 mm). The proportion of the pitch of the protruding parts to the peripheral length of the imaginary circle having the inner diameter of the cylindrical basket-like washing tub is represented as pitch ratio (hereinafter referred to as a pitch). In this comparative example a pitch was 2% (18.84 mm). A number of a rotation of the frame body was 6.

Comparative Example 2

A height was 2% (6 mm). A pitch was 2% (18.84 mm). A number of a rotation was 10.

Comparative Example 3

A height was 2% (6 mm). A pitch was 2% (18.84 mm). A number of a rotation was 20.

Example 1

A height was 2% (6 mm). A pitch was 2% (18.84 mm). A number of a rotation was 30.

Example 2

A height was 2% (6 mm). A pitch was 2% (18.84 mm). A number of a rotation was 45.

Example 3

A height was 2% (6 mm). A pitch was 2% (18.84 mm). A number of a rotation was 60.

Comparative Example 4

A height was 2% (6 mm). A pitch was 2% (18.84 mm). A number of a rotation was 90.

Comparative Example 5

A height was 2% (6 mm). A pitch was 2% (18.84 mm). A number of a rotation was 120.

Comparative Example 6

A height was 2% (6 mm). A pitch was 2% (18.84 mm). A number of a rotation was 140.

Comparative Example 7

A height was 2% (6 mm). A pitch was 3% (28.26 mm). A number of a rotation was 6.

Comparative Example 8

A height was 2% (6 mm). A pitch was 3% (28.26 mm). A number of a rotation was 10.

Comparative Example 9

A height was 2% (6 mm). A pitch was 3% (28.26 mm). A number of a rotation was 20.

Example 4

A height was 2% (6 mm). A pitch was 3% (28.26 mm). A number of a rotation was 30.

Example 5

A height was 2% (6 mm). A pitch was 3% (28.26 mm). A number of a rotation was 45.

Example 6

A height was 2% (6 mm). A pitch was 3% (28.26 mm). A number of a rotation was 60.

Comparative Example 10

A height was 2% (6 mm). A pitch was 3% (28.26 mm). A number of a rotation was 90.

Comparative Example 11

A height was 2% (6 mm). A pitch was 3% (28.26 mm). A number of a rotation was 120.

Comparative Example 12

A height was 2% (6 mm). A pitch was 3% (28.26 mm). A number of a rotation was 140.

Comparative Example 13

A height was 2% (6 mm). A pitch was 5% (47.1 mm). A number of a rotation was 6

Comparative Example 14

A height was 2% (6 mm). A pitch was 5% (47.1 mm). A number of a rotation was 10.

Comparative Example 15

A height was 2% (6 mm). A pitch was 5% (47.1 mm). A number of a rotation was 20.

Example 7

A height was 2% (6 mm). A pitch was 5% (47.1 mm). A number of a rotation was 30.

Example 8

A height was 2% (6 mm). A pitch was 5% (47.1 mm). A number of a rotation was 45.

Example 9

A height was 2% (6 mm). A pitch was 5% (47.1 mm). A number of a rotation was 60.

Example 10

A height was 2% (6 mm). A pitch was 5% (47.1 mm). A number of a rotation was 90.

Comparative Example 16

A height was 2% (6 mm). A pitch was 5% (47.1 mm). A number of a rotation was 120.

Comparative Example 17

A height was 2% (6 mm). A pitch was 5% (47.1 mm). A number of a rotation was 140.

Comparative Example 18

A height was 2% (6 mm). A pitch was 6% (56.52 mm). A number of a rotation was 6

Comparative Example 19

A height was 2% (6 mm). A pitch was 6% (56.52 mm). A number of a rotation was 10.

Comparative Example 20

A height was 2% (6 mm). A pitch was 6% (56.52 mm). A number of a rotation was 20.

Example 11

A height was 2% (6 mm). A pitch was 6% (56.52 mm). A number of a rotation was 30.

Example 12

A height was 2% (6 mm). A pitch was 6% (56.52 mm). A number of a rotation was 45.

Example 13

A height was 2% (6 mm). A pitch was 6% (56.52 mm). A number of a rotation was 60.

Example 14

A height was 2% (6 mm). A pitch was 6% (56.52 mm). A number of a rotation was 90.

Comparative Example 21

A height was 2% (6 mm). A pitch was 6% (56.52 mm). A number of a rotation was 120.

Comparative Example 22

A height was 2% (6 mm). A pitch was 6% (56.52 mm). A number of a rotation was 140.

Comparative Example 23

A height was 2% (6 mm). A pitch was 7% (65.94 mm). A number of a rotation was 6

Comparative Example 24

A height was 2% (6 mm). A pitch was 7% (65.94 mm). A number of a rotation was 10.

Comparative Example 25

A height was 2% (6 mm). A pitch was 7% (65.94 mm). A number of a rotation was 20.

Example 15

A height was 2% (6 mm). A pitch was 7% (65.94 mm). A number of a rotation was 30.

Example 16

A height was 2% (6 mm). A pitch was 7% (65.94 mm). A number of a rotation was 45.

Example 17

A height was 2% (6 mm). A pitch was 7% (65.94 mm). A number of a rotation was 60.

Example 18

A height was 2% (6 mm). A pitch was 7% (65.94 mm). A number of a rotation was 90.

Comparative Example 26

A height was 2% (6 mm). A pitch was 7% (65.94 mm). A number of a rotation was 120.

Comparative Example 27

A height was 2% (6 mm). A pitch was 7% (65.94 mm). A number of a rotation was 140.

Comparative Example 28

A height was 2% (6 mm). A pitch was 8% (75.36 mm). A number of a rotation was 6

Comparative Example 29

A height was 2% (6 mm). A pitch was 8% (75.36 mm). A number of a rotation was 10.

Comparative Example 30

A height was 2% (6 mm). A pitch was 8% (75.36 mm). A number of a rotation was 20.

Example 19

A height was 2% (6 mm). A pitch was 8% (75.36 mm). A number of a rotation was 30.

Example 20

A height was 2% (6 mm). A pitch was 8% (75.36 mm). A number of a rotation was 45.

Example 21

A height was 2% (6 mm). A pitch was 8% (75.36 mm). A number of a rotation was 60.

Example 22

A height was 2% (6 mm). A pitch was 8% (75.36 mm). A number of a rotation was 90.

Comparative Example 31

A height was 2% (6 mm). A pitch was 8% (75.36 mm). A number of a rotation was 120.

Comparative Example 32

A height was 2% (6 mm). A pitch was 8% (75.36 mm). A number of a rotation was 140.

Comparative Example 33

A height was 2% (6 mm). A pitch was 9% (84.78 mm). A number of a rotation was 6

Comparative Example 34

A height was 2% (6 mm). A pitch was 9% (84.78 mm). A number of a rotation was 10.

Comparative Example 35

A height was 2% (6 mm). A pitch was 9% (84.78 mm). A number of a rotation was 20.

Example 23

A height was 2% (6 mm). A pitch was 9% (84.78 mm). A number of a rotation was 30.

Example 24

A height was 2% (6 mm). A pitch was 9% (84.78 mm). A number of a rotation was 45.

Example 25

A height was 2% (6 mm). A pitch was 9% (84.78 mm). A number of a rotation was 60.

Comparative Example 36

A height was 2% (6 mm). A pitch was 9% (84.78 mm). A number of a rotation was 90.

Comparative Example 37

A height was 2% (6 mm). A pitch was 9% (84.78 mm). A number of a rotation was 120.

Comparative Example 38

A height was 2% (6 mm). A pitch was 9% (84.78 mm). A number of a rotation was 140.

Comparative Example 39

A height was 3% (9 mm). A pitch was 2% (18.84 mm). A number of a rotation was 6.

Comparative Example 40

A height was 3% (9 mm). A pitch was 2% (18.84 mm). A number of a rotation was 10.

Comparative Example 41

A height was 3% (9 mm). A pitch was 2% (18.84 mm). A number of a rotation was 20.

Example 26

A height was 3% (9 mm). A pitch was 2% (18.84 mm). A number of a rotation was 30.

Example 27

A height was 3% (9 mm). A pitch was 2% (18.84 mm). A number of a rotation was 45.

Example 28

A height was 3% (9 mm). A pitch was 2% (18.84 mm). A number of a rotation was 60.

Example 29

A height was 3% (9 mm). A pitch was 2% (18.84 mm). A number of a rotation was 90.

Comparative Example 42

A height was 3% (9 mm). A pitch was 2% (18.84 mm). A number of a rotation was 120.

Comparative Example 43

A height was 3% (9 mm). A pitch was 2% (18.84 mm). A number of a rotation was 140.

Comparative Example 44

A height was 3% (9 mm). A pitch was 3% (28.26 mm). A number of a rotation was 6.

Comparative Example 45

A height was 3% (9 mm). A pitch was 3% (2-8.26 mm). A number of a rotation was 10.

Comparative Example 46

A height was 3% (9 mm). A pitch was 3% (28.26 mm). A number of a rotation was 20.

Example 30

A height was 3% (9 mm). A pitch was 3% (28.26 mm). A number of a rotation was 30.

Example 31

A height was 3% (9 mm). A pitch was 3% (28.26 mm). A number of a rotation was 45.

Example 32

A height was 3% (9 mm). A pitch was 3% (28.26 mm). A number of a rotation was 60.

Comparative Example 47

A height was 3% (9 mm). A pitch was 3% (28.26 mm). A number of a rotation was 90.

Comparative Example 48

A height was 3% (9 mm). A pitch was 3% (28.26 mm). A number of a rotation was 120.

Comparative Example 49

A height was 3% (9 mm). A pitch was 3% (28.26 mm). A number of a rotation was 140.

Comparative Example 50

A height was 3% (9 mm). A pitch was 5% (47.1 mm). A number of a rotation was 6

Comparative Example 51

A height was 3% (9 mm). A pitch was 5% (47.1 mm). A number of a rotation was 10.

Comparative Example 52

A height was 3% (9 mm). A pitch was 5% (47.1 mm). A number of a rotation was 20.

Example 33

A height was 3% (9 mm). A pitch was 5% (47.1 mm). A number of a rotation was 30.

Example 34

A height was 3% (9 mm). A pitch was 5% (47.1 mm). A number of a rotation was 45.

Example 35

A height was 3% (9 mm). A pitch was 5% (47.1 mm). A number of a rotation was 60.

Example 36

A height was 3% (9 mm) A pitch was 5% (47.1 mm). A number of a rotation was 90.

Comparative Example 53

A height was 3% (9 mm). A pitch was 5% (47.1 mm). A number of a rotation was 120.

Comparative Example 54

A height was 3% (9 mm). A pitch was 5% (47.1 mm). A number of a rotation was 140.

Comparative Example 55

A height was 3% (9 mm). A pitch was 6% (56.52 mm). A number of a rotation was 6

Comparative Example 56

A height was 3% (9 mm). A pitch was 6% (56.52 mm). A number of a rotation was 10.

Comparative Example 57

A height was 3% (9 mm). A pitch was 6% (56.52 mm). A number of a rotation was 20.

Example 37

A height was 3% (9 mm). A pitch was 6% (56.52 mm). A number of a rotation was 30.

Example 38

A height was 3% (9 mm). A pitch was 6% (56.52 mm). A number of a rotation was 45.

Example 39

A height was 3% (9 mm). A pitch was 6% (56.52 mm). A number of a rotation was 60.

Example 40

A height was 3% (9 mm). A pitch was 6% (56.52 mm). A number of a rotation was 90.

Comparative Example 58

A height was 3% (9 mm). A pitch was 6% (56.52 mm). A number of a rotation was 120.

Comparative Example 59

A height was 3% (9 mm). A pitch was 6% (56.52 mm). A number of a rotation was 140.

Comparative Example 60

A height was 3% (9 mm) A pitch was 7% (65.94 mm). A number of a rotation was 6

Comparative Example 61

A height was 3% (9 mm). A pitch was 7% (65.94 mm). A number of a rotation was 10.

Comparative Example 62

A height was 3% (9 mm). A pitch was 7% (65.94 mm). A number of a rotation was 20.

Example 41

A height was 3% (9 mm). A pitch was 7% (65.94 mm). A number of a rotation was 30.

Example 42

A height was 3% (9 mm). A pitch was 7% (65.94 mm). A number of a rotation was 45.

Example 43

A height was 3% (9 mm). A pitch was 7% (65.94 mm). A number of a rotation was 60.

Example 44

A height was 3% (9 mm). A pitch was 7% (65.94 mm). A number of a rotation was 90.

Comparative Example 63

A height was 3% (9 mm). A pitch was 7% (65.94 mm). A number of a rotation was 120.

Comparative Example 64

A height was 3% (9 mm). A pitch was 7% (65.94 mm). A number of a rotation was 140.

Comparative Example 65

A height was 3% (9 mm). A pitch was 8% (75.36 mm). A number of a rotation was 6

Comparative Example 66

A height was 3% (9 mm). A pitch was 8% (75.36 mm). A number of a rotation was 10.

Comparative Example 67

A height was 3% (9 mm). A pitch was 8% (75.36 mm). A number of a rotation was 20.

Example 45

A height was 3% (9 mm). A pitch was 8% (75.36 mm). A number of a rotation was 30.

Example 46

A height was 3% (9 mm). A pitch was 8% (75.36 mm). A number of a rotation was 45.

Example 47

A height was 3% (9 mm). A pitch was 8% (75.36 mm). A number of a rotation was 60.

Example 48

A height was 3% (9 mm). A pitch was 8% (75.36 mm). A number of a rotation was 90.

Comparative Example 68

A height was 3% (9 mm). A pitch was 8% (75.36 mm). A number of a rotation was 120.

Comparative Example 69

A height was 3% (9 mm). A pitch was 8% (75.36 mm). A number of a rotation was 140.

Comparative Example 70

A height was 3% (9 mm). A pitch was 9% (84.78 mm). A number of a rotation was 6

Comparative Example 71

A height was 3% (9 mm). A pitch was 9% (84.78 mm). A number of a rotation was 10.

Comparative Example 72

A height was 3% (9 mm). A pitch was 9% (84.78 mm). A number of a rotation was 20.

Example 49

A height was 3% (9 mm). A pitch was 9% (84.78 mm). A number of a rotation was 30.

Example 50

A height was 3% (9 mm). A pitch was 9% (84.78 mm). A number of a rotation was 45.

Example 51

A height was 3% (9 mm). A pitch was 9% (84.78 mm). A number of a rotation was 60.

Comparative Example 73

A height was 3% (9 mm). A pitch was 9% (84.78 mm). A number of a rotation was 90.

Comparative Example 74

A height was 3% (9 mm). A pitch was 9% (84.78 mm). A number of a rotation was 120.

Comparative Example 75

A height was 3% (9 mm). A pitch was 9% (84.78 mm). A number of a rotation was 140.

Comparative Example 76

A height was 5% (15 mm). A pitch was 2% (18.84 mm). A number of a rotation was 6.

Comparative Example 77

A height was 5% (15 mm). A pitch was 2% (18.84 mm). A number of a rotation was 10.

Comparative Example 78

A height was 5% (15 mm). A pitch was 2% (18.84 mm). A number of a rotation was 20.

Example 52

A height was 5% (15 mm). A pitch was 2% (18.84 mm). A number of a rotation was 30.

Example 53

A height was 5% (15 mm). A pitch was 2% (18.84 mm). A number of a rotation was 45.

Example 54

A height was 5% (15 mm). A pitch was 2% (18.84 mm). A number of a rotation was 60.

Example 55

A height was 5% (15 mm). A pitch was 2% (18.84 mm). A number of a rotation was 90.

Comparative Example 79

A height was 5% (15 mm). A pitch was 2% (18.84 mm). A number of a rotation was 120.

Comparative Example 80

A height was 5% (15 mm). A pitch was 2% (18.84 mm). A number of a rotation was 140.

Comparative Example 81

A height was 5% (15 mm). A pitch was 3% (28.26 mm). A number of a rotation was 6.

Comparative Example 82

A height was 5% (15 mm). A pitch was 3% (28.26 mm). A number of a rotation was 10.

Comparative Example 83

A height was 5% (15 mm). A pitch was 3% (28.26 mm). A number of a rotation was 20.

Example 56

A height was 5% (15 mm). A pitch was 3% (28.26 mm). A number of a rotation was 30.

Example 57

A height was 5% (15 mm). A pitch was 3% (28.26 mm). A number of a rotation was 45.

Example 58

A height was 5% (15 mm). A pitch was 3% (28.26 mm). A number of a rotation was 60.

Example 59

A height was 5% (15 mm). A pitch was 3% (28.26 mm). A number of a rotation was 90.

Comparative Example 84

A height was 5% (15 mm). A pitch was 3% (28.26 mm). A number of a rotation was 120.

Comparative Example 85

A height was 5% (15 mm). A pitch was 3% (28.26 mm). A number of a rotation was 140.

Comparative Example 86

A height was 5% (15 mm). A pitch was 5% (47.1 mm). A number of a rotation was 6

Comparative Example 87

A height was 5% (15 mm). A pitch was 5% (47.1 mm). A number of a rotation was 10.

Comparative Example 88

A height was 5% (15 mm). A pitch was 5% (47.1 mm). A number of a rotation was 20.

Example 60

A height was 5% (15 mm). A pitch was 5% (47.1 mm). A number of a rotation was 30.

Example 61

A height was 5% (15 mm). A pitch was 5% (47.1 mm). A number of a rotation was 45.

Example 62

A height was 5% (15 mm). A pitch was 5% (47.1 mm). A number of a rotation was 60.

Comparative Example 89

A height was 5% (15 mm). A pitch was 5% (47.1 mm). A number of a rotation was 90.

Comparative Example 90

A height was 5% (15 mm). A pitch was 5% (47.1 mm). A number of a rotation was 120.

Comparative Example 91

A height was 5% (15 mm). A pitch was 5% (47.1 mm). A number of a rotation was 140.

Comparative Example 92

A height was 5% (15 mm). A pitch was 6% (56.52 mm). A number of a rotation was 6

Comparative Example 93

A height was 5% (15 mm). A pitch was 6% (56.52 mm). A number of a rotation was 10.

Comparative Example 94

A height was 5% (15 mm). A pitch was 6% (56.52 mm). A number of a rotation was 20.

Example 63

A height was 5% (15 mm). A pitch was 6% (56.52 mm). A number of a rotation was 30.

Example 64

A height was 5% (15 mm). A pitch was 6% (56.52 mm). A number of a rotation was 45.

Example 65

A height was 5% (15 mm). A pitch was 6% (56.52 mm). A number of a rotation was 60.

Example 66

A height was 5% (15 mm). A pitch was 6% (56.52 mm). A number of a rotation was 90.

Comparative Example 95

A height was 5% (15 mm). A pitch was 6% (56.52 mm). A number of a rotation was 120.

Comparative Example 96

A height was 5% (15 mm). A pitch was 6% (56.52 mm). A number of a rotation was 140.

Comparative Example 97

A height was 5% (15 mm). A pitch was 7% (65.94 mm). A number of a rotation was 6

Comparative Example 98

A height was 5% (15 mm). A pitch was 7% (65.94 mm). A number of a rotation was 10.

Comparative Example 99

A height was 5% (15 mm). A pitch was 7% (65.94 mm). A number of a rotation was 20.

Example 67

A height was 5% (15 mm). A pitch was 7% (65.94 mm). A number of a rotation was 30.

Example 68

A height was 5% (15 mm). A pitch was 7% (65.94 mm). A number of a rotation was 45.

Example 69

A height was 5% (15 mm). A pitch was 7% (65.94 mm). A number of a rotation was 60.

Example 70

A height was 5% (15 mm). A pitch was 7% (65.94 mm). A number of a rotation was 90.

Comparative Example 100

A height was 5% (15 mm). A pitch was 7% (65.94 mm). A number of a rotation was 120.

Comparative Example 101

A height was 5% (15 mm). A pitch was 7% (65.94 mm). A number of a rotation was 140.

Comparative Example 102

A height was 5% (15 mm). A pitch was 8% (75.36 mm). A number of a rotation was 6

Comparative Example 103

A height was 5% (15 mm). A pitch was 8% (75.36 mm). A number of a rotation was 10.

Comparative Example 104

A height was 5% (15 mm). A pitch was 8% (75.36 mm). A number of a rotation was 20.

Example 71

A height was 5% (15 mm). A pitch was 8% (75.36 mm). A number of a rotation was 30.

Example 72

A height was 5% (15 mm). A pitch was 8% (75.36 mm). A number of a rotation was 45.

Example 73

A height was 5% (15 mm). A pitch was 8% (75.36 mm). A number of a rotation was 60.

Example 74

A height was 5% (15 mm). A pitch was 8% (75.36 mm). A number of a rotation was 90.

Comparative Example 105

A height was 5% (15 mm). A pitch was 8% (75.36 mm). A number of a rotation was 120.

Comparative Example 106

A height was 5% (15 mm). A pitch was 8% (75.36 mm). A number of a rotation was 140.

Comparative Example 107

A height was 5% (15 mm). A pitch was 9% (84.78 mm). A number of a rotation was 6

Comparative Example 108

A height was 5% (15 mm). A pitch was 9% (84.78 mm). A number of a rotation was 10.

Comparative Example 109

A height was 5% (15 mm). A pitch was 9% (84.78 mm). A number of a rotation was 20.

Example 75

A height was 5% (15 mm). A pitch was 9% (84.78 mm). A number of a rotation was 30.

Example 76

A height was 5% (15 mm). A pitch was 9% (84.78 mm). A number of a rotation was 45.

Example 77

A height was 5% (15 mm). A pitch was 9% (84.78 mm). A number of a rotation was 60.

Example 78

A height was 5% (15 mm). A pitch was 9% (84.78 mm). A number of a rotation was 90.

Comparative Example 110

A height was 5% (15 mm). A pitch was 9% (84.78 mm). A number of a rotation was 120.

Comparative Example 111

A height was 5% (15 mm). A pitch was 9% (84.78 mm). A number of a rotation was 140.

Comparative Example 112

A height was 6% (18 mm). A pitch was 2% (18.84 mm). A number of a rotation was 6.

Comparative Example 113

A height was 6% (18 mm). A pitch was 2% (18.84 mm). A number of a rotation was 10.

Comparative Example 114

A height was 6% (18 mm). A pitch was 2% (18.84 mm). A number of a rotation was 20.

Example 79

A height was 6% (18 mm). A pitch was 2% (18.84 mm). A number of a rotation was 30.

Example 80

A height was 6% (18 mm). A pitch was 2% (18.84 mm). A number of a rotation was 45.

Example 81

A height was 6% (18 mm). A pitch was 2% (18.84 mm). A number of a rotation was 60.

Comparative Example 115

A height was 6% (18 mm). A pitch was 2% (18.84 mm). A number of a rotation was 90.

Comparative Example 116

A height was 6% (18 mm). A pitch was 2% (18.84 mm). A number of a rotation was 120.

Comparative Example 117

A height was 6% (18 mm). A pitch was 2% (18.84 mm). A number of a rotation was 140.

Comparative Example 118

A height was 6% (18 mm). A pitch was 3% (28.26 mm). A number of a rotation was 6.

Comparative Example 119

A height was 6% (18 mm). A pitch was 3% (28.26 mm). A number of a rotation was 10.

Comparative Example 120

A height was 6% (18 mm). A pitch was 3% (28.26 mm). A number of a rotation was 20.

Example 82

A height was 6% (18 mm). A pitch was 3% (28.26 mm). A number of a rotation was 30.

Example 83

A height was 6% (18 mm). A pitch was 3% (28.26 mm). A number of a rotation was 45.

Example 84

A height was 6% (18 mm). A pitch was 3% (28.26 mm). A number of a rotation was 60.

Comparative Example 121

A height was 6% (18 mm). A pitch was 3% (28.26 mm). A number of a rotation was 90.

Comparative Example 122

A height was 6% (18 mm). A pitch was 3% (28.26 mm). A number of a rotation was 120.

Comparative Example 123

A height was 6% (18 mm). A pitch was 3% (28.26 mm). A number of a rotation was 140.

Comparative Example 124

A height was 6% (18 mm). A pitch was 5% (47.1 mm). A number of a rotation was 6

Comparative Example 125

A height was 6% (18 mm). A pitch was 5% (47.1 mm). A number of a rotation was 10.

Comparative Example 126

A height was 6% (18 mm). A pitch was 5% (47.1 mm). A number of a rotation was 20.

Example 85

A height was 6% (18 mm). A pitch was 5% (47.1 mm). A number of a rotation was 30.

Example 86

A height was 6% (18 mm). A pitch was 5% (47.1 mm). A number of a rotation was 45.

Example 87

A height was 6% (18 mm). A pitch was 5% (47.1 mm). A number of a rotation was 60.

Comparative Example 127

A height was 6% (18 mm). A pitch was 5% (47.1 mm). A number of a rotation was 90.

Comparative Example 128

A height was 6% (18 mm). A pitch was 5% (47.1 mm). A number of a rotation was 120.

Comparative Example 129

A height was 6% (18 mm). A pitch was 5% (47.1 mm). A number of a rotation was 140.

Comparative Example 130

A height was 6% (18 mm). A pitch was 6% (56.52 mm). A number of a rotation was 6

Comparative Example 131

A height was 6% (18 mm). A pitch was 6% (56.52 mm). A number of a rotation was 10.

Comparative Example 132

A height was 6% (18 mm). A pitch was 6% (56.52 mm). A number of a rotation was 20.

Example 88

A height was 6% (18 mm). A pitch was 6% (56.52 mm). A number of a rotation was 30.

Example 89

A height was 6% (18 mm). A pitch was 6% (56.52 mm). A number of a rotation was 45.

Example 90

A height was 6% (18 mm). A pitch was 6% (56.52 mm). A number of a rotation was 60.

Comparative Example 133

A height was 6% (18 mm). A pitch was 6% (56.52 mm). A number of a rotation was 90.

Comparative Example 134

A height was 6% (18 mm). A pitch was 6% (56.52 mm). A number of a rotation was 120.

Comparative Example 135

A height was 6% (18 mm). A pitch was 6% (56.52 mm). A number of a rotation was 140.

Comparative Example 136

A height was 6% (18 mm). A pitch was 7% (65.94 mm). A number of a rotation was 6

Comparative Example 137

A height was 6% (18 mm). A pitch was 7% (65.94 mm). A number of a rotation was 10.

Comparative Example 138

A height was 6% (18 mm). A pitch was 7% (65.94 mm). A number of a rotation was 20.

Example 91

A height was 6% (18 mm). A pitch was 7% (65.94 mm). A number of a rotation was 30.

Example 92

A height was 6% (18 mm). A pitch was 7% (65.94 mm). A number of a rotation was 45.

Example 93

A height was 6% (18 mm). A pitch was 7% (65.94 mm). A number of a rotation was 60.

Comparative Example 139

A height was 6% (18 mm). A pitch was 7% (65.94 mm). A number of a rotation was 90.

Comparative Example 140

A height was 6% (18 mm). A pitch was 7% (65.94 mm). A number of a rotation was 120.

Comparative Example 141

A height was 6% (18 mm). A pitch was 7% (65.94 mm). A number of a rotation was 140.

Comparative Example 142

A height was 6% (18 mm). A pitch was 8% (75.36 mm). A number of a rotation was 6

Comparative Example 143

A height was 6% (18 mm). A pitch was 8% (75.36 mm). A number of a rotation was 10.

Comparative Example 144

A height was 6% (18 mm). A pitch was 8% (75.36 mm). A number of a rotation was 20.

Example 94

A height was 6% (18 mm). A pitch was 8% (75.36 mm). A number of a rotation was 30.

Example 95

A height was 6% (18 mm). A pitch was 8% (75.36 mm). A number of a rotation was 45.

Example 96

A height was 6% (18 mm). A pitch was 8% (75.36 mm). A number of a rotation was 60.

Comparative Example 145

A height was 6% (18 mm). A pitch was 8% (75.36 mm). A number of a rotation was 90.

Comparative Example 146

A height was 6% (18 mm). A pitch was 8% (75.36 mm). A number of a rotation was 120.

Comparative Example 147

A height was 6% (18 mm). A pitch was 8% (75.36 mm). A number of a rotation was 140.

Comparative Example 148

A height was 6% (18 mm). A pitch was 9% (84.78 mm). A number of a rotation was 6

Comparative Example 149

A height was 6% (18 mm). A pitch was 9% (84.78 mm). A number of a rotation was 10.

Comparative Example 150

A height was 6% (18 mm). A pitch was 9% (84.78 mm). A number of a rotation was 20.

Example 97

A height was 6% (18 mm). A pitch was 9% (84.78 mm). A number of a rotation was 30.

Example 98

A height was 6% (18 mm). A pitch was 9% (84.78 mm). A number of a rotation was 45.

Example 99

A height was 6% (18 mm). A pitch was 9% (84.78 mm). A number of a rotation was 60.

Comparative Example 151

A height was 6% (18 mm). A pitch was 9% (84.78 mm). A number of a rotation was 90.

Comparative Example 152

A height was 6% (18 mm). A pitch was 9% (84.78 mm). A number of a rotation was 120.

Comparative Example 153

A height was 6% (18 mm). A pitch was 9% (84.78 mm). A number of a rotation was 140.

Comparative Example 154

A height was 7% (21 mm). A pitch was 2% (18.84 mm). A number of a rotation was 6.

Comparative Example 155

A height was 7% (21 mm). A pitch was 2% (18.84 mm). A number of a rotation was 10.

Comparative Example 156

A height was 7% (21 mm). A pitch was 2% (18.84 mm). A number of a rotation was 20.

Example 100

A height was 7% (21 mm). A pitch was 2% (18.84 mm). A number of a rotation was 30.

Example 101

A height was 7% (21 mm). A pitch was 2% (18.84 mm). A number of a rotation was 45.

Example 102

A height was 7% (21 mm). A pitch was 2% (18.84 mm). A number of a rotation was 60.

Comparative Example 157

A height was 7% (21 mm). A pitch was 2% (18.84 mm). A number of a rotation was 90.

Comparative Example 158

A height was 7% (21 mm). A pitch was 2% (18.84 mm). A number of a rotation was 120.

Comparative Example 159

A height was 7% (21 mm). A pitch was 2% (18.84 mm). A number of a rotation was 140.

Comparative Example 160

A height was 7% (21 mm). A pitch was 3% (28.26 mm). A number of a rotation was 6.

Comparative Example 161

A height was 7% (21 mm). A pitch was 3% (28.26 mm). A number of a rotation was 10.

Comparative Example 162

A height was 7% (21 mm). A pitch was 3% (28.26 mm). A number of a rotation was 20.

Example 103

A height was 7% (21 mm). A pitch was 3% (28.26 mm). A number of a rotation was 30.

Example 104

A height was 7% (21 mm). A pitch was 3% (28.26 mm). A number of a rotation was 45.

Example 105

A height was 7% (21 mm). A pitch was 3% (28.26 mm). A number of a rotation was 60.

Comparative Example 163

A height was 7% (21 mm). A pitch was 3% (28.26 mm). A number of a rotation was 90.

Comparative Example 164

A height was 7% (21 mm). A pitch was 3% (28.26 mm). A number of a rotation was 120.

Comparative Example 165

A height was 7% (21 mm). A pitch was 3% (28.26 mm). A number of a rotation was 140.

Comparative Example 166

A height was 7% (21 mm). A pitch was 5% (47.1 mm). A number of a rotation was 6

Comparative Example 167

A height was 7% (21 mm). A pitch was 5% (47.1 mm). A number of a rotation was 10.

Comparative Example 168

A height was 7% (21 mm). A pitch was 5% (47.1 mm). A number of a rotation was 20.

Example 106

A height was 7% (21 mm). A pitch was 5% (47.1 mm). A number of a rotation was 30.

Example 107

A height was 7% (21 mm). A pitch was 5% (47.1 mm). A number of a rotation was 45.

Example 108

A height was 7% (21 mm). A pitch was 5% (47.1 mm). A number of a rotation was 60.

Comparative Example 169

A height was 7% (21 mm). A pitch was 5% (47.1 mm). A number of a rotation was 90.

Comparative Example 170

A height was 7% (21 mm). A pitch was 5% (47.1 mm). A number of a rotation was 120.

Comparative Example 171

A height was 7% (21 mm). A pitch was 5% (47.1 mm). A number of a rotation was 140.

Comparative Example 172

A height was 7% (21 mm). A pitch was 6% (56.52 mm). A number of a rotation was 6

Comparative Example 173

A height was 7% (21 mm). A pitch was 6% (56.52 mm). A number of a rotation was 10.

Comparative Example 174

A height was 7% (21 mm). A pitch was 6% (56.52 mm). A number of a rotation was 20.

Example 109

A height was 7% (21 mm). A pitch was 6% (56.52 mm). A number of a rotation was 30.

Example 110

A height was 7% (21 mm). A pitch was 6% (56.52 mm). A number of a rotation was 45.

Example 111

A height was 7% (21 mm). A pitch was 6% (56.52 mm). A number of a rotation was 60.

Comparative Example 175

A height was 7% (21 mm). A pitch was 6% (56.52 mm). A number of a rotation was 90.

Comparative Example 176

A height was 7% (21 mm). A pitch was 6% (56.52 mm). A number of a rotation was 120.

Comparative Example 177

A height was 7% (21 mm). A pitch was 6% (56.52 mm). A number of a rotation was 140.

Comparative Example 178

A height was 7% (21 mm). A pitch was 7% (65.94 mm). A number of a rotation was 6

Comparative Example 179

A height was 7% (21 mm). A pitch was 7% (65.94 mm). A number of a rotation was 10.

Comparative Example 180

A height was 7% (21 mm). A pitch was 7% (65.94 mm). A number of a rotation was 20.

Example 112

A height was 7% (21 mm). A pitch was 7% (65.94 mm). A number of a rotation was 30.

Example 113

A height was 7% (21 mm). A pitch was 7% (65.94 mm). A number of a rotation was 45.

Example 114

A height was 7% (21 mm). A pitch was 7% (65.94 mm). A number of a rotation was 60.

Comparative Example 181

A height was 7% (21 mm). A pitch was 7% (65.94 mm). A number of a rotation was 90.

Comparative Example 182

A height was 7% (21 mm). A pitch was 7% (65.94 mm). A number of a rotation was 120.

Comparative Example 183

A height was 7% (21 mm). A pitch was 7% (65.94 mm). A number of a rotation was 140.

Comparative Example 184

A height was 7% (21 mm). A pitch was 8% (75.36 mm). A number of a rotation was 6

Comparative Example 185

A height was 7% (21 ram). A pitch was 8% (75.36 mm). A number of a rotation was 10.

Comparative Example 186

A height was 7% (21 mm). A pitch was 8% (75.36 mm). A number of a rotation was 20.

Example 115

A height was 7% (21 mm). A pitch was 8% (75.36 mm). A number of a rotation was 30.

Example 116

A height was 7% (21 mm). A pitch was 8% (75.36 mm). A number of a rotation was 45.

Example 117

A height was 7% (21 mm). A pitch was 8% (75.36 mm). A number of a rotation was 60.

Comparative Example 187

A height was 7% (21 mm). A pitch was 8% (75.36 mm). A number of a rotation was 90.

Comparative Example 188

A height was 7% (21 mm). A pitch was 8% (75.36 mm). A number of a rotation was 120.

Comparative Example 189

A height was 7% (21 mm). A pitch was 8% (75.36 mm). A number of a rotation was 140.

Comparative Example 190

A height was 7% (21 mm). A pitch was 9% (84.78 mm). A number of a rotation was 6

Comparative Example 191

A height was 7% (21 mm). A pitch was 9% (84.78 mm). A number of a rotation was 10.

Comparative Example 192

A height was 7% (21 mm). A pitch was 9% (84.78 mm). A number of a rotation was 20.

Example 118

A height was 7% (21 mm). A pitch was 9% (84.78 mm). A number of a rotation was 30.

Example 119

A height was 7% (21 mm). A pitch was 9% (84.78 mm). A number of a rotation was 45.

Example 120

A height was 7% (21 mm). A pitch was 9% (84.78 mm). A number of a rotation was 60.

Comparative Example 193

A height was 7% (21 mm). A pitch was 9% (84.78 mm). A number of a rotation was 90.

Comparative Example 194

A height was 7% (21 mm). A pitch was 9% (84.78 mm). A number of a rotation was 120.

Comparative Example 195

A height was 7% (21 mm). A pitch was 9% (84.78 mm). A number of a rotation was 140.

Comparative Example 196

A height was 8% (24 mm). A pitch was 2% (18.84 mm). A number of a rotation was 6.

Comparative Example 197

A height was 8% (24 mm). A pitch was 2% (18.84 mm). A number of a rotation was 10.

Comparative Example 198

A height was 8% (24 mm). A pitch was 2% (18.84 mm). A number of a rotation was 20.

Example 121

A height was 8% (24 mm). A pitch was 2% (18.84 mm). A number of a rotation was 30.

Example 122

A height was 8% (24 mm). A pitch was 2% (18.84 mm). A number of a rotation was 45.

Example 123

A height was 8% (24 mm). A pitch was 2% (18.84 mm). A number of a rotation was 60.

Example 124

A height was 8% (24 mm). A pitch was 2% (18.84 mm). A number of a rotation was 90.

Comparative Example 199

A height was 8% (24 mm). A pitch was 2% (18.84 mm). A number of a rotation was 120.

Comparative Example 200

A height was 8% (24 mm). A pitch was 2% (18.84 mm). A number of a rotation was 140.

Comparative Example 201

A height was 8% (24 mm). A pitch was 3% (28.26 mm). A number of a rotation was 6.

Comparative Example 202

A height was 8% (24 mm). A pitch was 3% (28.26 mm). A number of a rotation was 10.

Comparative Example 203

A height was 8% (24 mm). A pitch was 3% (28.26 mm). A number of a rotation was 20.

Example 125

A height was 8% (24 mm). A pitch was 3% (28.26 mm). A number of a rotation was 30.

Example 126

A height was 8% (24 mm). A pitch was 3% (28.26 mm). A number of a rotation was 45.

Example 127

A height was 8% (24 mm). A pitch was 3% (28.26 mm). A number of a rotation was 60.

Comparative Example 204

A height was 8% (24 mm). A pitch was 3% (28.26 mm). A number of a rotation was 90.

Comparative Example 205

A height was 8% (24 mm). A pitch was 3% (28.26 mm). A number of a rotation was 120.

Comparative Example 206

A height was 8% (24 mm). A pitch was 3% (28.26 mm). A number of a rotation was 140.

Comparative Example 207

A height was 8% (24 mm). A pitch was 5% (47.1 mm). A number of a rotation was 6

Comparative Example 208

A height was 8% (24 mm). A pitch was 5% (47.1 mm). A number of a rotation was 10.

Comparative Example 209

A height was 8% (24 mm). A pitch was 5% (47.1 mm). A number of a rotation was 20.

Example 128

A height was 8% (24 mm). A pitch was 5% (47.1 mm). A number of a rotation was 30.

Example 129

A height was 8% (24 mm). A pitch was 5% (47.1 mm). A number of a rotation was 45.

Example 130

A height was 8% (24 mm). A pitch was 5% (47.1 mm). A number of a rotation was 60.

Comparative Example 210

A height was 8% (24 mm). A pitch was 5% (47.1 mm). A number of a rotation was 90.

Comparative Example 211

A height was 8% (24 mm). A pitch was 5% (47.1 mm). A number of a rotation was 120.

Comparative Example 212

A height was 8% (24 mm). A pitch was 5% (47.1 mm). A number of a rotation was 140.

Comparative Example 213

A height was 8% (24 mm). A pitch was 6% (56.52 mm). A number of a rotation was 6

Comparative Example 214

A height was 8% (24 mm). A pitch was 6% (56.52 mm). A number of a rotation was 10.

Comparative Example 215

A height was 8% (24 mm). A pitch was 6% (56.52 mm). A number of a rotation was 20.

Example 131

A height was 8% (24 mm). A pitch was 6% (56.52 mm). A number of a rotation was 30.

Example 132

A height was 8% (24 mm). A pitch was 6% (56.52 mm). A number of a rotation was 45.

Example 133

A height was 8% (24 mm). A pitch was 6% (56.52 mm). A number of a rotation was 60.

Comparative Example 216

A height was 8% (24 mm). A pitch was 6% (56.52 mm). A number of a rotation was 90.

Comparative Example 217

A height was 8% (24 mm). A pitch was 6% (56.52 mm). A number of a rotation was 120.

Comparative Example 218

A height was 8% (24 mm). A pitch was 6% (56.52 mm). A number of a rotation was 140.

Comparative Example 219

A height was 8% (24 mm). A pitch was 7% (65.94 mm). A number of a rotation was 6

Comparative Example 220

A height was 8% (24 mm). A pitch was 7% (65.94 mm). A number of a rotation was 10.

Comparative Example 221

A height was 8% (24 mm). A pitch was 7% (65.94 mm). A number of a rotation was 20.

Example 134

A height was 8% (24 mm). A pitch was 7% (65.94 mm). A number of a rotation was 30.

Example 135

A height was 8% (24 mm). A pitch was 7% (65.94 mm). A number of a rotation was 45.

Example 136

A height was 8% (24 mm). A pitch was 7% (65.94 mm). A number of a rotation was 60.

Comparative Example 222

A height was 8% (24 mm). A pitch was 7% (65.94 mm). A number of a rotation was 90.

Comparative Example 223

A height was 8% (24 mm). A pitch was 7% (65.94 mm). A number of a rotation was 120.

Comparative Example 224

A height was 8% (24 mm). A pitch was 7% (65.94 mm). A number of a rotation was 140.

Comparative Example 225

A height was 8% (24 mm). A pitch was 8% (15.36 mm). A number of a rotation was 6

Comparative Example 226

A height was 8% (24 mm). A pitch was 8% (75.36 mm). A number of a rotation was 10.

Comparative Example 227

A height was 8% (24 mm). A pitch was 8% (75.36 mm). A number of a rotation was 20.

Example 137

A height was 8% (24 mm). A pitch was 8% (75.36 mm). A number of a rotation was 30.

Example 138

A height was 8% (24 mm). A pitch was 8% (75.36 mm). A number of a rotation was 45.

Example 139

A height was 8% (24 mm). A pitch was 8% (75.36 mm). A number of a rotation was 60.

Comparative Example 228

A height was 8% (24 mm). A pitch was 8% (75.36 mm). A number of a rotation was 90.

Comparative Example 229

A height was 8% (24 mm). A pitch was 8% (75.36 mm). A number of a rotation was 120.

Comparative Example 230

A height was 8% (24 mm). A pitch was 8% (75.36 mm). A number of a rotation was 140.

Comparative Example 231

A height was 8% (24 mm). A pitch was 9% (84.78 mm). A number of a rotation was 6

Comparative Example 232

A height was 8% (24 mm). A pitch was 9% (84.78 mm). A number of a rotation was 10.

Comparative Example 233

A height was 8% (24 mm). A pitch was 9% (84.78 mm). A number of a rotation was 20.

Example 140

A height was 8% (24 mm). A pitch was 9% (84.78 mm). A number of a rotation was 30.

Example 141

A height was 8% (24 mm). A pitch was 9% (84.78 mm). A number of a rotation was 45.

Example 142

A height was 8% (24 mm). A pitch was 9% (84.78 mm). A number of a rotation was 60.

Comparative Example 234

A height was 8% (24 mm). A pitch was 9% (84.78 mm). A number of a rotation was 90.

Comparative Example 235

A height was 8% (24 mm). A pitch was 9% (84.78 mm). A number of a rotation was 120.

Comparative Example 236

A height was 8% (24 mm). A pitch was 9% (84.78 mm). A number of a rotation was 140.

Comparative Example 237

A height was 9% (27 mm). A pitch was 2% (18.84 mm). A number of a rotation was 6.

Comparative Example 238

A height was 9% (27 mm). A pitch was 2% (18.84 mm). A number of a rotation was 10.

Comparative Example 239

A height was 9% (27 mm). A pitch was 2% (18.84 mm). A number of a rotation was 20.

Example 143

A height was 9% (27 mm). A pitch was 2% (18.84 mm). A number of a rotation was 30.

Example 144

A height was 9% (27 mm). A pitch was 2% (18.84 mm). A number of a rotation was 45.

Example 145

A height was 9% (27 mm). A pitch was 2% (18.84 mm). A number of a rotation was 60.

Comparative Example 240

A height was 9% (27 mm). A pitch was 2% (18.84 mm). A number of a rotation was 90.

Comparative Example 241

A height was 9% (27 mm). A pitch was 2% (18.84 mm). A number of a rotation was 120.

Comparative Example 242

A height was 9% (27 mm). A pitch was 2% (18.84 mm). A number of a rotation was 140.

Comparative Example 243

A height was 9% (27 mm). A pitch was 3% (28.26 mm). A number of a rotation was 6.

Comparative Example 244

A height was 9% (27 mm). A pitch was 3% (28.26 mm). A number of a rotation was 10.

Comparative Example 245

A height was 9% (27 mm). A pitch was 3% (28.26 mm). A number of a rotation was 20.

Example 146

A height was 9% (27 mm). A pitch was 3% (28.26 mm). A number of a rotation was 30.

Example 147

A height was 9% (27 mm). A pitch was 3% (28.26 mm). A number of a rotation was 45.

Example 148

A height was 9% (27 mm). A pitch was 3% (28.26 mm). A number of a rotation was 60.

Comparative Example 246

A height was 9% (27 mm). A pitch was 3% (28.26 mm). A number of a rotation was 90.

Comparative Example 247

A height was 9% (27 mm). A pitch was 3% (28.26 mm). A number of a rotation was 120.

Comparative Example 248

A height was 9% (27 mm). A pitch was 3% (28.26 mm). A number of a rotation was 140.

Comparative Example 249

A height was 9% (27 mm). A pitch was 5% (47.1 mm). A number of a rotation was 6

Comparative Example 250

A height was 9% (27 mm). A pitch was 5% (47.1 mm). A number of a rotation was 10.

Comparative Example 251

A height was 9% (27 mm). A pitch was 5% (47.1 mm). A number of a rotation was 20.

Example 149

A height was 9% (27 mm). A pitch was 5% (47.1 mm). A number of a rotation was 30.

Example 150

A height was 9% (27 mm). A pitch was 5% (47.1 mm). A number of a rotation was 45.

Example 151

A height was 9% (27 mm). A pitch was 5% (47.1 mm). A number of a rotation was 60.

Comparative Example 252

A height was 9% (27 mm). A pitch was 5% (47.1 mm). A number of a rotation was 90.

Comparative Example 253

A height was 9% (27 mm). A pitch was 5% (47.1 mm). A number of a rotation was 120.

Comparative Example 254

A height was 9% (27 mm). A pitch was 5% (47.1 mm). A number of a rotation was 140.

Comparative Example 255

A height was 9% (27 mm). A pitch was 6% (56.52 mm). A number of a rotation was 6

Comparative Example 256

A height was 9% (27 mm). A pitch was 6% (56.52 mm). A number of a rotation was 10.

Comparative Example 257

A height was 9% (27 mm). A pitch was 6% (56.52 mm). A number of a rotation was 20.

Example 152

A height was 9% (27 mm). A pitch was 6% (56.52 mm). A number of a rotation was 30.

Example 153

A height was 9% (27 mm). A pitch was 6% (56.52 mm). A number of a rotation was 45.

Example 154

A height was 9% (27 mm). A pitch was 6% (56.52 mm). A number of a rotation was 60.

Comparative Example 258

A height was 9% (27 mm). A pitch was 6% (56.52 mm). A number of a rotation was 90.

Comparative Example 259

A height was 9% (27 mm). A pitch was 6% (56.52 mm). A number of a rotation was 120.

Comparative Example 260

A height was 9% (27 mm). A pitch was 6% (56.52 mm). A number of a rotation was 140.

Comparative Example 61

A height was 9% (27 mm). A pitch was 7% (65.94 mm). A number of a rotation was 6

Comparative Example 262

A height was 9% (27 mm). A pitch was 7% (65.94 mm). A number of a rotation was 10.

Comparative Example 263

A height was 9% (27 mm). A pitch was 7% (65.94 mm). A number of a rotation was 20.

Example 155

A height was 9% (27 mm). A pitch was 7% (65.94 mm). A number of a rotation was 30.

Example 156

A height was 9% (27 mm). A pitch was 7% (65.94 mm). A number of a rotation was 45.

Example 157

A height was 9% (27 mm). A pitch was 7% (65.94 mm). A number of a rotation was 60.

Comparative Example 264

A height was 9% (27 mm). A pitch was 7% (65.94 mm). A number of a rotation was 90.

Comparative Example 265

A height was 9% (27 mm). A pitch was 7% (65.94 mm). A number of a rotation was 120.

Comparative Example 266

A height was 9% (27 mm). A pitch was 7% (65.94 mm). A number of a rotation was 140.

Comparative Example 267

A height was 9% (27 mm). A pitch was 8% (75.36 mm). A number of a rotation was 6

Comparative Example 268

A height was 9% (27 mm). A pitch was 8% (75.36 mm). A number of a rotation was 10.

Comparative Example 269

A height was 9% (27 mm). A pitch was 8% (75.36 mm). A number of a rotation was 20.

Example 158

A height was 9% (27 mm). A pitch was 8% (75.36 mm). A number of a rotation was 30.

Example 159

A height was 9% (27 mm). A pitch was 8% (75.36 mm). A number of a rotation was 45.

Example 160

A height was 9% (27 mm). A pitch was 8% (75.36 mm). A number of a rotation was 60.

Comparative Example 270

A height was 9% (27 mm). A pitch was 8% (75.36 mm). A number of a rotation was 90.

Comparative Example 271

A height was 9% (27 mm). A pitch was 8% (75.36 mm). A number of a rotation was 120.

Comparative Example 272

A height was 9% (27 mm). A pitch was 8% (75.36 mm). A number of a rotation was 140.

Comparative Example 273

A height was 9% (27 mm). A pitch was 9% (84.78 mm). A number of a rotation was 6

Comparative Example 274

A height was 9% (27 mm). A pitch was 9% (84.78 mm). A number of a rotation was 10.

Comparative Example 275

A height was 9% (27 mm). A pitch was 9% (84.78 mm). A number of a rotation was 20.

Example 161

A height was 9% (27 mm). A pitch was 9% (84.78 mm). A number of a rotation was 30.

Example 162

A height was 9% (27 mm). A pitch was 9% (84.78 mm). A number of a rotation was 45.

Example 163

A height was 9% (27 mm). A pitch was 9% (84.78 mm). A number of a rotation was 60.

Comparative Example 276

A height was 9% (27 mm). A pitch was 9% (84.78 mm). A number of a rotation was 90.

Comparative Example 277

A height was 9% (27 mm). A pitch was 9% (84.78 mm). A number of a rotation was 120.

Comparative Example 278

A height was 9% (27 mm). A pitch was 9% (84.78 mm). A number of a rotation was 140.

Comparative Example 279

A height was 4% (12 mm). A pitch was 4% (37.68 mm). A number of a rotation was 6.

Comparative Example 280

A height was 4% (12 mm). A pitch was 4% (37.68 mm). A number of a rotation was 10.

Comparative Example 281

A height was 4% (12 mm). A pitch was 4% (37.68 mm). A number of a rotation was 20.

Example 164

A height was 4% (12 mm). A pitch was 4% (37.68 mm). A number of a rotation was 30.

Example 165

A height was 4% (12 mm). A pitch was 4% (37.68 mm). A number of a rotation was 45.

Example 166

A height was 4% (12 mm). A pitch was 4% (37.68 mm). A number of a rotation was 60.

Example 167

A height was 4% (12 mm). A pitch was 4% (37.68 mm). A number of a rotation was 90.

Comparative Example 282

A height was 4% (12 mm). A pitch was 4% (37.68 mm). A number of a rotation was 120.

Comparative Example 283

A height was 4% (12 mm). A pitch was 4% (37.68 mm). A number of a rotation was 140.

Contents of Examples 1 to 3 and Comparative Examples 1 to 6 are shown in Table 1.

Contents of Examples 4 to 6 and Comparative Examples 7 to 12 are shown in Table 2.

Contents of Examples 7 to 10 and Comparative Examples 13 to 17 are shown in Table 3.

Contents of Examples 11 to 14 and Comparative Examples 18 to 22 are shown in Table 4.

Contents of Examples 15 to 18 and Comparative Examples 23 to 27 are shown in Table 5.

Contents of Examples 19 to 22 and Comparative Examples 28 to 32 are shown in Table 6.

Contents of Examples 23 to 25 and Comparative Examples 33 to 38 are shown in Table 7.

Contents of Examples 26 to 29 and Comparative Examples 39 to 43 are shown in Table 8.

Contents of Examples 30 to 32 and Comparative Examples 44 to 49 are shown in Table 9.

Contents of Examples 33 to 36 and Comparative Examples 50 to 54 are shown in Table 10.

Contents of Examples 37 to 40 and Comparative Examples 55 to 59 are shown in Table 11.

Contents of Examples 41 to 44 and Comparative Examples 60 to 64 are shown in Table 12.

Contents of Examples 45 to 48 and Comparative Examples 65 to 69 are shown in Table 13.

Contents of Examples 49 to 51 and Comparative Examples 70 to 75 are shown in Table 14.

Contents of Examples 52 to 55 and Comparative Examples 76 to 80 are shown in Table 15.

Contents of Examples 56 to 59 and Comparative Examples 81 to 85 are shown in Table 16.

Contents of Examples 60 to 62 and Comparative Examples 86 to 91 are shown in Table 17.

Contents of Examples 63 to 66 and Comparative Examples 92 to 96 are shown in Table 18.

Contents of Examples 67 to 70 and Comparative Examples 97 to 101 are shown in Table 19.

Contents of Examples 71 to 74 and Comparative Examples 102 to 106 are shown in Table 20.

Contents of Examples 75 to 78 and Comparative Examples 107 to 111 are shown in Table 21.

Contents of Examples 79 to 81 and Comparative Examples 112 to 117 are shown in Table 22.

Contents of Examples 82 to 84 and Comparative Examples 118 to 123 are shown in Table 23.

Contents of Examples 85 to 87 and Comparative Examples 124 to 129 are shown in Table 24.

Contents of Examples 88 to 90 and Comparative Examples 130 to 135 are shown in Table 25.

Contents of Examples 91 to 93 and Comparative Examples 136 to 141 are shown in Table 26.

Contents of Examples 94 to 96 and Comparative Examples 142 to 147 are shown in Table 27.

Contents of Examples 97 to 99 and Comparative Examples 148 to 153 are shown in Table 28.

Contents of Examples 100 to 102 and Comparative Examples 154 to 159 are shown in Table 29.

Contents of Examples 103 to 105 and Comparative Examples 160 to 165 are shown in Table 30.

Contents of Examples 106 to 108 and Comparative Examples 166 to 171 are shown in Table 31.

Contents of Examples 109 to 111 and Comparative Examples 172 to 177 are shown in Table 32.

Contents of Examples 112 to 114 and Comparative Examples 178 to 183 are shown in Table 33.

Contents of Examples 115 to 117 and Comparative Examples 184 to 189 are shown in Table 34.

Contents of Examples 118 to 120 and Comparative Examples 190 to 195 are shown in Table 35.

Contents of Examples 121 to 124 and Comparative Examples 196 to 200 are shown in Table 36.

Contents of Examples 125 to 127 and Comparative Examples 201 to 206 are shown in Table 37.

Contents of Examples 128 to 130 and Comparative Examples 207 to 212 are shown in Table 38.

Contents of Examples 131 to 133 and Comparative Examples 213 to 218 are shown in Table 39.

Contents of Examples 134 to 136 and Comparative Examples 219 to 224 are shown in Table 40.

Contents of Examples 137 to 139 and Comparative Examples 225 to 230 are shown in Table 41.

Contents of Examples 140 to 142 and Comparative Examples 231 to 236 are shown in Table 42.

Contents of Examples 143 to 145 and Comparative Examples 237 to 242 are shown in Table 43.

Contents of Examples 146 to 148 and Comparative Examples 243 to 248 are shown in Table 44.

Contents of Examples 149 to 151 and Comparative Examples 249 to 254 are shown in Table 45.

Contents of Examples 152 to 154 and Comparative Examples 255 to 260 are shown in Table 46.

Contents of Examples 155 to 157 and Comparative Examples 261 to 266 are shown in Table 47.

Contents of Examples 158 to 160 and Comparative Examples 267 to 272 are shown in Table 48.

Contents of Examples 161 to 163 and Comparative Examples 273 to 278 are shown in Table 49.

Contents of Examples 164 to 167 and Comparative Examples 279 to 283 are shown in Table 50.

TABLE 1

| | | | Rotation Speed | | | | | | | | |
|---|---|---|---|---|---|---|---|---|---|---|---|
| Hight mm | Pitch mm | Floating Ball | Comp. Ex. 1 6 rpm | Comp. Ex. 2 10 rpm | Comp. Ex. 3 20 rpm | Ex. 1 30 rpm | Ex. 2 45 rpm | Ex. 3 60 rpm | Comp. Ex. 4 90 rpm | Comp. Ex. 5 120 rpm | Comp. Ex. 6 140 rpm |
| 2%-6 | 2% 18.84 | Red (0.95) | Rolled along the inner wall. | Rolled along the inner wall. | Rolled with bouncing along the inner wall. | Repeated wide bouncing and rolled along the inner wall. | Repeated wide bouncing and rolled along the inner wall. | Repeated wide bouncing and rolled along the inner wall. | Contacted. | No contact. | No contact. |
| | | White (1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. | Moved in a circular motion along the vicinity of the inner wall. | Gathered in the center. | Gathered in the center. | Gathered in the center. |
| | | Brown (1.2) | Rolled along the inner wall. | Rolled along the inner wall. | Rolled with bouncing along the inner wall. | Repeated wide bouncing and rolled along the inner wall. | Contacted. | Pressed against the wall. | Pressed against the wall. | Pressed against the wall. | Pressed against the wall. |

TABLE 2

| Hight mm | Pitch mm | Floating Ball | Rotation Speed: Comp. Ex. 7 6 rpm | Comp. Ex. 8 10 rpm | Comp. Ex. 9 20 rpm | Ex. 4 30 rpm | Ex. 5 45 rpm | Ex. 6 60 rpm | Comp. Ex. 10 90 rpm | Comp. Ex. 11 120 rpm | Comp. Ex. 12 140 rpm |
|---|---|---|---|---|---|---|---|---|---|---|---|
| 2%-6 | 3% 28.26 | Red (0.95) | Rolled along the inner wall. | Rolled along the inner wall. | Rolled with bouncing along the inner wall. | Repeated wide bouncing and rolled along the inner wall. | Repeated wide bouncing and rolled along the inner wall. | Repeated wide bouncing and rolled along the inner wall. | No contact. | No contact. | No contact. |
| | | White (1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. | Moved in a circular motion along the vicinity of the inner wall. | Gathered in the center. | Gathered in the center. | Gathered in the center. |
| | | Brown (1.2) | Rolled along the inner wall. | Rolled along the inner wall. | Rolled with bouncing along the inner wall. | Repeated wide bouncing and rolled along the inner wall. | Repeated wide bouncing and rolled along the inner wall. | Contacted. | Pressed against the wall. | Pressed against the wall. | Pressed against the wall. |

TABLE 3

| Hight mm | Pitch mm | Floating Ball | Rotation Speed: Comp. Ex. 13 6 rpm | Comp. Ex. 14 10 rpm | Comp. Ex. 15 20 rpm | Ex. 7 30 rpm | Ex. 8 45 rpm | Ex. 9 60 rpm | Ex. 10 90 rpm | Comp. Ex. 16 120 rpm | Comp. Ex. 17 140 rpm |
|---|---|---|---|---|---|---|---|---|---|---|---|
| 2%-6 | 5% 47.1 | Red (0.95) | Rolled along the inner wall. | Rolled along the inner wall. | Rolled with bouncing along the inner wall. | Repeated wide bouncing and rolled along the inner wall. | Repeated wide bouncing and rolled along the inner wall. | Contacted. | No contact. | No contact. | No contact. |
| | | White (1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. | Moved in a circular motion along the vicinity of the inner wall. | Moved in a circular motion along the vicinity of the inner wall. | Gathered in the center. | Gathered in the center. |
| | | Brown (1.2) | Rolled along the inner wall. | Rolled along the inner wall. | Rolled with bouncing along the inner wall. | Repeated wide bouncing and rolled along the inner wall. | Repeated wide bouncing and rolled along the inner wall. | Contacted. | Pressed against the wall. | Pressed against the wall. | Pressed against the wall. |

TABLE 4

| Hight mm | Pitch mm | Floating Ball | Rotation Speed: Comp. Ex. 18 6 rpm | Comp. Ex. 19 10 rpm | Comp. Ex. 20 20 rpm | Ex. 11 30 rpm | Ex. 12 45 rpm | Ex. 13 60 rpm | Ex. 14 90 rpm | Comp. Ex. 21 120 rpm | Comp. Ex. 22 140 rpm |
|---|---|---|---|---|---|---|---|---|---|---|---|
| 2%-6 | 6% 56.52 | Red (0.95) | Rolled along the inner wall. | Rolled along the inner wall. | Rolled with bouncing along the inner wall. | Repeated wide bouncing and rolled along the inner wall. | Repeated wide bouncing and rolled along the inner wall. | Contacted. | No contact. | No contact. | No contact. |
| | | White (1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. | Moved in a circular motion along the vicinity of the inner wall. | Moved in a circular motion along the vicinity of the inner wall. | Gathered in the center. | Gathered in the center. |
| | | Brown (1.2) | Rolled along the inner wall. | Rolled along the inner wall. | Rolled with bouncing along the inner wall. | Repeated wide bouncing and rolled along the inner wall. | Repeated wide bouncing and rolled along the inner wall. | Repeated wide bouncing and rolled along the inner wall. | Pressed against the wall. | Pressed against the wall. | Pressed against the wall. |

TABLE 5

| Hight mm | Pitch mm | Floating Ball | Rotation Speed: Comp. Ex. 23 6 rpm | Comp. Ex. 24 10 rpm | Comp. Ex. 25 20 rpm | Ex. 15 30 rpm | Ex. 16 45 rpm | Ex. 17 60 rpm | Ex. 18 90 rpm | Comp. Ex. 26 120 rpm | Comp. Ex. 27 140 rpm |
|---|---|---|---|---|---|---|---|---|---|---|---|
| 2%-6 | 7% 65.94 | Red (0.95) | Rolled along the inner wall. | Rolled along the inner wall. | Contacted. | Contacted. | Contacted. | Contacted. | No contact. | No contact. | No contact. |
| | | White (1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. | Moved in a circular motion along the vicinity of the inner wall. | Moved in a circular motion along the vicinity of the inner wall. | Gathered in the center. | Gathered in the center. |
| | | Brown (1.2) | Rolled along the inner wall. | Rolled along the inner wall. | Contacted. | Contacted. | Contacted. | Contacted. | Pressed against the wall. | Pressed against the wall. | Pressed against the wall. |

TABLE 6

| Hight mm | Pitch mm | Floating Ball | Rotation Speed: Comp. Ex. 28 6 rpm | Comp. Ex. 29 10 rpm | Comp. Ex. 30 20 rpm | Ex. 19 30 rpm | Ex. 20 45 rpm |
|---|---|---|---|---|---|---|---|
| 2%-6 | 8% 75.36 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed: Ex. 21 60 rpm | Ex. 22 90 rpm | Comp. Ex. 31 120 rpm | Comp. Ex. 32 140 rpm |
|---|---|---|---|---|---|---|
| 2%-6 | 8% 75.36 | Red(0.95) | Contacted. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Contacted. | Pressed against the wall. | Pressed against the wall. | Pressed against the wall. |

TABLE 7

| Hight mm | Pitch mm | Floating Ball | Rotation Speed: Comp. Ex. 33 6 rpm | Comp. Ex. 34 10 rpm | Comp. Ex. 35 20 rpm | Ex. 23 30 rpm | Ex. 24 45 rpm |
|---|---|---|---|---|---|---|---|
| 2%-6 | 9% 84.78 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

TABLE 7-continued

| | | | Rotation Speed | | | |
|---|---|---|---|---|---|---|
| Hight mm | Pitch mm | Floating Ball | Ex. 25 60 rpm | Comp. Ex. 36 90 rpm | Comp. Ex. 37 120 rpm | Comp. Ex. 38 140 rpm |
| 2%-6 | 9% 84.78 | Red(0.95) White(1.0) | Contacted. Moved in a circular motion along the vicinity of the inner wall. | Contacted. Gathered in the center. | No contact. Gathered in the center. | No contact. Gathered in the center. |
| | | Brown(1.2) | Contacted. | Contacted. | Pressed against the wall. | Pressed against the wall. |

TABLE 8

| | | | Rotation Speed | | | | |
|---|---|---|---|---|---|---|---|
| Hight mm | Pitch mm | Floating Ball | Comp. Ex. 39 6 rpm | Comp. Ex. 40 10 rpm | Comp. Ex. 41 20 rpm | Ex. 26 30 rpm | Ex. 27 45 rpm |
| 3%-9 | 2% 18.84 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |

| | | | Rotation Speed | | | |
|---|---|---|---|---|---|---|
| Hight mm | Pitch mm | Floating Ball | Ex. 28 60 rpm | Ex. 29 90 rpm | Comp. Ex. 42 120 rpm | Comp. Ex. 43 140 rpm |
| 3%-9 | 2% 18.84 | Red(0.95) White(1.0) | Contacted. Moved in a circular motion along the vicinity of the inner wall. | No contact. Moved in a circular motion along the vicinity of the inner wall. | No contact. Gathered in the center. | No contact. Gathered in the center. |
| | | Brown(1.2) | Repeated wide bouncing and rolled along the inner wall. | Pressed against the wall. | Pressed against the wall. | Pressed against the wall. |

TABLE 9

| | | | Rotation Speed | | | | |
|---|---|---|---|---|---|---|---|
| Hight mm | Pitch mm | Floating Ball | Comp. Ex. 44 6 rpm | Comp. Ex. 45 10 rpm | Comp. Ex. 46 20 rpm | Ex. 30 30 rpm | Ex. 31 45 rpm |
| 3%-9 | 3% 28.26 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

TABLE 9-continued

| | | | Rotation Speed | | | |
|---|---|---|---|---|---|---|
| Hight mm | Pitch mm | Floating Ball | Ex. 32 60 rpm | Comp. Ex. 47 90 rpm | Comp. Ex. 48 120 rpm | Comp. Ex. 49 140 rpm |
| 3%-9 | 3% 28.26 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 10

| | | | Rotation Speed | | | | |
|---|---|---|---|---|---|---|---|
| Hight mm | Pitch mm | Floating Ball | Comp. Ex. 50 6 rpm | Comp. Ex. 51 10 rpm | Comp. Ex. 52 20 rpm | Ex. 33 30 rpm | Ex. 34 45 rpm |
| 3%-9 | 5% 47.1 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |

| | | | Rotation Speed | | | |
|---|---|---|---|---|---|---|
| Hight mm | Pitch mm | Floating Ball | Ex. 35 60 rpm | Ex. 36 90 rpm | Comp. Ex. 53 120 rpm | Comp. Ex. 54 140 rpm |
| 3%-9 | 5% 47.1 | Red(0.95) White(1.0) | No contact. Moved in a circular motion along the vicinity of the inner wall. | No contact. Moved in a circular motion along the vicinity of the inner wall. | No contact. Gathered in the center. | No contact. Gathered in the center. |
| | | Brown(1.2) | Repeated wide bouncing and rolled along the inner wall. | Pressed against the wall. | Pressed against the wall. | Pressed against the wall. |

TABLE 11

| | | | Rotation Speed | | | | |
|---|---|---|---|---|---|---|---|
| Hight mm | Pitch mm | Floating Ball | Comp. Ex. 55 6 rpm | Comp. Ex. 56 10 rpm | Comp. Ex. 57 20 rpm | Ex. 37 30 rpm | Ex. 38 45 rpm |
| 3%-9 | 6% 56.52 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |

TABLE 11-continued

| | | | | | | |
|---|---|---|---|---|---|---|
| | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |
| | | | Rotation Speed | | | |
| Hight mm | Pitch mm | Floating Ball | Ex. 39 60 rpm | Ex. 40 90 rpm | Comp. Ex. 58 120 rpm | Comp. Ex. 59 140 rpm |
| 3%-9 | 6% 56.52 | Red(0.95) White(1.0) | No contact. Moved in a circular motion along the vicinity of the inner wall. | No contact. Moved in a circular motion along the vicinity of the inner wall. | No contact. Gathered in the center. | No contact. Gathered in the center. |
| | | Brown(1.2) | Repeated wide bouncing and rolled along the inner wall. | Pressed against the wall. | Pressed against the wall. | Pressed against the wall. |

TABLE 12

| | | | | | | | |
|---|---|---|---|---|---|---|---|
| | | | Rotation Speed | | | | |
| Hight mm | Pitch mm | Floating Ball | Comp. Ex. 60 6 rpm | Comp. Ex. 61 10 rpm | Comp. Ex. 62 20 rpm | Ex. 41 30 rpm | Ex. 42 45 rpm |
| 3%-9 | 7% 65.94 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |
| | | | Rotation Speed | | | | |
| Hight mm | Pitch mm | Floating Ball | Ex. 43 60 rpm | Ex. 44 90 rpm | Comp. Ex. 63 120 rpm | Comp. Ex. 64 140 rpm | |
| 3%-9 | 7% 65.94 | Red(0.95) White(1.0) | No contact. Moved in a circular motion along the vicinity of the inner wall. | No contact. Moved in a circular motion along the vicinity of the inner wall. | No contact. Gathered in the center. | No contact. Gathered in the center. | |
| | | Brown(1.2) | Contacted. | Pressed against the wall. | Pressed against the wall. | Pressed against the wall. | |

TABLE 13

| | | | | | | | |
|---|---|---|---|---|---|---|---|
| | | | Rotation Speed | | | | |
| Hight mm | Pitch mm | Floating Ball | Comp. Ex. 65 6 rpm | Comp. Ex. 66 10 rpm | Comp. Ex. 67 20 rpm | Ex. 45 30 rpm | Ex. 46 45 rpm |
| 3%-9 | 8% 75.36 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |

TABLE 13-continued

| | | | | | | |
|---|---|---|---|---|---|---|
| | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |

| | | | Rotation Speed | | | |
|---|---|---|---|---|---|---|
| Hight mm | Pitch mm | Floating Ball | Ex. 47 60 rpm | Ex. 48 90 rpm | Comp. Ex. 68 120 rpm | Comp. Ex. 69 140 rpm |
| 3%-9 | 8% 75.36 | Red(0.95) | Repeated wide bouncing and rolled along the inner wall. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Repeated wide bouncing and rolled along the inner wall. | Pressed against the wall. | Pressed against the wall. | Pressed against the wall. |

TABLE 14

| | | | Rotation Speed | | | | |
|---|---|---|---|---|---|---|---|
| Hight mm | Pitch mm | Floating Ball | Comp. Ex. 70 6 rpm | Comp. Ex. 71 10 rpm | Comp. Ex. 72 20 rpm | Ex. 49 30 rpm | Ex. 50 45 rpm |
| 3%-9 | 9% 84.78 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |

| | | | Rotation Speed | | | |
|---|---|---|---|---|---|---|
| Hight mm | Pitch mm | Floating Ball | Ex. 51 60 rpm | Comp. Ex. 73 90 rpm | Comp. Ex. 74 120 rpm | Comp. Ex. 75 140 rpm |
| 3%-9 | 9% 84.78 | Red(0.95) | Contacted. | No contact. | No contact. | No contact. |
| | | White(1.0) | Moved in a circular motion along the vicinity of the inner wall. | Gathered in the center. | Gathered in the center. | Gathered in the center. |
| | | Brown(1.2) | Contacted. | Contacted. | Pressed against the wall. | Pressed against the wall. |

TABLE 15

| | | | Rotation Speed | | | | |
|---|---|---|---|---|---|---|---|
| Hight mm | Pitch mm | Floating Ball | Comp. Ex. 76 6 rpm | Comp. Ex. 77 10 rpm | Comp. Ex. 78 20 rpm | Ex. 52 30 rpm | Ex. 53 45 rpm |
| 5%-15 | 2% 18.84 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |

TABLE 15-continued

| | | | | | | |
|---|---|---|---|---|---|---|
| | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |

| | | | Rotation Speed | | | |
|---|---|---|---|---|---|---|
| Hight mm | Pitch mm | Floating Ball | Ex. 54 60 rpm | Ex. 55 90 rpm | Comp. Ex. 79 120 rpm | Comp. Ex. 80 140 rpm |
| 5%-15 | 2% 18.84 | Red(0.95) White(1.0) | Contacted. Moved in a circular motion along the vicinity of the inner wall. | No contact. Moved in a circular motion along the vicinity of the inner wall. | No contact. Gathered in the center. | No contact. Gathered in the center. |
| | | Brown(1.2) | Repeated wide bouncing and rolled along the inner wall. | Pressed against the wall. | Pressed against the wall. | Pressed against the wall. |

TABLE 16

| | | | Rotation Speed | | | | |
|---|---|---|---|---|---|---|---|
| Hight mm | Pitch mm | Floating Ball | Comp. Ex. 81 6 rpm | Comp. Ex. 82 10 rpm | Comp. Ex. 83 20 rpm | Ex. 56 30 rpm | Ex. 57 45 rpm |
| 5%-15 | 3% 28.26 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |

| | | | Rotation Speed | | | |
|---|---|---|---|---|---|---|
| Hight mm | Pitch mm | Floating Ball | Ex. 58 60 rpm | Ex. 59 90 rpm | Comp. Ex. 84 120 rpm | Comp. Ex. 85 140 rpm |
| 5%-15 | 3% 28.26 | Red(0.95) White(1.0) | No contact. Moved in a circular motion along the vicinity of the inner wall. | No contact. Moved in a circular motion along the vicinity of the inner wall. | No contact. Gathered in the center. | No contact. Gathered in the center. |
| | | Brown(1.2) | Contacted. | Pressed against the wall. | Pressed against the wall. | Pressed against the wall. |

TABLE 17

| Hight mm | Pitch mm | Floating Ball | Rotation Speed: Comp. Ex. 86 6 rpm | Comp. Ex. 87 10 rpm | Comp. Ex. 88 20 rpm | Ex. 60 30 rpm | Ex. 61 45 rpm |
|---|---|---|---|---|---|---|---|
| 5%-15 | 5% 47.1 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed: Ex. 62 60 rpm | Comp. Ex. 89 90 rpm | Comp. Ex. 90 120 rpm | Comp. Ex. 91 140 rpm |
|---|---|---|---|---|---|---|
| 5%-15 | 5% 47.1 | Red(0.95) | No contact. | No contact. | No contact. | No contact. |
| | | White(1.0) | Moved in a circular motion along the vicinity of the inner wall. | Gathered in the center. | Gathered in the center. | Gathered in the center. |
| | | Brown(1.2) | Contacted. | Pressed against the wall. | Pressed against the wall. | Pressed against the wall. |

TABLE 18

| Hight mm | Pitch mm | Floating Ball | Rotation Speed: Comp. Ex. 92 6 rpm | Comp. Ex. 93 10 rpm | Comp. Ex. 94 20 rpm | Ex. 63 30 rpm | Ex. 64 45 rpm |
|---|---|---|---|---|---|---|---|
| 5%-15 | 6% 56.52 | Red(0.95) | Rolled along the inner wall. | Rolled along the inner wall. | Rolled along the inner wall. | Repeated wide bouncing and rolled along the inner wall. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Repeated wide bouncing and rolled along the inner wall. | Contacted. |

| Hight mm | Pitch mm | Floating Ball | Rotation Speed: Ex. 65 60 rpm | Ex. 66 90 rpm | Comp. Ex. 95 120 rpm | Comp. Ex. 96 140 rpm |
|---|---|---|---|---|---|---|
| 5%-15 | 6% 56.52 | Red(0.95) | No contact. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Contacted. | Pressed against the wall. | Pressed against the wall. | Pressed against the wall. |

TABLE 19

| Hight mm | Pitch mm | Floating Ball | Rotation Speed: Comp. Ex. 97 6 rpm | Comp. Ex. 98 10 rpm | Comp. Ex. 99 20 rpm | Ex. 67 30 rpm | Ex. 68 45 rpm |
|---|---|---|---|---|---|---|---|
| 5%-15 | 7% 65.94 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed: Ex. 69 60 rpm | Ex. 70 90 rpm | Comp. Ex. 100 120 rpm | Comp. Ex. 101 140 rpm |
|---|---|---|---|---|---|---|
| 5%-15 | 7% 65.94 | Red(0.95) | Contacted. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Contacted. | Pressed against the wall. | Pressed against the wall. | Pressed against the wall. |

TABLE 20

| Hight mm | Pitch mm | Floating Ball | Rotation Speed: Comp. Ex. 102 6 rpm | Comp. Ex. 103 10 rpm | Comp. Ex. 104 20 rpm | Ex. 71 30 rpm | Ex. 72 45 rpm |
|---|---|---|---|---|---|---|---|
| 5%-15 | 8% 75.36 | Red(0.95) | Rolled along the inner wall. | Rolled along the inner wall. | Repeated wide bouncing and rolled along the inner wall. | Repeated wide bouncing and rolled along the inner wall. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Repeated wide bouncing and rolled along the inner wall. | Repeated wide bouncing and rolled along the inner wall. | Contacted. |

| Hight mm | Pitch mm | Floating Ball | Rotation Speed: Ex. 73 60 rpm | Ex. 74 90 rpm | Comp. Ex. 105 120 rpm | Comp. Ex. 106 140 rpm |
|---|---|---|---|---|---|---|
| 5%-15 | 8% 75.36 | Red(0.95) | No contact. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Contacted. | Pressed against the wall. | Pressed against the wall. | Pressed against the wall. |

TABLE 21

| Hight mm | Pitch mm | Floating Ball | Rotation Speed: Comp. Ex. 107 6 rpm | Comp. Ex. 108 10 rpm | Comp. Ex. 109 20 rpm | Ex. 75 30 rpm | Ex. 76 45 rpm |
|---|---|---|---|---|---|---|---|
| 5%-15 | 9% 84.78 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed: Ex. 77 60 rpm | Ex. 78 90 rpm | Comp. Ex. 110 120 rpm | Comp. Ex. 111 140 rpm |
|---|---|---|---|---|---|---|
| 5%-15 | 9% 84.78 | Red(0.95) | No contact. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Contacted. | Pressed against the wall. | Pressed against the wall. | Pressed against the wall. |

TABLE 22

| Hight mm | Pitch mm | Floating Ball | Rotation Speed: Comp. Ex. 112 6 rpm | Comp. Ex. 113 10 rpm | Comp. Ex. 114 20 rpm | Ex. 79 30 rpm | Ex. 80 45 rpm |
|---|---|---|---|---|---|---|---|
| 6%-18 | 2% 18.84 | Red(0.95) | Rolled along the inner wall. | Rolled along the inner wall. | Rolled along the inner wall. | Repeated wide bouncing and rolled along the inner wall. | Repeated wide bouncing and rolled along the inner wall. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Repeated wide bouncing and rolled along the inner wall. | Repeated wide bouncing and rolled along the inner wall. |

| Hight mm | Pitch mm | Floating Ball | Rotation Speed: Ex. 81 60 rpm | Comp. Ex. 115 90 rpm | Comp. Ex. 116 120 rpm | Comp. Ex. 117 140 rpm |
|---|---|---|---|---|---|---|
| 6%-18 | 2% 18.84 | Red(0.95) | No contact. | No contact. | No contact. | No contact. |
| | | White(1.0) | Moved in a circular motion along the vicinity of the inner wall. | Gathered in the center. | Gathered in the center. | Gathered in the center. |
| | | Brown(1.2) | Pressed against the wall. | Pressed against the wall. | Pressed against the wall. | Pressed against the wall. |

TABLE 23

| Hight mm | Pitch mm | Floating Ball | Rotation Speed Comp. Ex. 118 6 rpm | Comp. Ex. 119 10 rpm | Comp. Ex. 120 20 rpm | Ex. 82 30 rpm | Ex. 83 45 rpm |
|---|---|---|---|---|---|---|---|
| 6%-18 | 3% 28.26 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |

| Hight mm | Pitch mm | Floating Ball | Rotation Speed Ex. 84 60 rpm | Comp. Ex. 121 90 rpm | Comp. Ex. 122 120 rpm | Comp. Ex. 123 140 rpm |
|---|---|---|---|---|---|---|
| 6%-18 | 3% 28.26 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 24

| Hight mm | Pitch mm | Floating Ball | Rotation Speed Comp. Ex. 124 6 rpm | Comp. Ex. 125 10 rpm | Comp. Ex. 126 20 rpm | Ex. 85 30 rpm | Ex. 86 45 rpm |
|---|---|---|---|---|---|---|---|
| 6%-18 | 5% 47.1 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |

| Hight mm | Pitch mm | Floating Ball | Rotation Speed Ex. 87 60 rpm | Comp. Ex. 127 90 rpm | Comp. Ex. 128 120 rpm | Comp. Ex. 129 140 rpm |
|---|---|---|---|---|---|---|
| 6%-18 | 5% 47.1 | Red(0.95) White(1.0) | Contacted. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 25

| Hight mm | Pitch mm | Floating Ball | Rotation Speed Comp. Ex. 130 6 rpm | Comp. Ex. 131 10 rpm | Comp. Ex. 132 20 rpm | Ex. 88 30 rpm | Ex. 89 45 rpm |
|---|---|---|---|---|---|---|---|
| 6%-18 | 6% 56.52 | Red(0.95) | Rolled along the inner wall. | Rolled along the inner wall. | Rolled along the inner wall. | Contacted. | No contact. |
| | | White(1.0) | Moved back and forth irregularly | Moved back and forth irregularly | Moved back and forth irregularly | Moved in a circular motion along | Moved in a circular motion along |

TABLE 25-continued

| | | | | | | |
|---|---|---|---|---|---|---|
| | | between the wall. | between the wall. | between the wall. | the vicinity of the inner wall. | the vicinity of the inner wall. |
| | Brown(1.2) | Rolled along the inner wall. | Rolled along the inner wall. | Rolled along the inner wall. | Contacted. | Contacted. |

| | | | Rotation Speed | | | |
|---|---|---|---|---|---|---|
| Hight mm | Pitch mm | Floating Ball | Ex. 90 60 rpm | Comp. Ex. 133 90 rpm | Comp. Ex. 134 120 rpm | Comp. Ex. 135 140 rpm |
| 6%-18 | 6% 56.52 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 26

| | | | Rotation Speed | | | | |
|---|---|---|---|---|---|---|---|
| Hight mm | Pitch mm | Floating Ball | Comp. Ex. 136 6 rpm | Comp. Ex. 137 10 rpm | Comp. Ex. 138 20 rpm | Ex. 91 30 rpm | Ex. 92 45 rpm |
| 6%-18 | 7% 65.94 | Red(0.95) | Rolled along the inner wall. | Rolled along the inner wall. | Contacted. | Contacted. | No contact. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| | | | Rotation Speed | | | |
|---|---|---|---|---|---|---|
| Hight mm | Pitch mm | Floating Ball | Ex. 93 60 rpm | Comp. Ex. 139 90 rpm | Comp. Ex. 140 120 rpm | Comp. Ex. 141 140 rpm |
| 6%-18 | 7% 65.94 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 27

| | | | Rotation Speed | | | | |
|---|---|---|---|---|---|---|---|
| Hight mm | Pitch mm | Floating Ball | Comp. Ex. 142 6 rpm | Comp. Ex. 143 10 rpm | Comp. Ex. 144 20 rpm | Ex. 94 30 rpm | Ex. 95 45 rpm |
| 6%-18 | 8% 75.36 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |

TABLE 27-continued

| | | | Rotation Speed | | | |
|---|---|---|---|---|---|---|
| Hight mm | Pitch mm | Floating Ball | Ex. 96 60 rpm | Comp. Ex. 145 90 rpm | Comp. Ex. 146 120 rpm | Comp. Ex. 147 140 rpm |
| 6%-18 | 8% 75.36 | Red(0.95) White(1.0) | Contacted. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 28

| | | | Rotation Speed | | | | |
|---|---|---|---|---|---|---|---|
| Hight mm | Pitch mm | Floating Ball | Comp. Ex. 148 6 rpm | Comp. Ex. 149 10 rpm | Comp. Ex. 150 20 rpm | Ex. 97 30 rpm | Ex. 98 45 rpm |
| 6%-18 | 9% 84.78 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| | | | Rotation Speed | | | |
|---|---|---|---|---|---|---|
| Hight mm | Pitch mm | Floating Ball | Ex. 99 60 rpm | Comp. Ex. 151 90 rpm | Comp. Ex. 152 120 rpm | Comp. Ex. 153 140 rpm |
| 6%-18 | 9% 84.78 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 29

| | | | Rotation Speed | | | | |
|---|---|---|---|---|---|---|---|
| Hight mm | Pitch mm | Floating Ball | Comp. Ex. 154 6 rpm | Comp. Ex. 155 10 rpm | Comp. Ex. 156 20 rpm | Ex. 100 30 rpm | Ex. 101 45 rpm |
| 7%-21 | 2% 18.84 | Red(0.95) | Rolled along the inner wall. | Rolled along the inner wall. | Rolled along the inner wall. | Contacted partially. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted partially. | Bounced and contacted. |

| | | | Rotation Speed | | | |
|---|---|---|---|---|---|---|
| Hight mm | Pitch mm | Floating Ball | Ex. 102 60 rpm | Comp. Ex. 157 90 rpm | Comp. Ex. 158 120 rpm | Comp. Ex. 159 140 rpm |
| 7%-21 | 2% 18.84 | Red(0.95) White(1.0) | No contact. Moved in a circular motion along the vicinity of the inner wall. | No contact. Gathered in the center. | No contact. Gathered in the center. | No contact. Gathered in the center. |

TABLE 29-continued

| | | | | | | | |
|---|---|---|---|---|---|---|---|
| | | | Brown(1.2) | Contacted. | Pressed against the wall. | Pressed against the wall. | Pressed against the wall. |

TABLE 30

| | | | Rotation Speed | | | | |
|---|---|---|---|---|---|---|---|
| Hight mm | Pitch mm | Floating Ball | Comp. Ex. 160 6 rpm | Comp. Ex. 161 10 rpm | Comp. Ex. 162 20 rpm | Ex. 103 30 rpm | Ex. 104 45 rpm |
| 7%-21 | 3% 28.26 | Red(0.95) | Rolled along the inner wall. | Rolled along the inner wall. | Bounced and contacted. | Contacted. | No contact. |
| | | White(1.0) | Moved back and forth irregularly between the wall. | Contacted. | Contacted. | Moved in a circular motion along the vicinity of the inner wall. | Moved in a circular motion along the vicinity of the inner wall. |
| | | Brown(1.2) | Rolled along the inner wall. | Rolled along the inner wall. | Bounced and contacted. | Contacted partially. | Contacted partially. |

| | | | Rotation Speed | | | |
|---|---|---|---|---|---|---|
| Hight mm | Pitch mm | Floating Ball | Ex. 105 60 rpm | Comp. Ex. 163 90 rpm | Comp. Ex. 164 120 rpm | Comp. Ex. 165 140 rpm |
| 7%-21 | 3% 28.26 | Red(0.95) | No contact. | No contact. | No contact. | No contact. |
| | | White(1.0) | Moved in a circular motion along the vicinity of the inner wall. | Gathered in the center. | Gathered in the center. | Gathered in the center. |
| | | Brown(1.2) | Pressed against the wall. | Pressed against the wall. | Pressed against the wall. | Pressed against the wall. |

TABLE 31

| | | | Rotation Speed | | | | |
|---|---|---|---|---|---|---|---|
| Hight mm | Pitch mm | Floating Ball | Comp. Ex. 166 6 rpm | Comp. Ex. 167 10 rpm | Comp. Ex. 168 20 rpm | Ex. 106 30 rpm | Ex. 107 45 rpm |
| 7%-21 | 5% 47.1 | Red(0.95) | Rolled along the inner wall. | Rolled along the inner wall. | Rolled along the inner wall. | Rolled along the inner wall. | Bounced and contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Rolled along the inner wall. | Bounced and contacted. |

| | | | Rotation Speed | | | |
|---|---|---|---|---|---|---|
| Hight mm | Pitch mm | Floating Ball | Ex. 108 60 rpm | Comp. Ex. 169 90 rpm | Comp. Ex. 170 120 rpm | Comp. Ex. 171 140 rpm |
| 7%-21 | 5% 47.1 | Red(0.95) | No contact. | No contact. | No contact. | No contact. |
| | | White(1.0) | Moved in a circular motion along the vicinity of the inner wall. | Gathered in the center. | Gathered in the center. | Gathered in the center. |
| | | Brown(1.2) | Bounced and contacted. | Pressed against the wall. | Pressed against the wall. | Pressed against the wall. |

TABLE 32

| Hight mm | Pitch mm | Floating Ball | Rotation Speed: Comp. Ex. 172 6 rpm | Comp. Ex. 173 10 rpm | Comp. Ex. 174 20 rpm | Ex. 109 30 rpm | Ex. 110 45 rpm |
|---|---|---|---|---|---|---|---|
| 7%-21 | 6% 56.52 | Red(0.95) | Rolled along the inner wall. | Rolled along the inner wall. | Contacted partially. | Contacted partially. | Contacted partially. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Rolled along the inner wall. | Contacted partially. |

| Hight mm | Pitch mm | Floating Ball | Rotation Speed: Ex. 111 60 rpm | Comp. Ex. 175 90 rpm | Comp. Ex. 176 120 rpm | Comp. Ex. 177 140 rpm |
|---|---|---|---|---|---|---|
| 7%-21 | 6% 56.52 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Pressed against the wall. | Pressed against the wall. | Pressed against the wall. | Pressed against the wall. |

TABLE 33

| Hight mm | Pitch mm | Floating Ball | Rotation Speed: Comp. Ex. 178 6 rpm | Comp. Ex. 179 10 rpm | Comp. Ex. 180 20 rpm | Ex. 112 30 rpm | Ex. 113 45 rpm |
|---|---|---|---|---|---|---|---|
| 7%-21 | 7% 65.94 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed: Ex. 114 60 rpm | Comp. Ex. 181 90 rpm | Comp. Ex. 182 120 rpm | Comp. Ex. 183 140 rpm |
|---|---|---|---|---|---|---|
| 7%-21 | 7% 65.94 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Contacted. | Pressed against the wall. | Pressed against the wall. |

TABLE 34

| Hight mm | Pitch mm | Floating Ball | Rotation Speed: Comp. Ex. 184 6 rpm | Comp. Ex. 185 10 rpm | Comp. Ex. 186 20 rpm | Ex. 115 30 rpm | Ex. 116 45 rpm |
|---|---|---|---|---|---|---|---|
| 7%-21 | 8% 75.36 | Red(0.95) | Rolled along the inner wall. | Rolled along the inner wall. | Rolled along the inner wall. | Contacted. | Contacted. |
| | | White(1.0) | Moved back and forth irregularly | Moved back and forth irregularly | Moved back and forth irregularly | Moved in a circular motion along | Moved in a circular motion along |

TABLE 34-continued

| | | | | | | |
|---|---|---|---|---|---|---|
| | | | between the wall. | between the wall. | between the wall. | the vicinity of the inner wall. | the vicinity of the inner wall. |
| | | Brown(1.2) | Rolled along the inner wall. | Rolled along the inner wall. | Rolled along the inner wall. | Contacted. | Contacted. |
| | | | | Rotation Speed | | | |
| | Hight mm | Pitch mm | Floating Ball | Ex. 117 60 rpm | Comp. Ex. 187 90 rpm | Comp. Ex. 188 120 rpm | Comp. Ex. 189 140 rpm |
| | 7%-21 | 8% 75.36 | Red(0.95) White(1.0) | No contact. Moved in a circular motion along the vicinity of the inner wall. | No contact. Gathered in the center. | No contact. Gathered in the center. | No contact. Gathered in the center. |
| | | | Brown(1.2) | Contacted. | Pressed against the wall. | Pressed against the wall. | Pressed against the wall. |

TABLE 35

| | | | Rotation Speed | | | | |
|---|---|---|---|---|---|---|---|
| Hight mm | Pitch mm | Floating Ball | Comp. Ex. 190 6 rpm | Comp. Ex. 191 10 rpm | Comp. Ex. 192 20 rpm | Ex. 118 30 rpm | Ex. 119 45 rpm |
| 7%-21 | 9% 84.78 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |
| | | | | Rotation Speed | | | |
| | Hight mm | Pitch mm | Floating Ball | Ex. 120 60 rpm | Comp. Ex. 193 90 rpm | Comp. Ex. 194 120 rpm | Comp. Ex. 195 140 rpm |
| | 7%-21 | 9% 84.78 | Red(0.95) White(1.0) | No contact. Moved in a circular motion along the vicinity of the inner wall. | No contact. Gathered in the center. | No contact. Gathered in the center. | No contact. Gathered in the center. |
| | | | Brown(1.2) | Pressed against the wall. | Pressed against the wall. | Pressed against the wall. | Pressed against the wall. |

TABLE 36

| | | | Rotation Speed | | | | |
|---|---|---|---|---|---|---|---|
| Hight mm | Pitch mm | Floating Ball | Comp. Ex. 196 6 rpm | Comp. Ex. 197 10 rpm | Comp. Ex. 198 20 rpm | Ex. 121 30 rpm | Ex. 122 45 rpm. |
| 8%-24 | 2% 18.84 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Bounced and contacted. | Bounced and contacted. |

TABLE 36-continued

| | | | Rotation Speed | | | |
|---|---|---|---|---|---|---|
| Hight mm | Pitch mm | Floating Ball | Ex. 123 60 rpm | Ex. 124 90 rpm | Comp. Ex. 199 120 rpm | Comp. Ex. 200 140 rpm |
| 8%-24 | 2% 18.84 | Red(0.95) White(1.0) | Contacted. Moved in a circular motion along the vicinity of the inner wall. | No contact. Moved in a circular motion along the vicinity of the inner wall. | No contact. Gathered in the center. | No contact. Gathered in the center. |
| | | Brown(1.2) | Bounced and contacted. | Pressed against the wall. | Pressed against the wall. | Pressed against the wall. |

TABLE 37

| | | | Rotation Speed | | | | |
|---|---|---|---|---|---|---|---|
| Hight mm | Pitch mm | Floating Ball | Comp. Ex. 201 6 rpm | Comp. Ex. 202 10 rpm | Comp. Ex. 203 20 rpm | Ex. 125 30 rpm | Ex. 126 45 rpm. |
| 8%-24 | 3% 28.26 | Red(0.95) White(1.0) | Rolled along the inner wall. Moved back and forth irregularly between the wall. | Rolled along the inner wall. Moved back and forth irregularly between the wall. | Rolled along the inner wall. Moved back and forth irregularly between the wall. | Rolled along the inner wall. Moved in a circular motion along the vicinity of the inner wall. | Contacted partially. Moved in a circular motion along the vicinity of the inner wall. |
| | | Brown(1.2) | Rolled along the inner wall. | Rolled along the inner wall. | Rolled along the inner wall. | Rolled along the inner wall. | Contacted partially. |

| | | | Rotation Speed | | | |
|---|---|---|---|---|---|---|
| Hight mm | Pitch mm | Floating Ball | Ex. 127 60 rpm | Comp. Ex. 204 90 rpm | Comp. Ex. 205 120 rpm | Comp. Ex. 206 140 rpm |
| 8%-24 | 3% 28.26 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Pressed against the wall. | Pressed against the wall. | Pressed against the wall. | Pressed against the wall. |

TABLE 38

| | | | Rotation Speed | | | | |
|---|---|---|---|---|---|---|---|
| Hight mm | Pitch mm | Floating Ball | Comp. Ex. 207 6 rpm | Comp. Ex. 208 10 rpm | Comp. Ex. 209 20 rpm | Ex. 128 30 rpm | Ex. 129 45 rpm. |
| 8%-24 | 5% 47.1 | Red(0.95) White(1.0) | Rolled along the inner wall. Moved back and forth irregularly between the wall. | Rolled along the inner wall. Moved back and forth irregularly between the wall. | Rolled along the inner wall. Moved back and forth irregularly between the wall. | Contacted partially. Moved in a circular motion along the vicinity of the inner wall. | Contacted partially. Moved in a circular motion along the vicinity of the inner wall. |
| | | Brown(1.2) | Rolled along the inner wall. | Rolled along the inner wall. | Rolled along the inner wall. | Contacted partially. | Contacted partially. |

| | | | Rotation Speed | | | |
|---|---|---|---|---|---|---|
| Hight mm | Pitch mm | Floating Ball | Ex. 130 60 rpm | Comp. Ex. 210 90 rpm | Comp. Ex. 211 120 rpm | Comp. Ex. 212 140 rpm |
| 8%-24 | 5% 47.1 | Red(0.95) White(1.0) | No contact. Moved in a circular | No contact. Gathered in the center. | No contact. Gathered in the center. | No contact. Gathered in the center. |

TABLE 38-continued

| | | | | | | | |
|---|---|---|---|---|---|---|---|
| | | | | motion along the vicinity of the inner wall. | | | |
| | | | Brown(1.2) | Contacted partially. | Pressed against the wall. | Pressed against the wall. | Pressed against the wall. |

TABLE 39

| | | | Rotation Speed | | | | |
|---|---|---|---|---|---|---|---|
| Hight mm | Pitch mm | Floating Ball | Comp. Ex. 213 6 rpm | Comp. Ex. 214 10 rpm | Comp. Ex. 215 20 rpm | Ex. 131 30 rpm | Ex. 132 45 rpm |
| 8%-24 | 6% 56.52 | Red(0.95) | Rolled along the inner wall. | Rolled along the inner wall. | Contacted partially. | Contacted partially. | Contacted partially. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted partially. | Contacted partially. | Contacted partially. |

| | | | Rotation Speed | | | |
|---|---|---|---|---|---|---|
| Hight mm | Pitch mm | Floating Ball | Ex. 133 60 rpm | Comp. Ex. 216 90 rpm | Comp. Ex. 217 120 rpm | Comp. Ex. 218 140 rpm |
| 8%-24 | 6% 56.52 | Red(0.95) White(1.0) | No contact. Moved in a circular motion along the vicinity of the inner wall. | No contact. Gathered in the center. motion along the vicinity of the inner wall. | No contact. Gathered in the center. | No contact. Gathered in the center. |
| | | Brown(1.2) | Pressed against the wall. | Pressed against the wall. | Pressed against the wall. | Pressed against the wall. |

TABLE 40

| | | | Rotation Speed | | | | |
|---|---|---|---|---|---|---|---|
| Hight mm | Pitch mm | Floating Ball | Comp. Ex. 219 6 rpm | Comp. Ex. 220 10 rpm | Comp. Ex. 221 20 rpm | Ex. 134 30 rpm | Ex. 135 45 rpm. |
| 8%-24 | 7% 65.94 | Red(0.95) | Rolled along the inner wall. | Rolled along the inner wall. | Rolled along the inner wall. | Contacted. | Contacted partially. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |

| | | | Rotation Speed | | | |
|---|---|---|---|---|---|---|
| Hight mm | Pitch mm | Floating Ball | Ex. 136 60 rpm | Comp. Ex. 222 90 rpm | Comp. Ex. 223 120 rpm | Comp. Ex. 224 140 rpm |
| 8%-24 | 7% 65.94 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Pressed against the wall. | Pressed against the wall. | Pressed against the wall. | Pressed against the wall. |

TABLE 41

| Hight mm | Pitch mm | Floating Ball | Rotation Speed Comp. Ex. 225 6 rpm | Comp. Ex. 226 10 rpm | Comp. Ex. 227 20 rpm | Ex. 137 30 rpm | Ex. 138 45 rpm. |
|---|---|---|---|---|---|---|---|
| 8%-24 | 8% 75.36 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed Ex. 139 60 rpm | Comp. Ex. 228 90 rpm | Comp. Ex. 229 120 rpm | Comp. Ex. 230 140 rpm |
|---|---|---|---|---|---|---|
| 8%-24 | 8% 75.36 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 42

| Hight mm | Pitch mm | Floating Ball | Rotation Speed Comp. Ex. 231 6 rpm | Comp. Ex. 232 10 rpm | Comp. Ex. 233 20 rpm | Ex. 140 30 rpm | Ex. 141 45 rpm. |
|---|---|---|---|---|---|---|---|
| 8%-24 | 9% 84.78 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| Hight mm | Pitch mm | Floating Ball | Rotation Speed Ex. 142 60 rpm | Comp. Ex. 234 90 rpm | Comp. Ex. 235 120 rpm | Comp. Ex. 236 140 rpm |
|---|---|---|---|---|---|---|
| 8%-24 | 9% 84.78 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Pressed against the wall. | Pressed against the wall. | Pressed against the wall. | Pressed against the wall. |

TABLE 43

| Hight mm | Pitch mm | Floating Ball | Rotation Speed Comp. Ex. 237 6 rpm | Comp. Ex. 238 10 rpm | Comp. Ex. 239 20 rpm | Ex. 143 30 rpm | Ex. 144 45 rpm. |
|---|---|---|---|---|---|---|---|
| 9%-27 | 2% 18.84 | Red(0.95) | Rolled along the inner wall. | Rolled along the inner wall. | Contacted partially. | Contacted partially. | Contacted partially. |
| | | White(1.0) | Moved back and forth irregularly | Moved back and forth irregularly | Moved back and forth irregularly | Moved in a circular motion along | Moved in a circular motion along |

TABLE 43-continued

| | | | | | | |
|---|---|---|---|---|---|---|
| | | between the wall. | between the wall. | between the wall. | the vicinity of the inner wall. | the vicinity of the inner wall. |
| | Brown(1.2) | Rolled along the inner wall. | Rolled along the inner wall. | Contacted partially. | Contacted partially. | Contacted partially. |

| | | | Rotation Speed | | | |
|---|---|---|---|---|---|---|
| Hight mm | Pitch mm | Floating Ball | Ex. 145 60 rpm | Comp. Ex. 240 90 rpm | Comp. Ex. 241 120 rpm | Comp. Ex. 242 140 rpm |
| 9%-27 | 2% 18.84 | Red(0.95) White(1.0) | Contacted. Moved in a circular motion along the vicinity of the inner wall. | No contact. Gathered in the center. | No contact. Gathered in the center. | No contact. Gathered in the center. |
| | | Brown(1.2) | Pressed against the wall. | Pressed against the wall. | Pressed against the wall. | Pressed against the wall. |

TABLE 44

| | | | Rotation Speed | | | | |
|---|---|---|---|---|---|---|---|
| Hight mm | Pitch mm | Floating Ball | Comp. Ex. 243 6 rpm | Comp. Ex. 244 10 rpm | Comp. Ex. 245 20 rpm | Ex. 146 30 rpm | Ex. 147 45 rpm |
| 9%-27 | 3% 28.26 | Red(0.95) White(1.0) | Rolled along the inner wall. Moved back and forth irregularly between the wall. | Rolled along the inner wall. Moved back and forth irregularly between the wall. | Rolled along the inner wall. Moved back and forth irregularly between the wall. | Contacted partially. Moved in a circular motion along the vicinity of the inner wall. | Contacted partially. Moved in a circular motion along the vicinity of the inner wall. |
| | | Brown(1.2) | Rolled along the inner wall. | Rolled along the inner wall. | Rolled along the inner wall. | Contacted partially. | Contacted partially. |

| | | | Rotation Speed | | | |
|---|---|---|---|---|---|---|
| Hight mm | Pitch mm | Floating Ball | Ex. 148 60 rpm | Comp. Ex. 246 90 rpm | Comp. Ex. 247 120 rpm | Comp. Ex. 248 140 rpm |
| 9%-27 | 3% 28.26 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted partially. | Pressed against the wall. | Pressed against the wall. | Pressed against the wall. |

TABLE 45

| | | | Rotation Speed | | | | |
|---|---|---|---|---|---|---|---|
| Hight mm | Pitch mm | Floating Ball | Comp. Ex. 249 6 rpm | Comp. Ex. 250 10 rpm | Comp. Ex. 251 20 rpm | Ex. 149 30 rpm | Ex. 150 45 rpm |
| 9%-27 | 5% 47.1 | Red(0.95) White(1.0) | Rolled along the inner wall. Moved back and forth irregularly between the wall. | Rolled along the inner wall. Moved back and forth irregularly between the wall. | Rolled along the inner wall. Moved back and forth irregularly between the wall. | Contacted partially. Moved in a circular motion along the vicinity of the inner wall. | Contacted partially. Moved in a circular motion along the vicinity of the inner wall. |
| | | Brown(1.2) | Rolled along the inner wall. | Rolled along the inner wall. | Rolled along the inner wall. | Contacted partially. | Contacted partially. |

TABLE 45-continued

| | | | Rotation Speed | | | |
|---|---|---|---|---|---|---|
| Hight mm | Pitch mm | Floating Ball | Ex. 151 60 rpm | Comp. Ex. 252 90 rpm | Comp. Ex. 253 120 rpm | Comp. Ex. 254 140 rpm |
| 9%-27 | 5% 47.1 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Pressed against the wall. | Pressed against the wall. | Pressed against the wall. | Pressed against the wall. |

TABLE 46

| | | | Rotation Speed | | | | |
|---|---|---|---|---|---|---|---|
| Hight mm | Pitch mm | Floating Ball | Comp. Ex. 255 6 rpm | Comp. Ex. 256 10 rpm | Comp. Ex. 257 20 rpm | Ex. 152 30 rpm | Ex. 153 45 rpm |
| 9%-27 | 6% 56.52 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| | | | Rotation Speed | | | |
|---|---|---|---|---|---|---|
| Hight mm | Pitch mm | Floating Ball | Ex. 154 60 rpm | Comp. Ex. 258 90 rpm | Comp. Ex. 259 120 rpm | Comp. Ex. 260 140 rpm |
| 9%-27 | 6% 56.52 | Red(0.95) White(1.0) | No contact. Moved in a circular motion along the vicinity of the inner wall. | No contact. Gathered in the center. | No contact. Gathered in the center. | No contact. Gathered in the center. |
| | | Brown(1.2) | Contacted. | Pressed against the wall. | Pressed against the wall. | Pressed against the wall. |

TABLE 47

| | | | Rotation Speed | | | | |
|---|---|---|---|---|---|---|---|
| Hight mm | Pitch mm | Floating Ball | Comp. Ex. 261 6 rpm | Comp. Ex. 262 10 rpm | Comp. Ex. 263 20 rpm | Ex. 155 30 rpm | Ex. 156 45 rpm |
| 9%-27 | 7% 65.94 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| | | | Rotation Speed | | | |
|---|---|---|---|---|---|---|
| Hight mm | Pitch mm | Floating Ball | Ex. 157 60 rpm | Comp. Ex. 264 90 rpm | Comp. Ex. 265 120 rpm | Comp. Ex. 266 140 rpm |
| 9%-27 | 7% 65.94 | Red(0.95) White(1.0) | No contact. Moved in a circular | No contact. Gathered in the center. | No contact. Gathered in the center. | No contact. Gathered in the center. |

TABLE 47-continued

| | | | | | | | |
|---|---|---|---|---|---|---|---|
| | | | | motion along the vicinity of the inner wall. | | | |
| | | | Brown(1.2) | Contacted. | Pressed against the wall. | Pressed against the wall. | Pressed against the wall. |

TABLE 48

| | | | Rotation Speed | | | | |
|---|---|---|---|---|---|---|---|
| Hight mm | Pitch mm | Floating Ball | Comp. Ex. 267 6 rpm | Comp. Ex. 268 10 rpm | Comp. Ex. 269 20 rpm | Ex. 158 30 rpm | Ex. 159 45 rpm |
| 9%-27 | 8% 75.36 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| | | | | Rotation Speed | | | |
|---|---|---|---|---|---|---|---|
| | Hight mm | Pitch mm | Floating Ball | Ex. 160 60 rpm | Comp. Ex. 270 90 rpm | Comp. Ex. 271 120 rpm | Comp. Ex. 272 140 rpm |
| | 9%-27 | 8% 75.36 | Red(0.95) | No contact. | No contact. | No contact. | No contact. |
| | | | White(1.0) | Moved in a circular motion along the vicinity of the inner wall. | Gathered in the center. | Gathered in the center. | Gathered in the center. |
| | | | Brown(1.2) | Contacted. | Pressed against the wall. | Pressed against the wall. | Pressed against the wall. |

TABLE 49

| | | | Rotation Speed | | | | |
|---|---|---|---|---|---|---|---|
| Hight mm | Pitch mm | Floating Ball | Comp. Ex. 273 6 rpm | Comp. Ex. 274 10 rpm | Comp. Ex. 275 20 rpm | Ex. 161 30 rpm | Ex. 162 45 rpm |
| 9%-27 | 9% 84.78 | Red(0.95) | Rolled along the inner wall. | Rolled along the inner wall. | Contacted. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Contacted. | Contacted. | Contacted. |

| | | | | Rotation Speed | | | |
|---|---|---|---|---|---|---|---|
| | Hight mm | Pitch mm | Floating Ball | Ex. 163 60 rpm | Comp. Ex. 276 90 rpm | Comp. Ex. 277 120 rpm | Comp. Ex. 278 140 rpm |
| | 9%-27 | 9% 84.78 | Red(0.95) | Contacted. | No contact. | No contact. | No contact. |
| | | | White(1.0) | Moved in a circular motion along the vicinity of the inner wall. | Gathered in the center. | Gathered in the center. | Gathered in the center. |
| | | | Brown(1.2) | Pressed against the wall. | Pressed against the wall. | Pressed against the wall. | Pressed against the wall. |

TABLE 50

| Hight mm | Pitch mm | Floating Ball | Rotation Speed Comp. Ex. 279 6 rpm | Comp. Ex. 280 10 rpm | Comp. Ex. 281 20 rpm | Ex. 164 30 rpm | Ex. 165 45 rpm |
|---|---|---|---|---|---|---|---|
| 4%-12 | 4% 37.68 | Red(0.95) | Rolled along the inner wall. | Rolled along the inner wall. | Rolled along the inner wall. | Contacted. | Contacted. |
| | | White(1.0) | Moved back and forth irregularly between the wall. | Moved back and forth irregularly between the wall. | Moved back and forth irregularly between the wall. | Moved in a circular motion along the vicinity of the inner wall. | Moved in a circular motion along the vicinity of the inner wall. |
| | | Brown(1.2) | Rolled along the inner wall. | Rolled along the inner wall. | Rolled along the inner wall. | Contacted. | Contacted. |

| Hight mm | Pitch mm | Floating Ball | Rotation Speed Ex. 166 60 rpm | Ex. 167 90 rpm | Comp. Ex. 282 120 rpm | Comp. Ex. 283 140 rpm |
|---|---|---|---|---|---|---|
| 4%-12 | 4% 37.68 | Red(0.95) | No contact. | No contact. | No contact. | No contact. |
| | | White(1.0) | Moved in a circular motion along the vicinity of the inner wall. | Moved in a circular motion along the vicinity of the inner wall. | Gathered in the center. | Gathered in the center. |
| | | Brown(1.2) | Pressed against the wall. | Pressed against the wall. | Pressed against the wall. | Pressed against the wall. |

As the specific gravity of a white small ball is 1.0, behaviors of white small balls are corresponding to behaviors of laundry articles placed in a frame body. When red small balls rolled along the inner periphery of the frame body, or when brown small balls rolled along the inner periphery of the frame body, a "wall of current" 49 should not formed in the frame body. When red small balls moved away from the inner periphery and brown small balls staid as like being pushed on the inner periphery, the cleaning liquid should gather at the center of the frame body to make it difficult to realize any effective washing, even if the "wall of current" 49 would be formed. When white small balls did not contact the inner periphery of the frame body, and did not gather at the center of the frame body, an excellent "wall of current" 49 should be formed.

In such a case, under the above mentioned circumstances of each embodiment, the excellent "wall of current" is formed in the frame body. Then, the laundry article is maintained in a near-zero gravity state. As a result, the laundry article is widely spread out to realize effective washing.

REFERENCE NUMERALS

Figure 1:
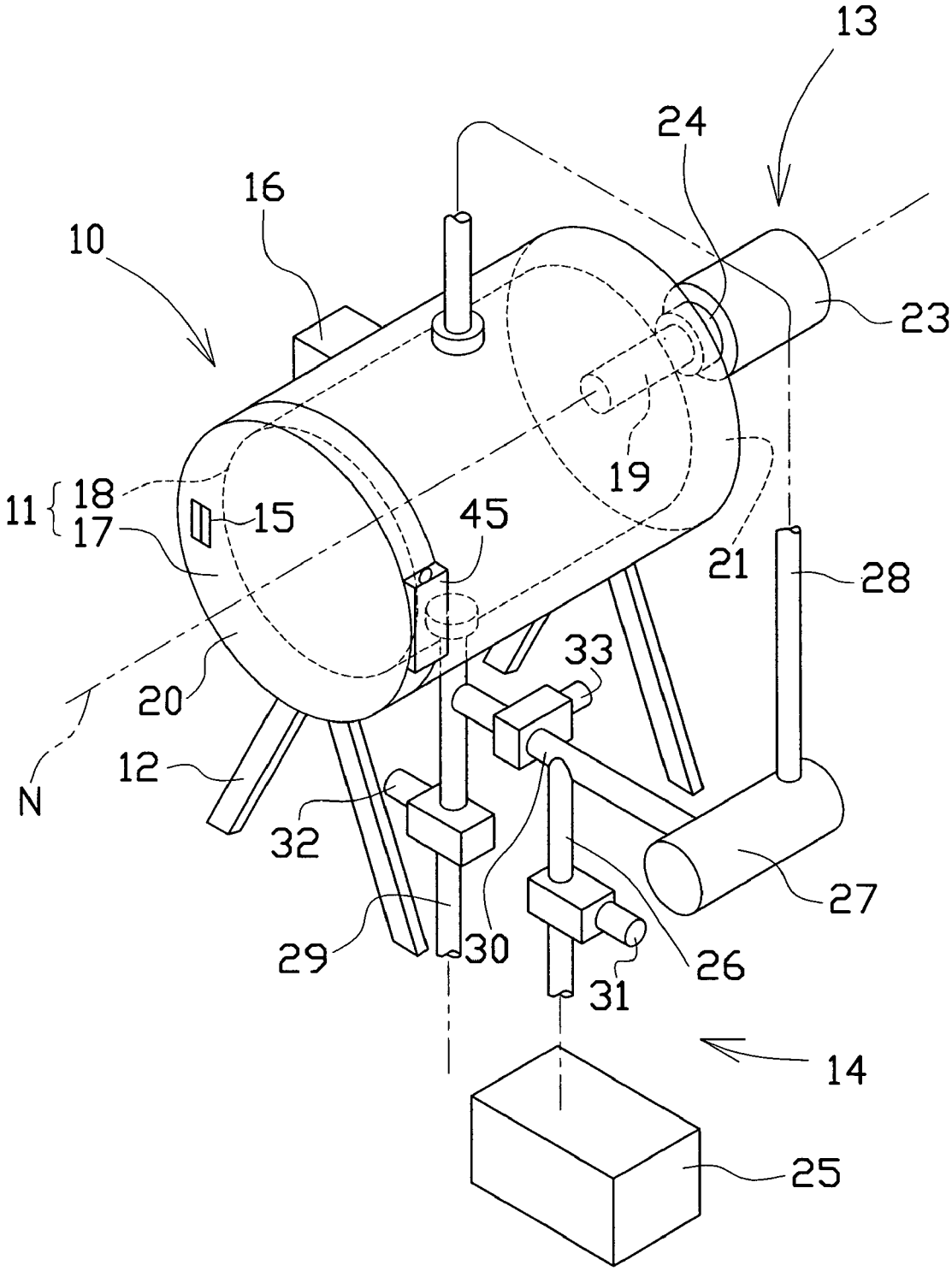
FIG. 1 is a schematic diagram showing a washing apparatus to be used for implementing a washing method according to one embodiment of this invention.
Figure 2:
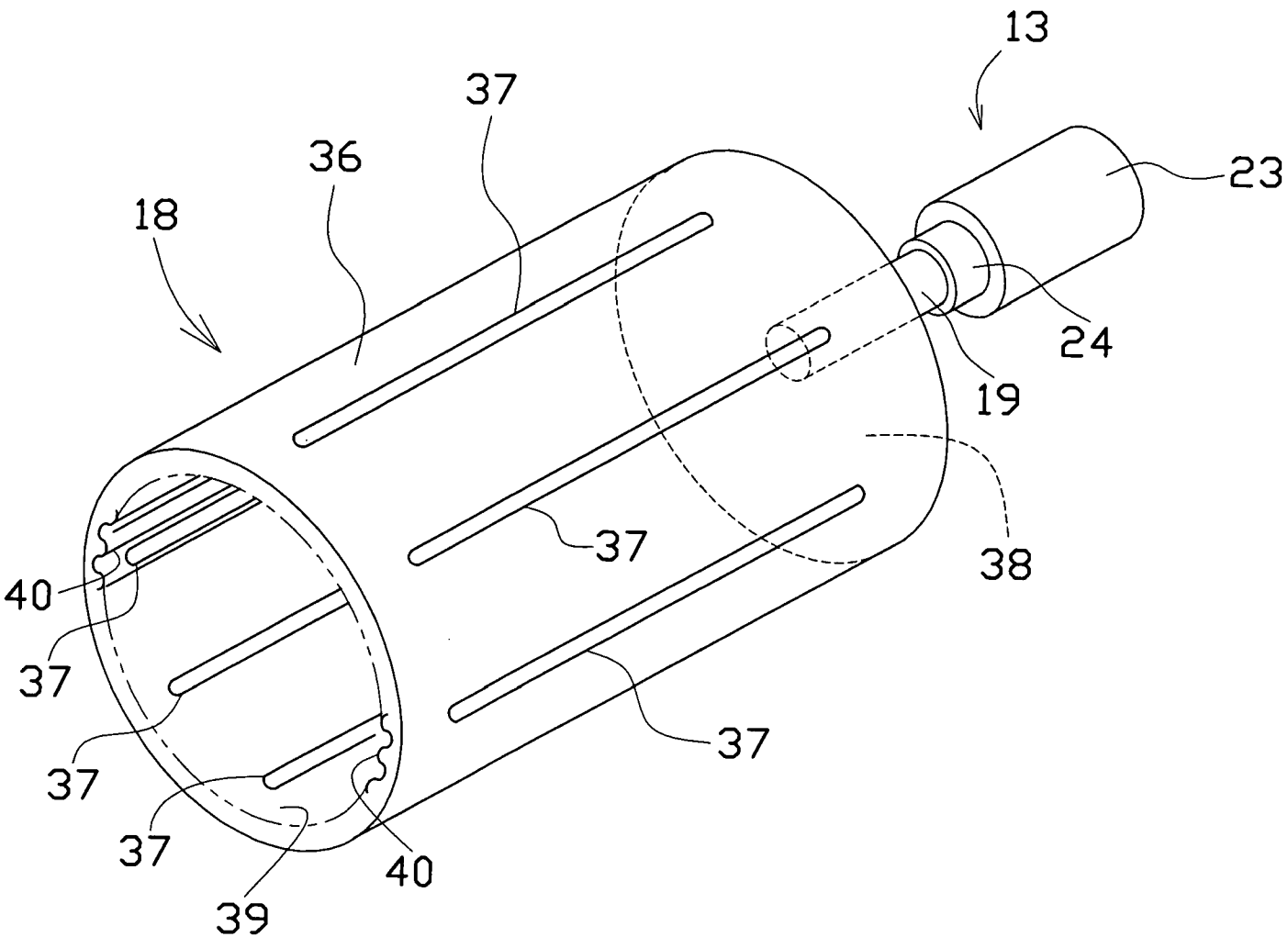
FIG. 2 is a perspective view showing a frame body of a washing apparatus according to the embodiment of this invention.
Figure 3:
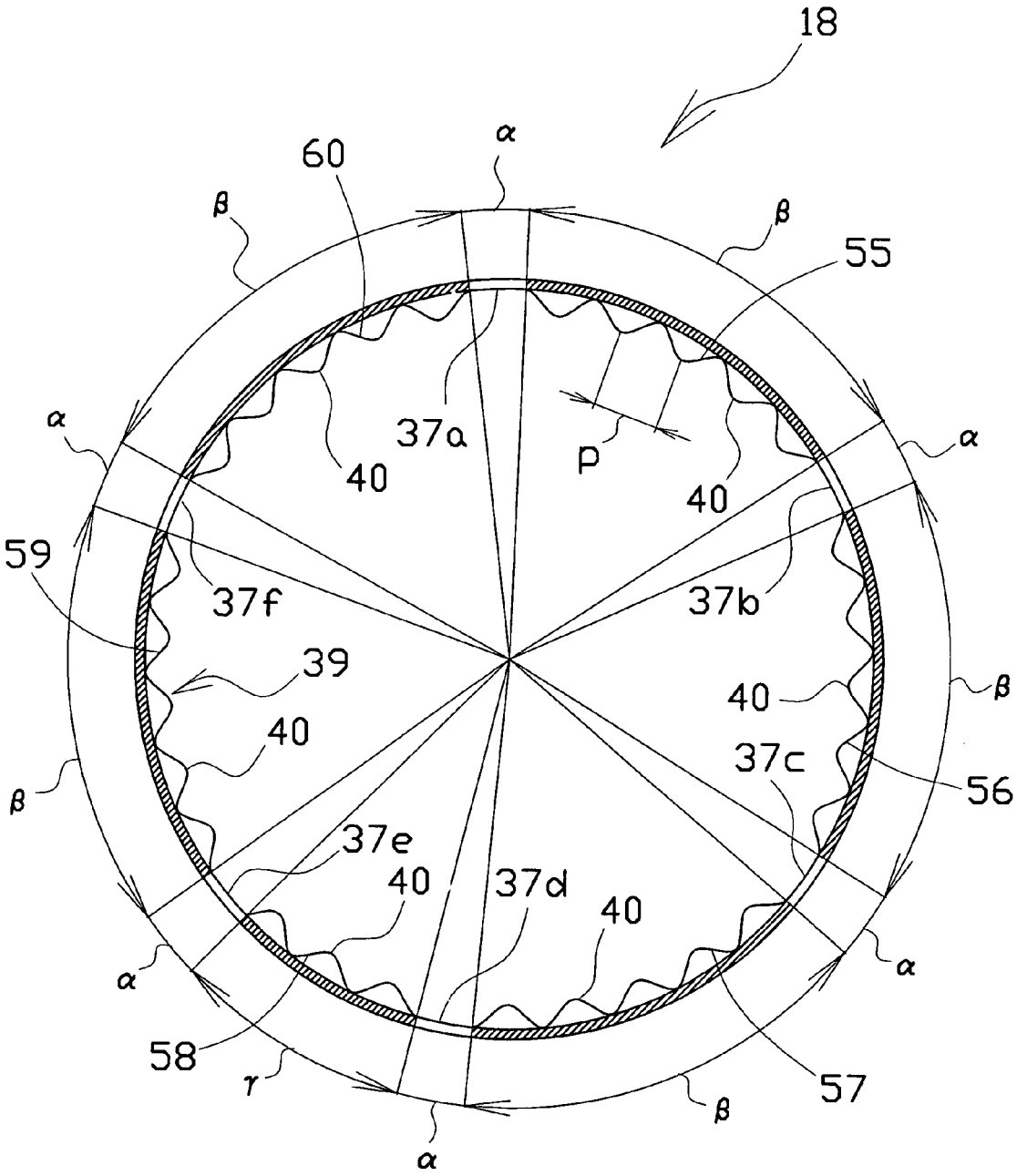
FIG. 3 is a sectional view showing the frame body of the washing apparatus according to the embodiment of this invention.
Figure 4:
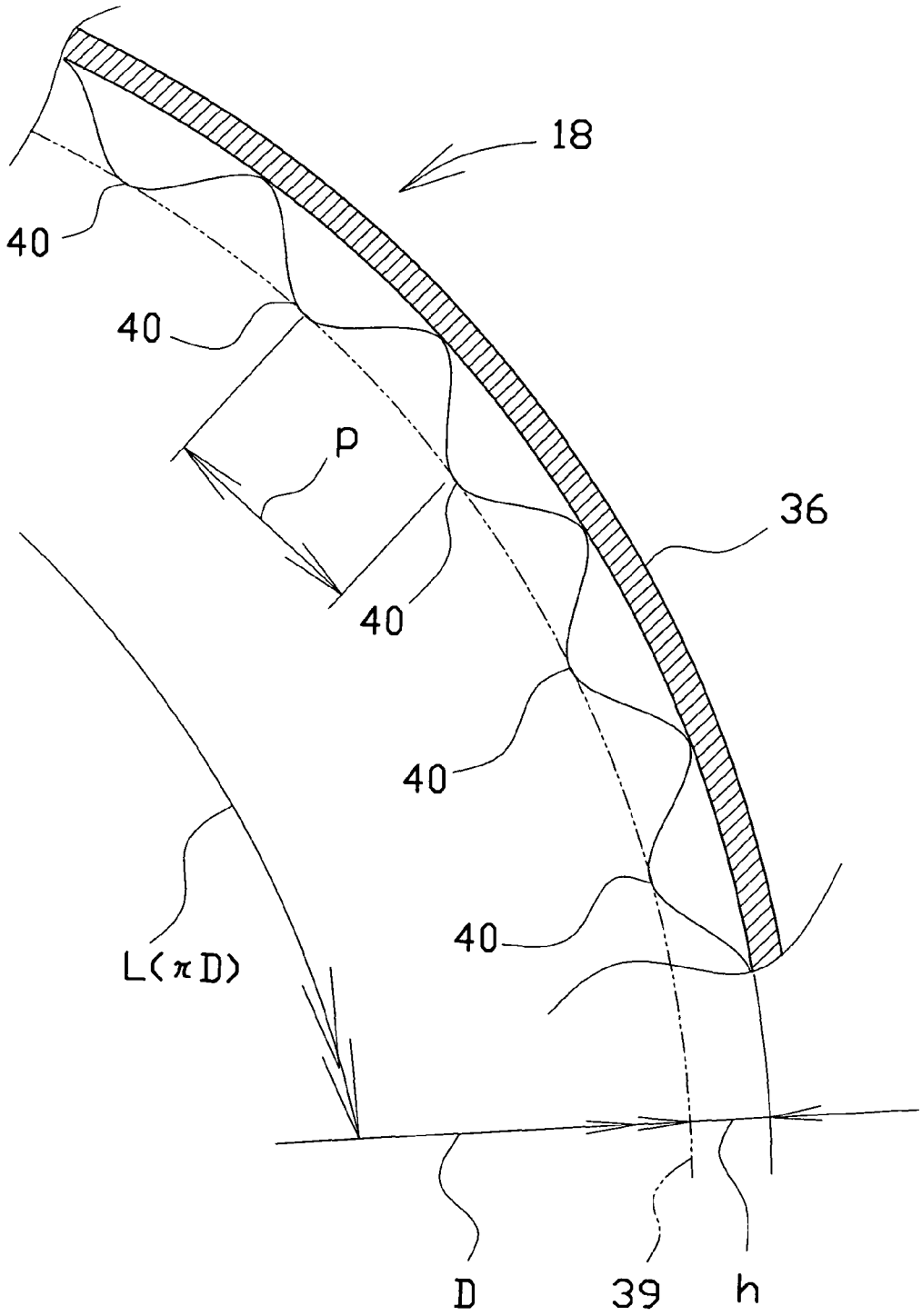
FIG. 4 is an enlarged view showing a major part of FIG. 3.
Figure 5:
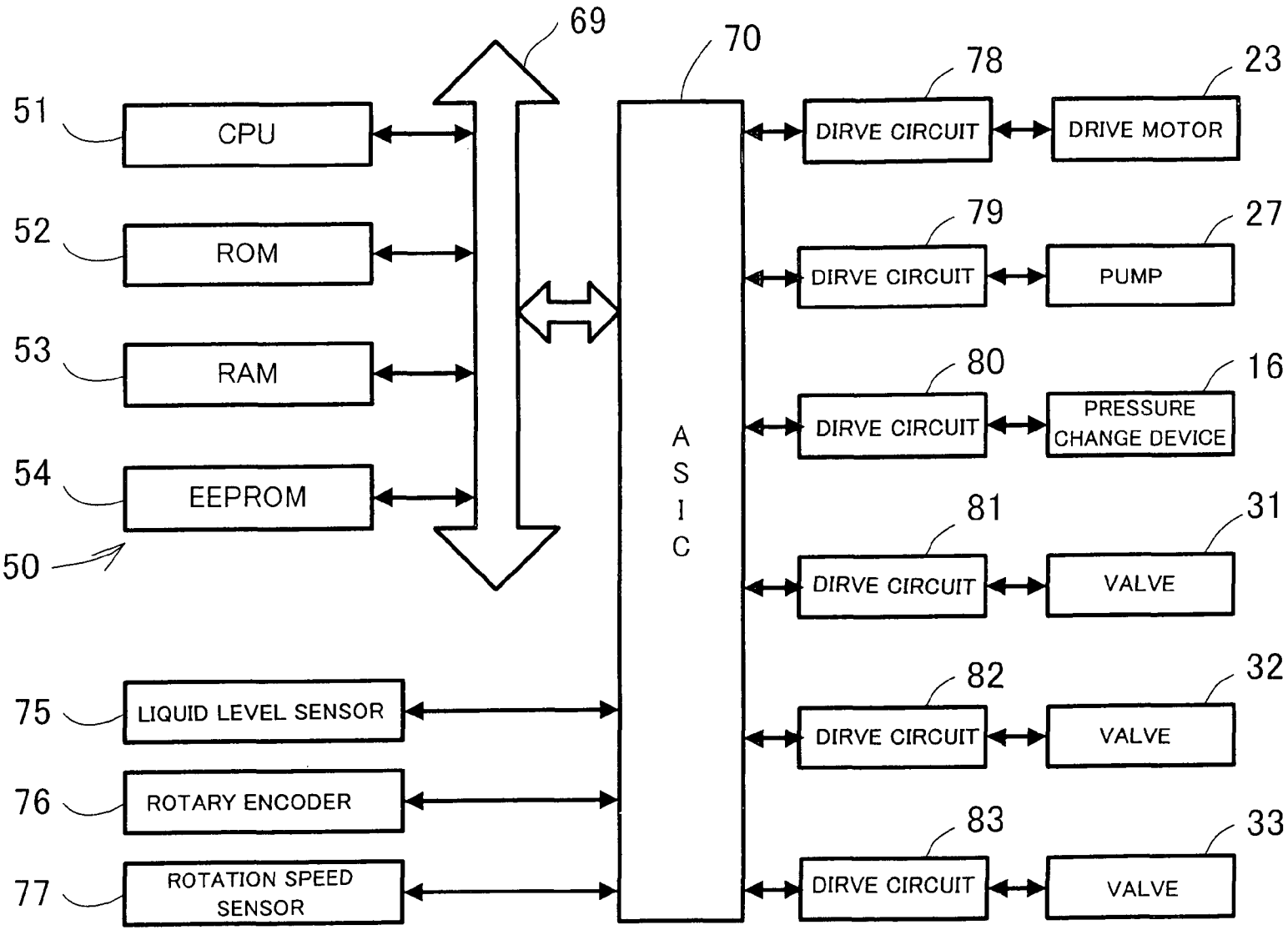
FIG. 5 is a schematic diagram showing a constitution of a control device of the washing apparatus according to the embodiment of this invention.
Figure 6:
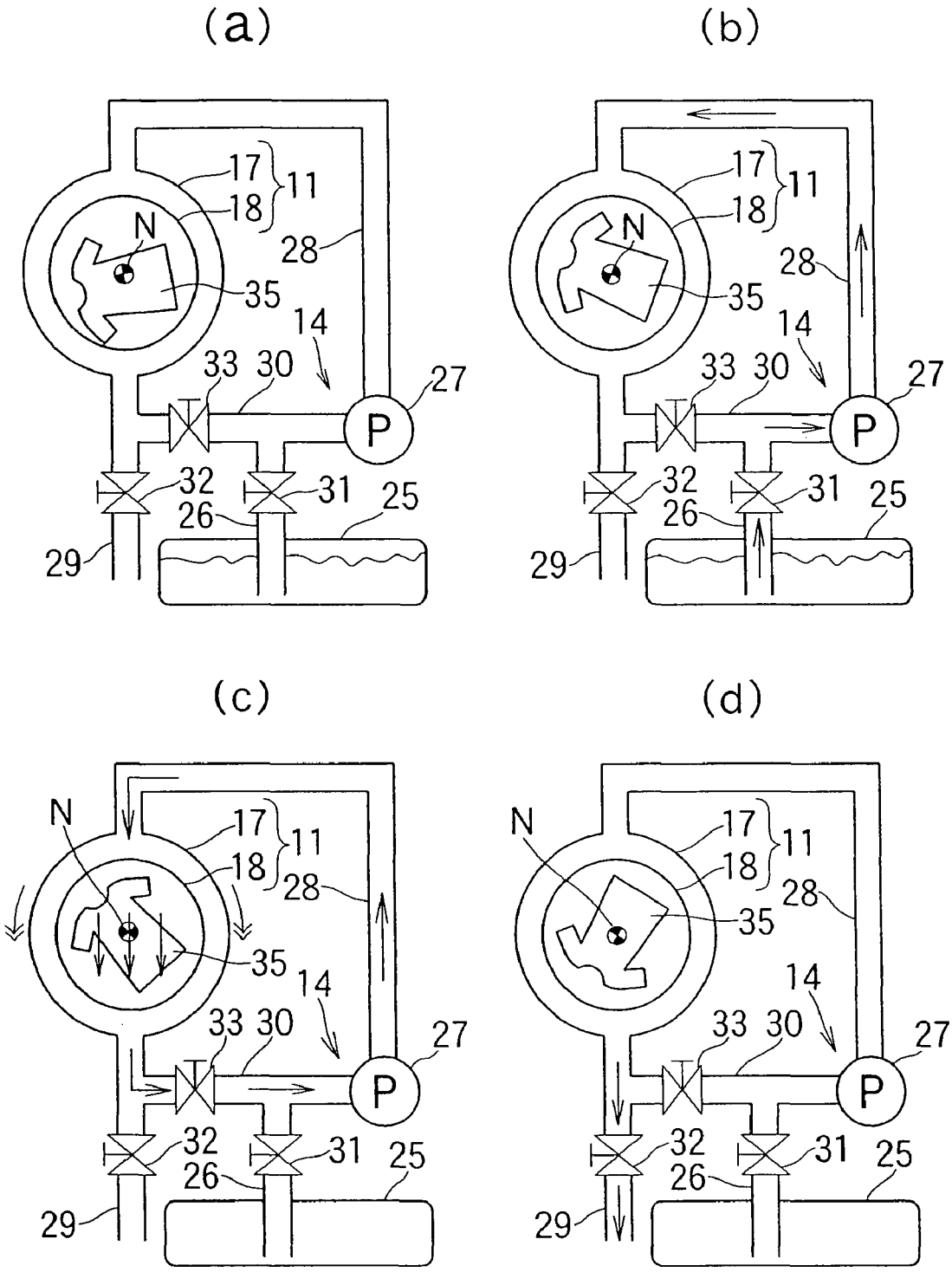
FIG. 6 is a diagram schematically showing a procedure of washing by the washing apparatus according to the embodiment of this invention.
Figure 7:
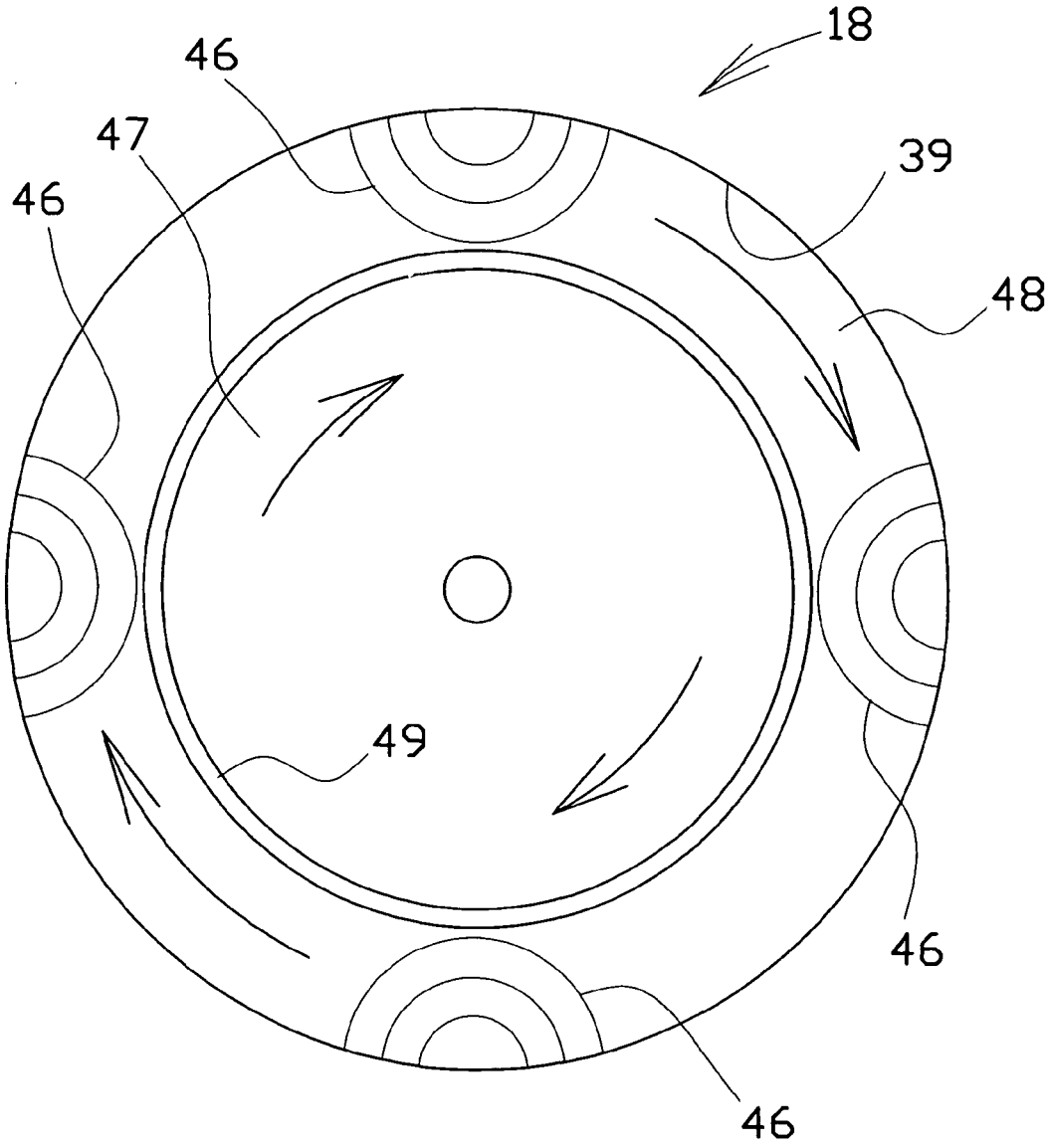
FIG. 7 is a diagram schematically showing a current of cleaning liquid in the rotating flame body according to the embodiment of this invention.

N: center
D: inner diameter
h: height
h: pitch
10: washing apparatus
11: washing tub unit
12: support device
13: rotation drive device
14: cleaning liquid supply device
16: pressure change device
17: casing
18: frame body
19: central shaft
21: end face
23: drive motor
24: drive shaft
25: tank
26: induction pipe
27: pump
28: supply pipe
29: drain pipe
30: bypass pipe
31: valve
32: valve
33: valve
35: clothes
36: periphery
37: slit
38: rear end
39: inner periphery
40: protruded part
49: wall of currents

50: control device
55: thin plate
56: thin plate
57: thin plate
58: thin plate
59: thin plate
60: thin plate

The invention claimed is:

1. A washing apparatus comprising:

an outer casing being disposed to contain cleaning liquid containing a surfactant;

a cylindrical basket-like washing tub being disposed in the outer casing;

a plurality of protruding portions protruding from an inner periphery of the cylindrical basket-like washing tub in a radial direction of the cylindrical basket-like washing tub and extending along an axial direction of the cylindrical basket-like washing tub;

a rotating mechanism for rotating the cylindrical basket-like washing tub about a central shaft in the outer casing while supporting the cylindrical basket-like washing tub in such a manner that the central shaft of the cylindrical basket-like washing tub is held horizontally;

a sensor being diagnosed to detect the level of the cleaning liquid in the outer casing; and a controller for starting a rotation of the cylindrical basket-like washing tub rotated by the rotating mechanism when the cylindrical basket-like washing tub is full of the cleaning liquid and for controlling a rotation speed of the cylindrical basket-like washing tub by the rotating mechanism so that a peripheral speed of the inner periphery of the cylindrical basket-like washing tub is from 28 meter/min to 57 meter/min.

2. A washing apparatus comprising:

an outer casing being disposed to contain liquid for washing;

a cylindrical basket-like washing tub being disposed in the outer casing and disposed to contain clothing to be washed;

a plurality of protruding portions being disposed on an inner surface of the cylindrical basket-like washing tub, the plurality of protruding portions protruding in a radial direction of the cylindrical basket-like washing tub and extending along an axial direction of the cylindrical basket-like washing tub;

a rotating mechanism being disposed to rotate the cylindrical basket-like washing tub about a central shaft in the outer casing;

a sensor being disposed to detect the level of the liquid in the outer casing; and a controller being disposed to start rotating the cylindrical basket-like washing tub by the rotating mechanism when the cylindrical basket-like washing tub is confirmed to be full of the liquid.

3. The washing apparatus according to claim 2, wherein the height h of the protruding portions is set to be from 2.0% to 9.0% of an inner diameter D of the cylindrical basket-like washing tub, and the pitch p of the protruding portions is set to be from 2.0% to 9.0% of a peripheral length L of the imaginary circle having the diameter of the inner diameter D.

4. The washing apparatus according to claim 2, wherein the rotating mechanism rotates the cylindrical basket-like washing tub intermittently.

5. The washing apparatus according to claim 2, wherein the rotating mechanism rotates the cylindrical basket-like washing tub normally and reversely.

6. The washing apparatus according to claim 2, further comprising a pressure change device for varying the pressure of the cleaning liquid in the cylindrical basket-like washing tub.

7. The washing apparatus according to claim 2, wherein the height h of the protruding portions is set to be from 3.0% to 6.0% of an inner diameter D of the cylindrical basket-like washing tub, and the pitch p of the protruding portions is set to be from 3.0% to 6.0% of a peripheral length L of an imaginary circle having the diameter of the inner diameter D.

8. The washing apparatus according to claim 2, wherein an inner diameter D of the cylindrical basket-like washing tub is set to be from 300 mm to 850 mm.

9. The washing apparatus according to claim 2, wherein the rotating mechanism supports the cylindrical basket-like washing tub such that the central shaft of the cylindrical basket-like washing tub is held horizontally.

10. The washing apparatus according to claim 2, wherein the controller is disposed to control a rotation speed of the cylindrical basket-like washing tub by the rotating mechanism such that a peripheral speed of the inner periphery of the cylindrical basket-like washing tub is from 28 meter/min to 57 meter/min.

11. A washing apparatus comprising:

an outer casing being disposed to contain liquid for washing;

a cylindrical basket-like washing tub being disposed in the outer casing and disposed to contain clothing to be washed;

a plurality of protruding portions being disposed on an inner surface of the cylindrical basket-like washing tub, the plurality of protruding portions protruding in a radial direction of the cylindrical basket-like washing tub and extending along an axial direction of the cylindrical basket-like washing tub such that the clothing during a process of the washing is kept in the middle of the cylindrical basket-like washing tub and prevented from colliding with the inner surface of the cylindrical basket-like washing tub;

a rotating mechanism being disposed to rotate the cylindrical basket-like washing tub about a central shaft in the outer casing;

a sensor being disposed to detect the level of the liquid in the outer casing; and a controller being disposed to start rotating the cylindrical basket-like washing tub by the rotating mechanism when the cylindrical basket-like washing tub is confirmed to be full of the liquid.

12. The washing apparatus according to claim 11, wherein the rotating mechanism supports the cylindrical basket-like washing tub such that the central shaft of the cylindrical basket-like washing tub is held horizontally.

* * * * *